US012649638B2

(12) United States Patent
Techlin

(10) Patent No.: US 12,649,638 B2
(45) Date of Patent: Jun. 9, 2026

(54) METHOD AND APPARATUS FOR PRODUCING CORELESS ROLL PRODUCTS

(71) Applicant: BW Converting, Inc., Green Bay, WI (US)

(72) Inventor: Michael E. Techlin, De Pere, WI (US)

(73) Assignee: BW Converting, Inc., Green Bay, WI (US)

( * ) Notice: Subject to any disclaimer, the term of this patent is extended or adjusted under 35 U.S.C. 154(b) by 231 days.

(21) Appl. No.: 18/502,521

(22) Filed: Nov. 6, 2023

(65) Prior Publication Data

US 2024/0158194 A1 May 16, 2024

Related U.S. Application Data

(60) Provisional application No. 63/424,300, filed on Nov. 10, 2022.

(51) Int. Cl.
*B65H 19/22* (2006.01)

(52) U.S. Cl.
CPC ..... *B65H 19/2292* (2013.01); *B65H 2301/418526* (2013.01); *B65H 2301/41854* (2013.01); *B65H 2701/1924* (2013.01)

(58) Field of Classification Search
CPC .. B65H 2301/4185; B65H 2301/41852; B65H 2301/41854
See application file for complete search history.

(56) References Cited

U.S. PATENT DOCUMENTS

| | | | | |
|---|---|---|---|---|
| 4,487,378 | A | 12/1984 | Kobayashi | |
| 5,027,582 | A | 7/1991 | Dearwester | |
| 5,186,099 | A | 2/1993 | Qing et al. | |
| 5,730,387 | A | 3/1998 | Yamazaki | |
| 6,056,229 | A | 5/2000 | Blume et al. | |
| 6,422,501 | B1 | 7/2002 | Hertel et al. | |
| 6,838,187 | B2 | 1/2005 | Figiel et al. | |
| 8,713,779 | B2 * | 5/2014 | Acciari | B65H 19/305 242/533 |
| 9,284,147 | B2 | 3/2016 | Techlin | |
| 9,290,347 | B2 | 3/2016 | Mazzaccherini et al. | |
| 9,919,888 | B2 | 3/2018 | Techlin | |

(Continued)

FOREIGN PATENT DOCUMENTS

| | | | |
|---|---|---|---|
| EP | 1056667 | A1 | 12/2000 |
| EP | 3822204 | A1 | 5/2021 |

(Continued)

*Primary Examiner* — Sang K Kim
(74) *Attorney, Agent, or Firm* — Thompson Coburn LLP

(57) ABSTRACT

A method is provided for removing mandrels from successive rolls of convolutely wound web material. In one aspect, a roll of web convolutely wound around a mandrel is moved to a position in which the mandrel is aligned with a clasp with the clasp spaced apart from the mandrel. The clasp is then moved along a path toward the roll. Movement of the clasp toward the roll is stopped only when the clasp is in a position to engage the mandrel. The mandrel is engaged with the clasp. The clasp and the mandrel are moved away from the roll to withdraw the mandrel from the roll. The mandrel is released from the clasp when the mandrel is removed from the roll. The mandrel is removed from the path of the clasp. The steps are repeated for a subsequent roll.

13 Claims, 26 Drawing Sheets

(56) References Cited

U.S. PATENT DOCUMENTS

| | | | | |
|---|---|---|---|---|
| 9,975,720 | B2 | 5/2018 | Techlin | |
| 10,213,066 | B2 | 2/2019 | Weisang et al. | |
| 10,676,304 | B2 | 6/2020 | Techlin | |
| 11,046,540 | B2 | 6/2021 | Techlin | |
| 11,247,863 | B2 | 2/2022 | Techlin et al. | |
| 11,261,045 | B2 | 3/2022 | Spinelli | |
| 11,383,947 | B2 | 7/2022 | Techlin | |
| 12,024,381 | B2 * | 7/2024 | Dettori | B65H 19/2292 |
| 2006/0208127 | A1 * | 9/2006 | Tsai | B65H 19/305 242/526 |
| 2014/0084102 | A1 * | 3/2014 | Techlin | B65H 75/2455 242/520 |
| 2016/0137398 | A1 | 5/2016 | Lemke et al. | |
| 2021/0403266 | A1 | 12/2021 | Techlin et al. | |
| 2023/0010524 | A1 | 1/2023 | Cui et al. | |

FOREIGN PATENT DOCUMENTS

| | | | |
|---|---|---|---|
| EP | 3688226 | B1 | 11/2021 |
| EP | 3688224 | B1 | 6/2022 |
| GB | 1554619 | A | 10/1979 |
| IT | 201600073544 | A1 | 1/2018 |
| JP | 3777150 | B2 | 5/2006 |
| WO | 2009004659 | A1 | 1/2009 |
| WO | 2020245319 | A1 | 12/2020 |

* cited by examiner

METHOD AND APPARATUS FOR PRODUCING CORELESS ROLL PRODUCTS

RELATED APPLICATION DATA

This application claims priority benefit to U.S. provisional application Ser. No. 63/424,300, filed Nov. 10, 2022, the disclosure of which is incorporated by reference herein.

BACKGROUND

This disclosure is directed to methods and apparatus for producing coreless roll products, and more particularly to the production of coreless bathroom tissue and kitchen towel (also called household towel). The disclosure is also applicable to the production of other coreless rolled products, such as nonwovens for canister wipes. Some of the methods and apparatus are also applicable to the production of roll products with cores, which are typically, though not exclusively, tubes made of cardboard or other relatively thick paper.

It is well known in the art that rolls of convolutely wound paper are typically formed on a machine known as a rewinder. A rewinder is used to convert large parent rolls of paper into smaller sized rolls of bathroom tissue, kitchen towel, hardwound towel, industrial products, and the like. A rewinder line usually comprises one or more unwinds, modules for paper finishing (e.g., embossing, printing, perforating), a rewinder for winding the paper into an elongated roll, commonly referred to as a log, and a tail sealing unit. The rewinder line may also include a mandrel extractor for withdrawing winding mandrels to make coreless logs. Typically, the rewinder produces logs which are about 90 to 203 mm in diameter for bathroom tissue and kitchen towel and about 100 to 350 mm in diameter for hardwound towel and industrial products. Log length is usually about 1.5 to 5.4 m, depending on the width of the parent roll. The logs are subsequently cut transversely to obtain small rolls about 90 to 115 mm long for bathroom tissue and about 200 to 300 mm long for kitchen towel and hardwound towel.

Around ten years ago (circa 2012), coreless tissue and towel products remained only a niche in the market. Since then, adoption of coreless has grown in the market thanks in part to the introduction of technology invented by the applicant. With this technology, the web is wound around an axially elastic mandrel the size and shape of a traditional cardboard core having a tensile yield strength divided by elastic modulus greater than 2.0% to form a log, after which the mandrel is removed from the log and sent back to the rewinder to be reused. The machine which removes the mandrels from the log is known as a mandrel extractor. Testing and analysis of this technology has made evident opportunities to improve its reliability and increase its throughput. These opportunities can be summarized as: improving system robustness as mandrels become less than perfectly round, less than perfectly clean, or worn; reducing the incidence and/or negative effect of logs bouncing as they roll into the mandrel extractor; increasing the mandrel life; and engineering motion strategies to allow for higher cycle rates.

Two consumer market trends are driving further adoption of coreless tissue and towel products: environmental sustainability and e-commerce. Consumers increasingly desire sustainably produced products and packaging. Removing the packaging waste of the cardboard core is one way for producers to improve the sustainability of their products. Compressing the roll for packaging, and thereby reducing the amount of air in the shipping unit, is another way for producers to improve the sustainability of their products. Coreless rolls may be easier for a packaging machine to compress than a cored roll. A compressed coreless roll may be better suited to withstand the demands of packaging and shipping than would the same roll in uncompressed form. A roll with a compressed coreless hole may be easier for a consumer to reform and use than a roll with a compressed core. Consumers also increasingly desire products to be shipped directly to them, providing further incentive for producers to compress the rolls to reduce the package size. Whether through e-commerce or more traditional retail distribution, coreless products lend themselves to a compressed roll format.

Broader adoption and consumer acceptance of coreless tissue and towel leads to a broader array of products that are viable in a coreless format, which tends to drive the cycle rates required of the coreless converting equipment higher. For example, the web from which a through air dried (TAD) household towel product is made may be of such a high caliper (thickness) that a coreless roll made with it can be of sufficient density and column strength to withstand the demands of packaging and shipping with a relatively short length of paper in the roll, which means a higher cycle rate is required to run at a given web speed. Increasing consumer demand for coreless products also tends to drive the cycle rates required of the coreless converting equipment higher, as producers require higher throughput to keep up with production needs.

As will become evident from the discussion that follows, the method and apparatus described herein provides for sustained, reliable, high throughput production of coreless rolls of high quality.

DETAILED DESCRIPTION

By way of example, the rewinder may be in accordance with one of the several examples in the figures in U.S. Pat. No. 11,247,863; the log formation and winding process may be assessed, and the converting line controlled based on the assessments, in accordance with the principles described in U.S. Pat. No. 11,261,045; the winding mandrel may be introduced and inserted into the rewinder in accordance with U.S. Pat. No. 6,422,501; a line of glue for web transfer may be applied to the winding mandrel in accordance with U.S. Pat. No. 6,422,501; and transfer of the web onto the mandrel in the rewinder may be in accordance with U.S. Pat. No. 6,056,229, the disclosures all of which are incorporated by reference herein.

A reinforcing agent and/or coating, and its application, may be in accordance with U.S. Pat. Nos. 4,487,378, 5,730,387, 6,838,187, 10,213,066, and 11,046,540, Italian patent IT 102016000073544, Great Britain patent GB 1,554,619, and European patents EP 3,688,224 and EP 3,688,226, the disclosures all of which are incorporated by reference herein.

The roll product, the coreless production method and apparatus, and the mandrel extractor, may be in accordance with U.S. Pat. Nos. 9,284,147, 9,919,888, 9,975,720, 10,676,304, and 11,383,947, and with pending US 2021/0403266 (application Ser. No. 17/350,213), the disclosures all of which are incorporated by reference herein. The infeed table may be in accordance with pending U.S. application Ser. No. 17/944,688, the disclosure of which is incorporated by reference herein.

The roll product may be compressed and packaged in accordance with any known method and apparatus, for example U.S. Pat. Nos. 5,027,582 and 5,186,099, and US 2016/0137398 (U.S. application Ser. No. 14/942,866), the disclosures all of which are incorporated by reference herein.

The description that follows provides a general overview of the system and follows with a more detailed description of the components of the system.

General Overview

Figure 1:
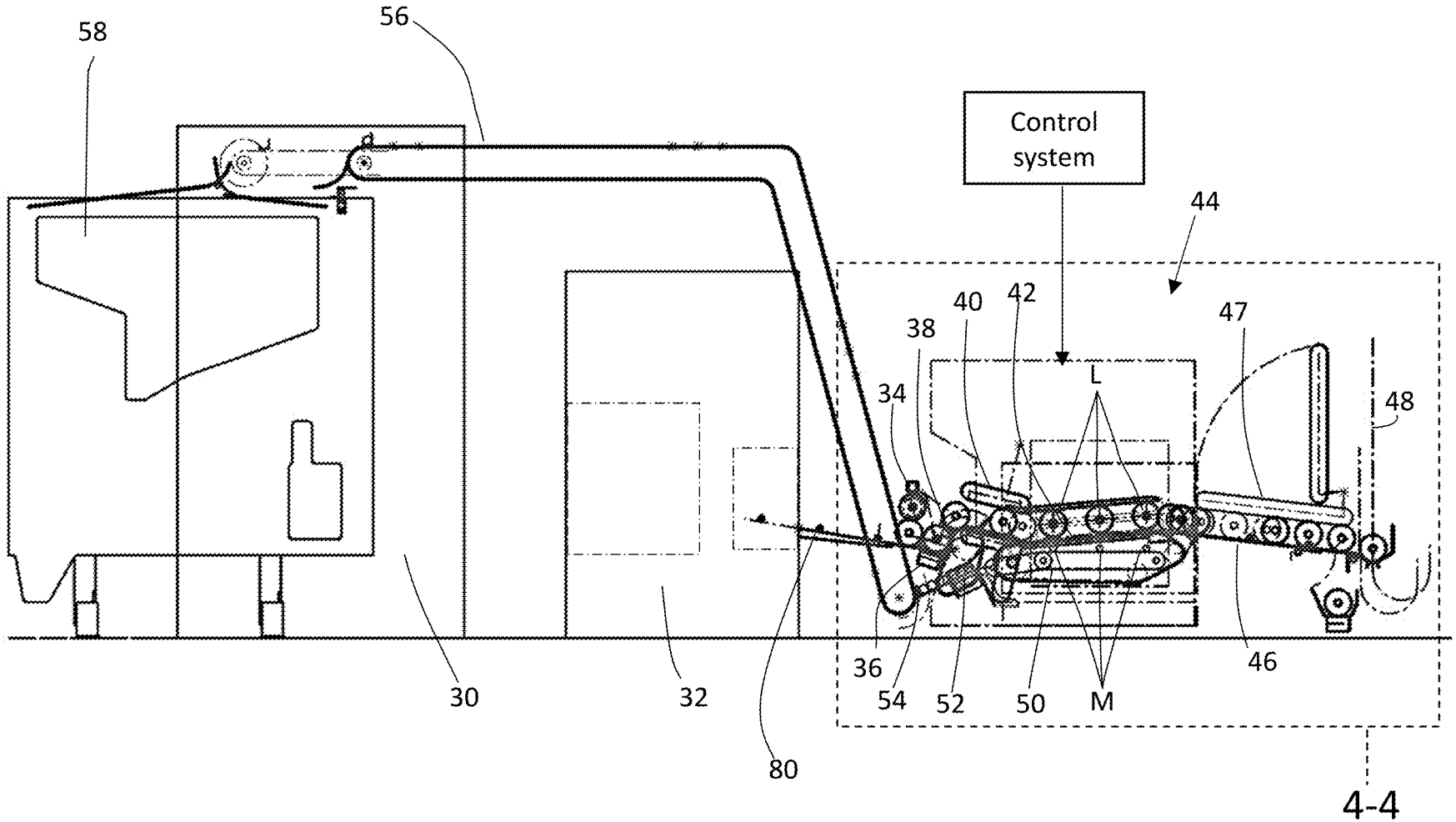
FIG. 1 is a schematic side elevation of a coreless winding mandrel extraction and mandrel return system.
Figure 2:
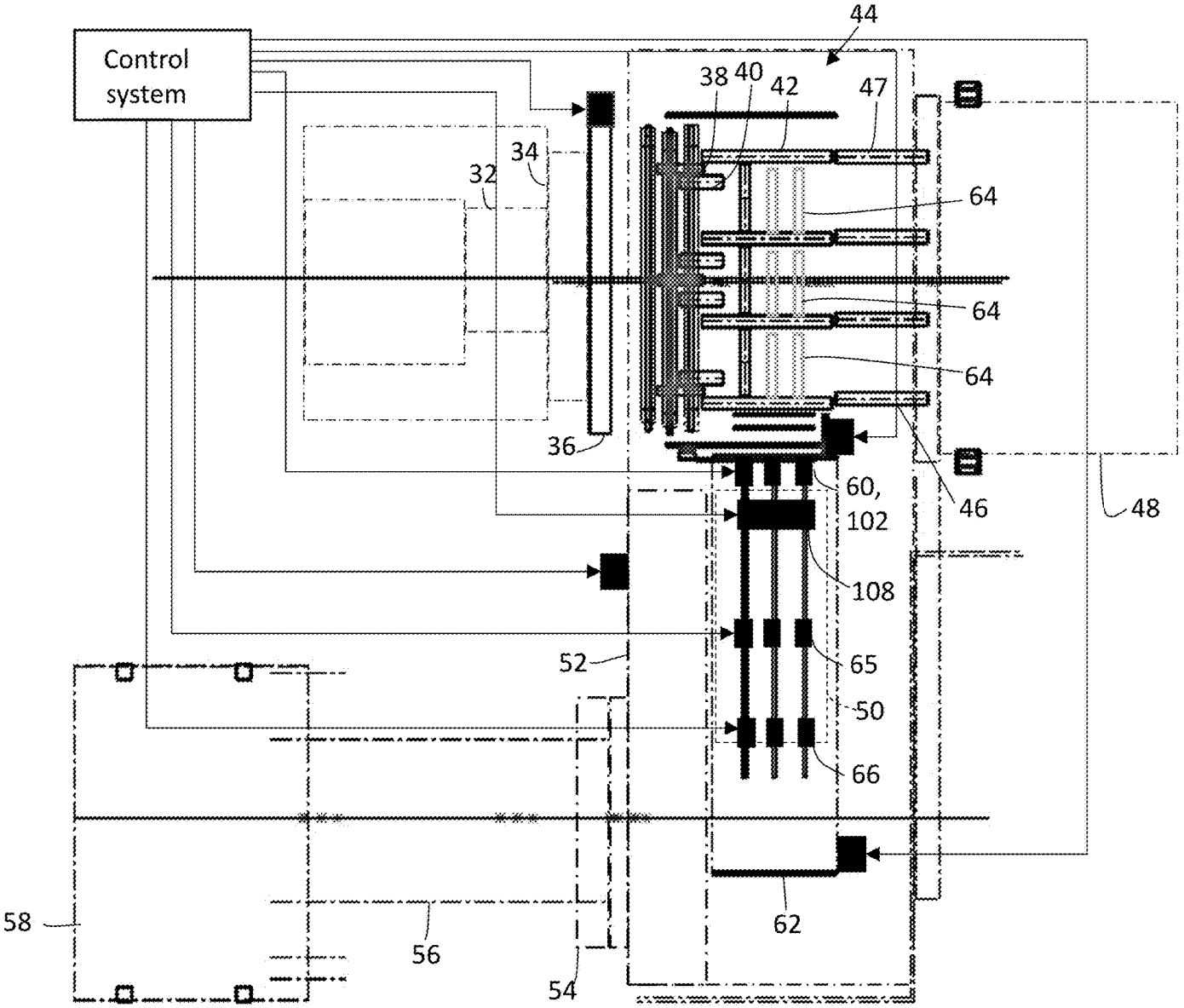
FIG. 2 is a plan view of the system of FIG. 1.
Figure 3A:
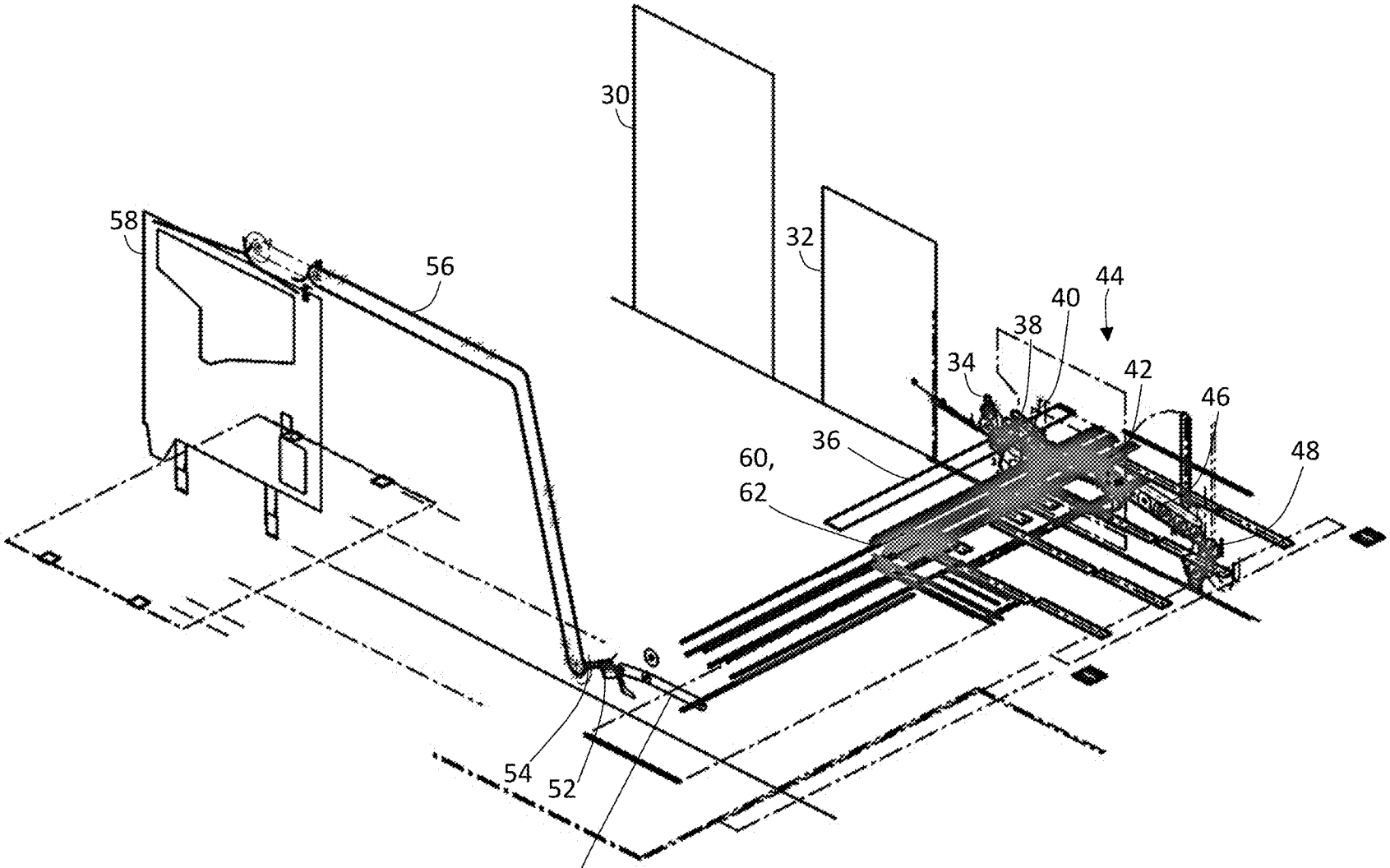
FIGS. 3A and 3B are isometric views of the system of FIG. 1.
Figure 3B:
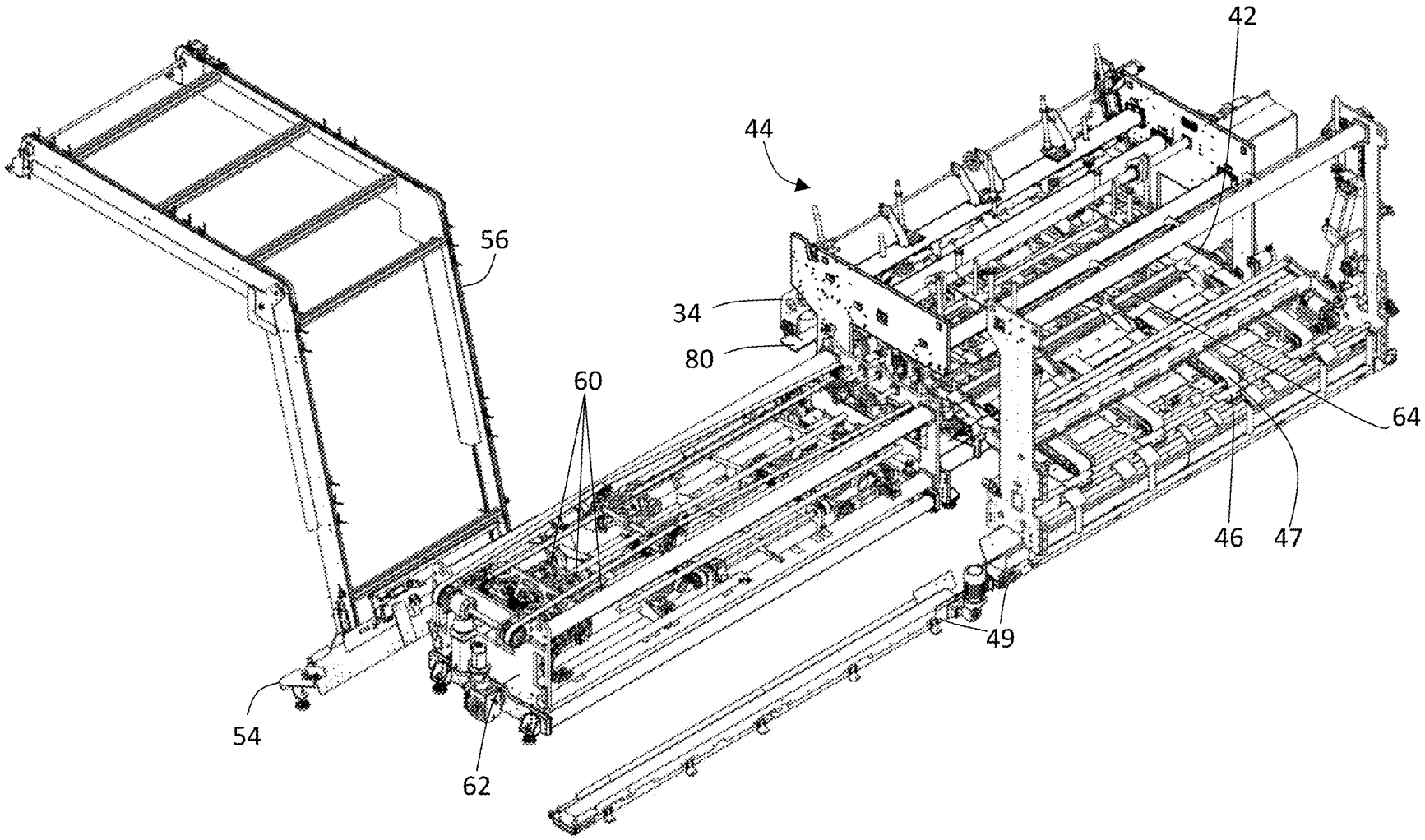
Figure 4:
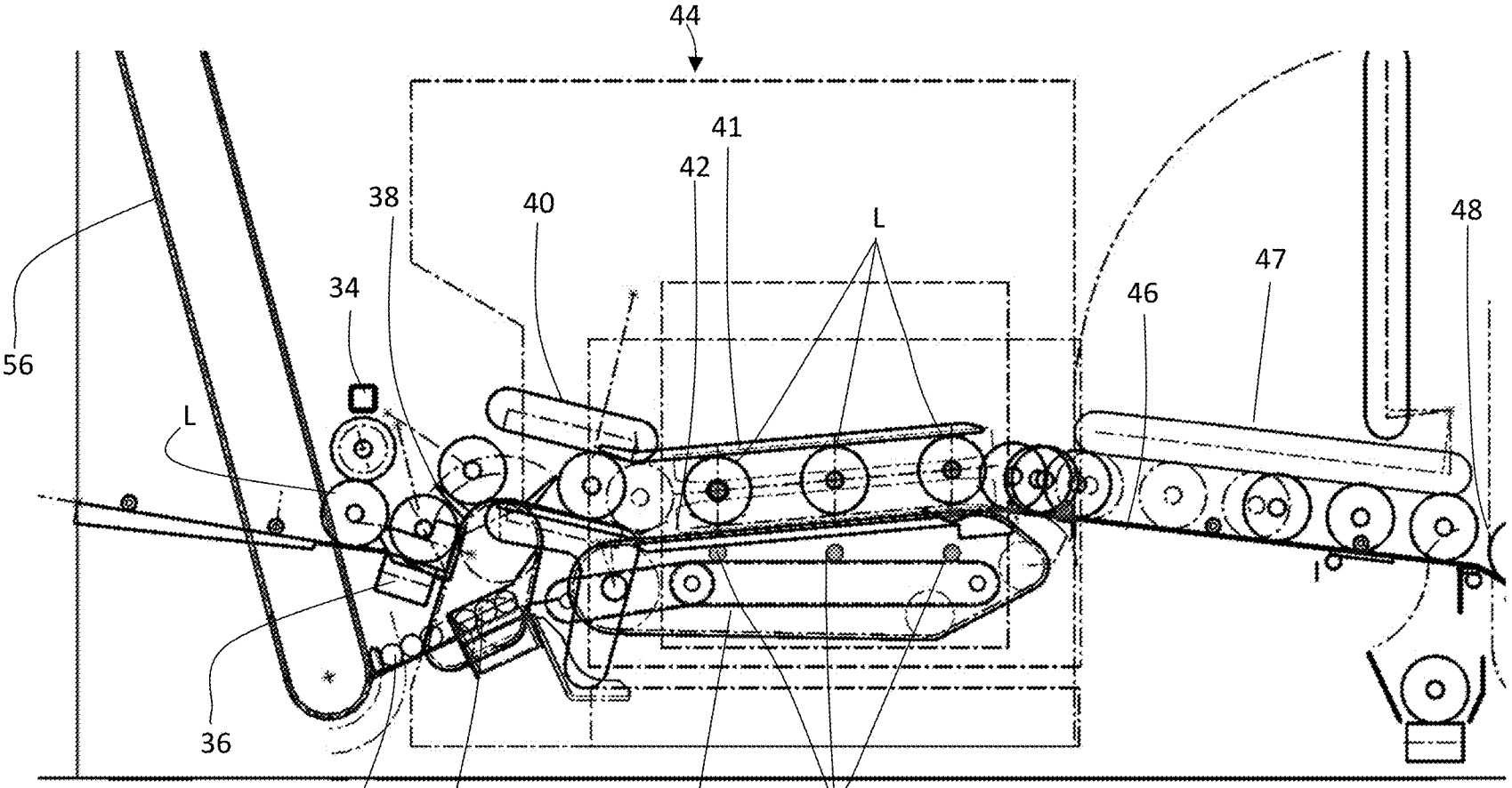
FIG. 4 is a detail view of FIG. 1 showing the side elevation of a 3-puller mandrel extractor and a portion of a mandrel return system.
Figure 5:
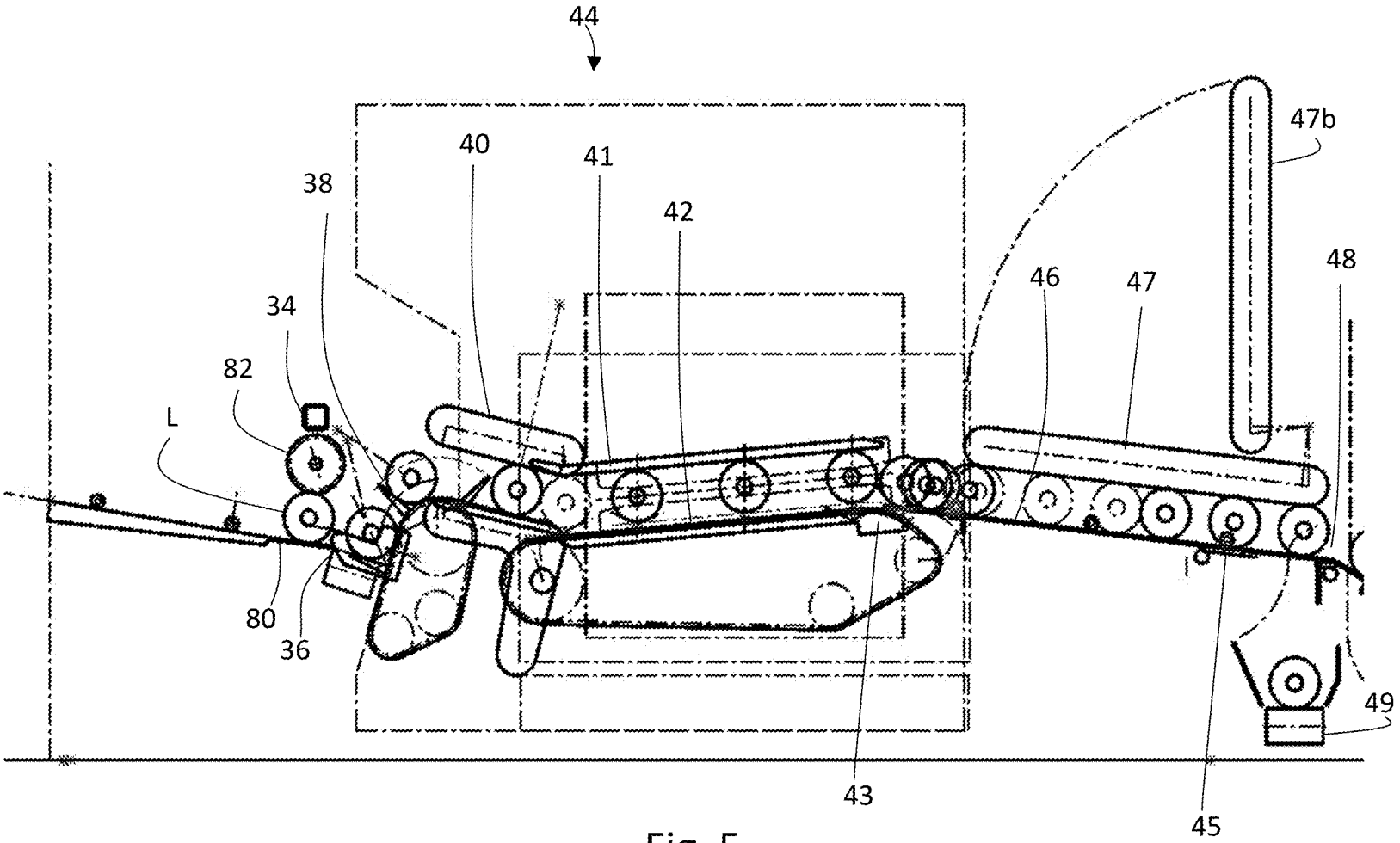
FIG. 5 is a detail view of FIG. 1 showing the side elevation of a 3-puller mandrel extractor.

A general overview of the system is shown in FIGS. 1-5. FIG. 1 shows a schematic drawing of a side elevation of a coreless winding mandrel extraction system and mandrel return system. The process flow for the logs (L) is from left to right, while the process flow for the mandrels (M) returning on the system is from right to left. The logs wound with the mandrels exit a rewinder 30, pass through a tail sealer 32, and then move to an infeed roller assembly 34, an alignment conveyor 36, a lift conveyor 38, an infeed conveyor assembly 40, and a main log conveyor 42 where extraction of the mandrels occurs in a mandrel extractor 44. The logs without the mandrels then move onto an outfeed table 46 and into an accumulator 48. Once extracted from the logs, the mandrels move onto a mandrel return conveyor 50, a mandrel return alignment conveyor 52, a mandrel infeed table 54, a mandrel return elevator 56, and to a storage magazine or mandrel hopper 58. From the storage magazine or mandrel hopper 58, the mandrels may be introduced back to the rewinder 30. FIG. 2 shows a plan view of the system of FIG. 1. In FIG. 2, the process flow for the logs is again from left to right, and the process flow for the mandrel returning in the system is top to bottom as the mandrels are removed from the logs, then right to left as the mandrels are returned to the storage magazine or mandrel hopper 58 for reuse in the rewinder. FIGS. 3A and 3B are isometric composites of FIGS. 1 and 2. The mandrels which have been extracted from logs are recirculated for reuse in winding new logs. A mandrel is introduced by an infeed conveyor into a conventional rewinder 30 for winding a log (L) around the mandrel (M). The wound logs are discharged from the rewinder and delivered to a tail sealer 32 for sealing the end, or tail, of the web of paper which was wound to form the log. Then the logs are delivered to a mandrel extractor 44. FIGS. 4 and 5 are enlarged views of detail area 4-4 of FIG. 1 showing the side elevation of a 3-puller mandrel extractor 44 and a portion of a mandrel return system. Extracted mandrels are delivered to a return conveyor 50 for conveying the mandrels to an alignment conveyor 52 which shifts the mandrels over so that they can be picked up by a return elevator 56 and conveyed back to the storage magazine or hopper 58 for reuse in the rewinder 30.

Log And Mandrel Handling Overview

The process of removing mandrels from successive logs of convolutely wound web material can be divided into log handling and mandrel handling processes. FIGS. 4 and 5 show the side elevation of a 3-puller mandrel extractor 44, where FIG. 5 omits the portion of the mandrel return conveyor system 50 shown in FIG. 4.

The following is a description of a log and mandrel handling process for the mandrel extractor in FIGS. 4-5. Being a 3-puller mandrel extractor, mandrels (M) are preferably extracted from logs (L) in groups of three. However, mandrels may be extracted from logs in groups of two, or even just one, using this machine. A log (L) rolls down the infeed table 80 from the tail seal unit 32. The log's arrival at the end of the table may be predicted by sensors positioned along the table. The log rolling velocity may be attenuated by the infeed roller 82 shown in FIG. 8. The infeed roller 82 may assist in providing timed delivery of the logs to the extractor by reducing or eliminating variation in the arrival times of the logs from the tail sealer.

Figure 9:
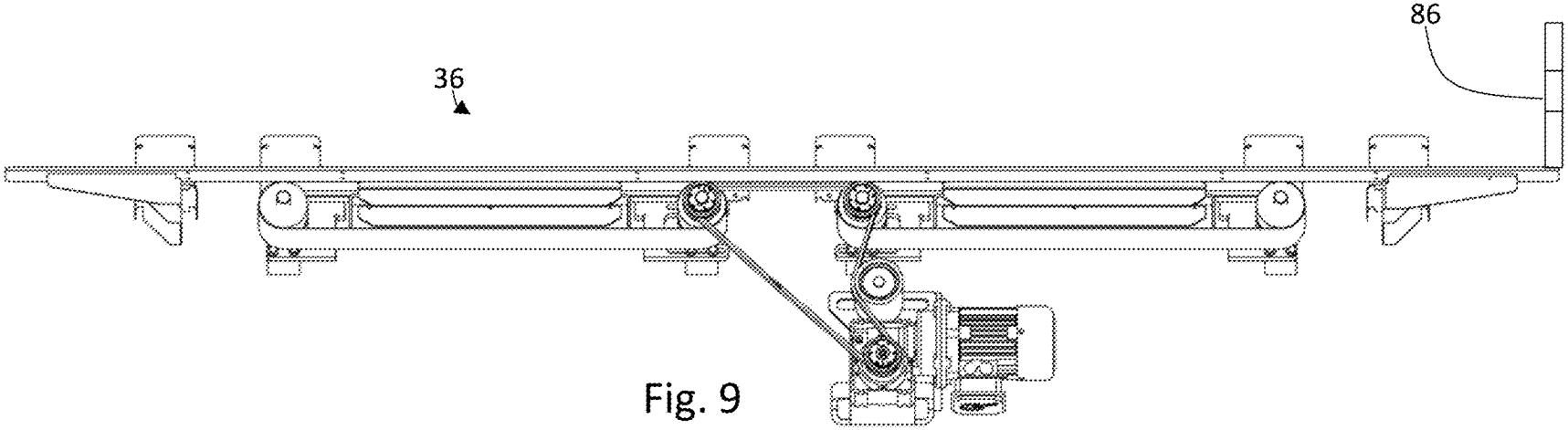
FIG. 9 is a front view of a log alignment conveyor.

The log next arrives at log alignment conveyor 36, for instance, as shown in FIG. 9. The log alignment conveyor is adapted and configured to shift the log in the cross-machine direction toward the side of the machine with pullers to extract the mandrels (out of the page in FIGS. 4 and 5). The log alignment conveyor 36 ensures the axial ends, or faces, of the logs are aligned in a common plane, for instance, against a reference plate, which may be an axial end restraint associated with the mandrel extractor 44.

Figure 10:
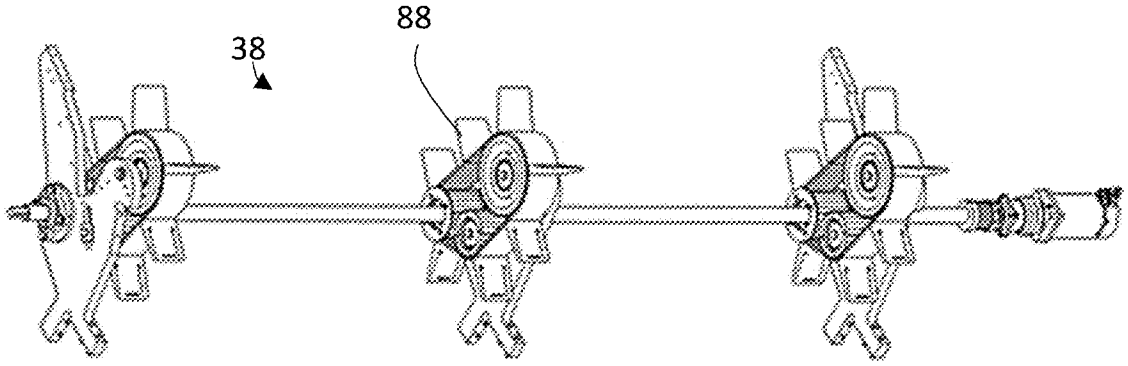
FIG. 10 is a perspective view of a log lift conveyor.

The logs are then directed to a log lift conveyor 38, for instance, as shown in FIG. 10. The log lift conveyor 38 is adapted and configured to queue three successive logs. The log lift conveyor 38 comprises a flighted belt conveyor. Upon the arrival of a log to the log lift conveyor 38 and alignment by the log alignment conveyor 36, the log lift conveyor receives the log and then indexes one flight (up in the drawings) to allow for the arrival and alignment of a second log. After the second log has arrived and been aligned, the log lift conveyor 38 indexes one flight up to allow for the arrival and alignment of a third log. After the third log has arrived and been aligned, the log lift conveyor 38 triple-indexes to feed the three logs through an infeed conveyor assembly 40 of the mandrel extractor and onto a main log conveyor 42, where the mandrels are extracted.

Figure 11:
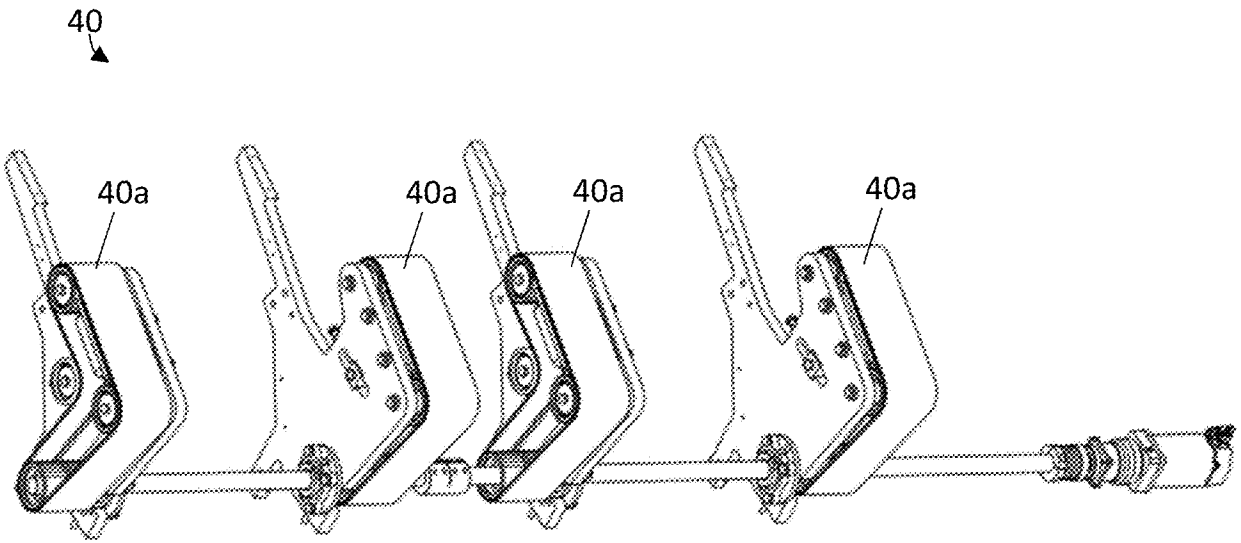
FIG. 11 is a perspective view of a lower infeed belt assembly.
Figure 12:
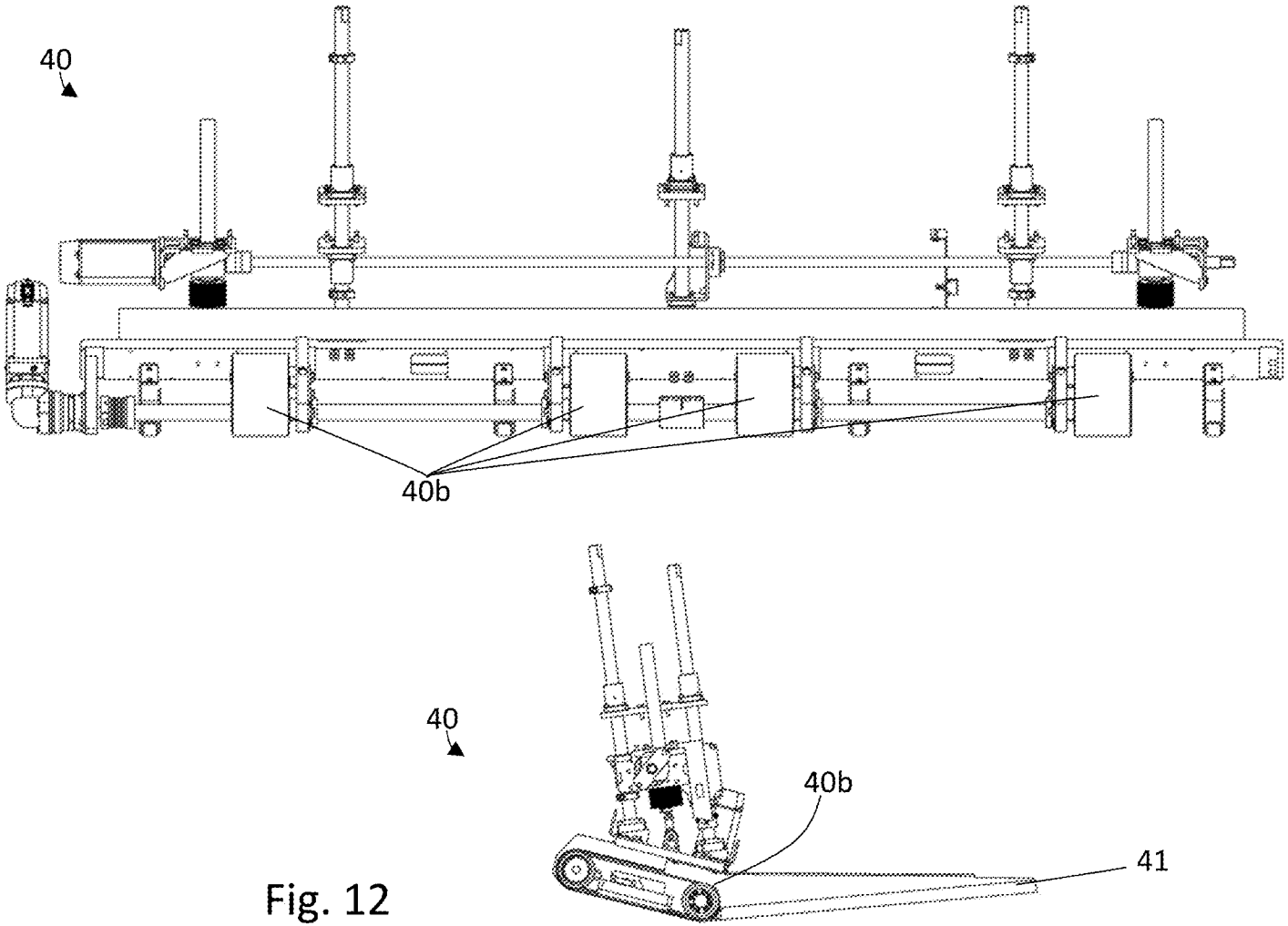
FIG. 12 is a front and side view of an upper infeed belt assembly.
Figure 13:
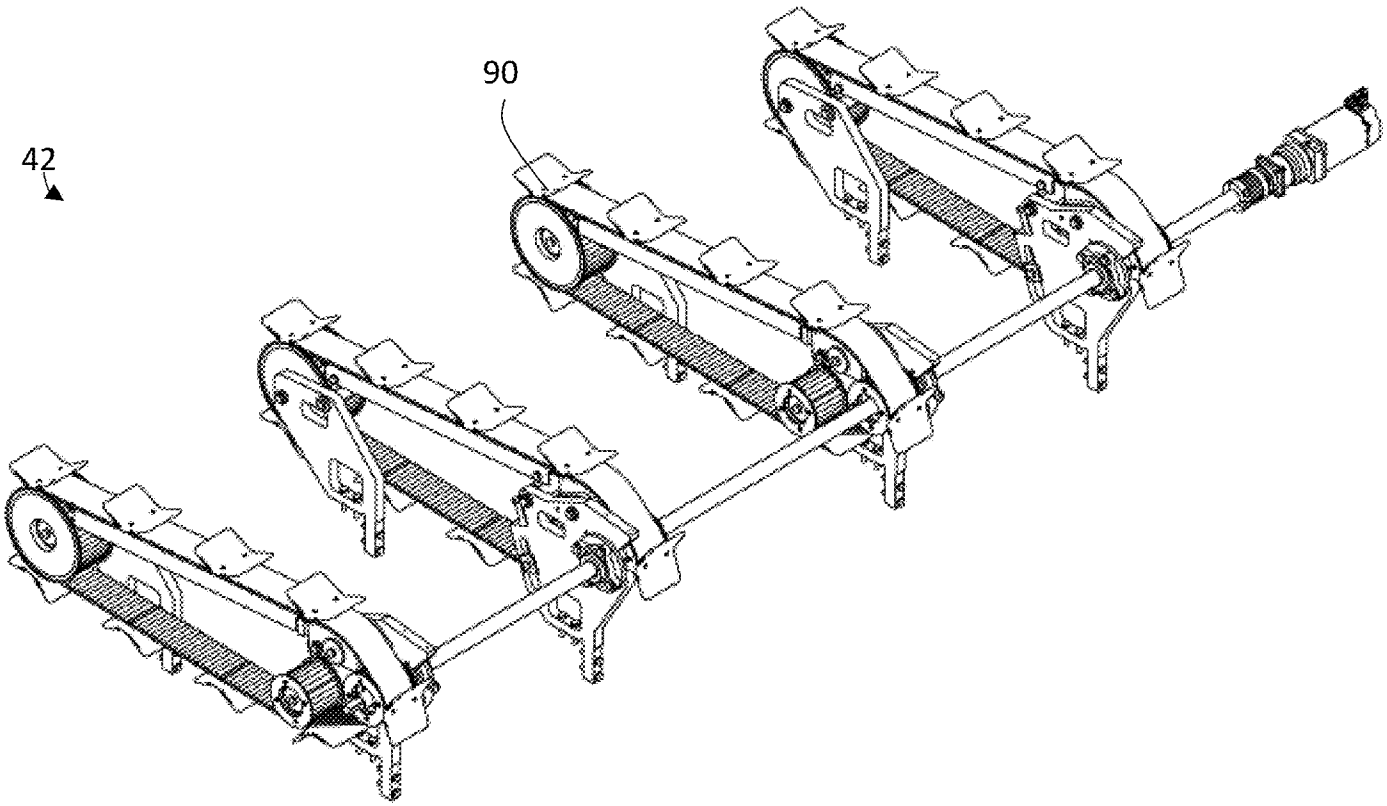
FIG. 13 is a perspective view of a main log conveyor assembly.

The infeed conveyor assembly 40 of the mandrel extractor 44 comprises upper and lower infeed belt assemblies 40*a*, 40*b* of the mandrel extractor. An exemplary lower belt 40*a* assembly is shown in FIG. 11, and an exemplary upper belt assembly 40*b* is shown in FIG. 12. The log travels between the upper and lower infeed belt assemblies 40*a*,40*b* to the main log conveyor 42 of the mandrel extractor 44. The infeed conveyor assembly 40 delivers the three logs in succession to a main log conveyor 42 of the mandrel extractor which is shown in FIG. 13. During the triple-index motion, the first log in the three log succession, which was residing between the upper and lower infeed belts, is delivered to a first (rightmost position in the drawings) extraction station by the main log conveyor, the second log which was residing on the upper pulley of the log lift conveyor is delivered to a second (the center position in the drawings) extraction station by the main log conveyor, and the log which was residing on the infeed table, at the pickup position of the log lift conveyor, is delivered to a third (the leftmost position in the drawings) extraction station by the main log conveyor. When the main log conveyor 42 comes to a stop, the main log conveyor has aligned the longitudinal center axis of each mandrel with a clasp 60 (FIGS. 14-17A, B,C) in a mandrel puller 62 (FIGS. 18-19) of the mandrel extractor 44, for removal of the mandrels from the logs as described below.

During removal of the mandrels from the logs residing at the extraction stations, the log lift conveyor 38 and infeed conveyor assembly 40 are free to execute single index motions, as described above, to accumulate arriving logs and stage them in preparation for the next triple-index. In this way, the time duration for removing the mandrels in the mandrel extractor 44 can be greater than the time interval between the arrival of logs at the log lift conveyor 38. After the mandrels have been removed from the logs, the next triple-index motion may be executed, which delivers the next group of three logs, staged at the infeed conveyor assembly 40 and log lift conveyor 38, to the extraction stations, and simultaneously delivers the current group of logs, which are now coreless logs, onto the outfeed table 46. The discharged logs roll on the outfeed table 46 into a space beneath outfeed belts 47 which control the translational velocity of the rolling logs and meter them into the next machine in the process, typically a log accumulator 48.

When each log on the main log conveyor 42 is in a position in which each mandrel's axis coincides substantially with the central axis of a clasp 60, restraints, for example as shown in US patent publication US20210403266A1, engage the periphery of each log to restrain the log from moving axially. Restraint of the log periphery may also prevent the log from rotating and also prevent the log from changing length. When the mandrel puller 62 is ready and the puller carriage 92 is in a mandrel stop position after the mandrels have been removed from the previous group of three logs, and the previous mandrels are out of the way of the clasps 60, the clasps 60 are moved toward the mandrel ends of the next group of logs by translating the puller carriage 92 toward the mandrel ends of the next group of logs, stopping when the clasps are in a mandrel engagement position to engage the ends of the mandrels. The clasps 60 then engage the mandrel ends. The clasps 60 are capable of engaging the mandrel ends securely to apply an axial force to pull the mandrels out of the logs and also optionally to apply a rotational torque to rotate the mandrels inside the logs. The mandrels are preferably rotated as they are withdrawn. The mandrel puller carriage 92 may begin to travel slowly, moving the clasps 60 away from the logs slowly to facilitate stretching the mandrels and generate localized breakaway of the mandrels progressively within the logs. Without stopping following this relatively slow pulling, the mandrel puller carriage 92 may accelerate to a relatively higher velocity to withdraw the mandrels rapidly, to minimize the cycle period, which is favorable for operation at higher cycle rates.

Figure 24:
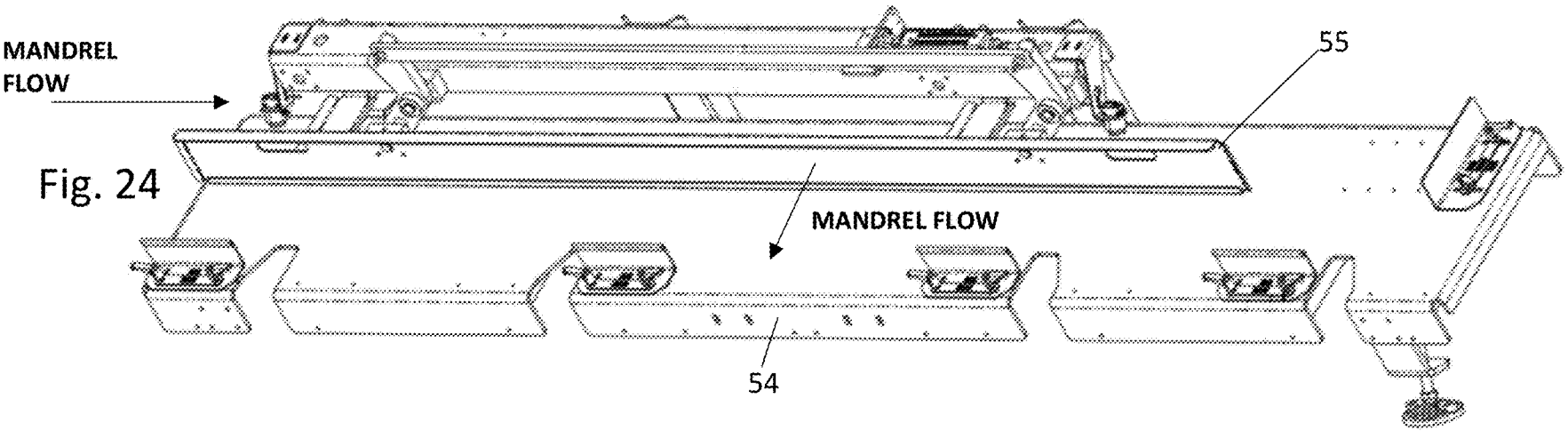
FIG. 24 is a perspective view of a mandrel return infeed table.

After the mandrels have exited the logs, preferably while the mandrels are decelerating with the puller, the clasps 60 unclamp the mandrel ends. Due to inertia the mandrel ends tend to stay in the clasps 60 and remain in contact with the clasps. Drag guides 66 may engage the mandrels in a pinching fashion to restrain them axially, causing the mandrel ends to emerge from the clasps as the clasps continue traversing to their stop position. The mandrel ends that are closer to the logs may be supported after the mandrels are withdrawn from the logs by mandrel end supports 65 that are raised into contact with the undersides of the mandrels for this purpose as the mandrels are withdrawn from the logs. When the mandrel ends are out of the clasps 60, the mandrel puller carriage 92 comes to a stop. The drag guides 66 disengage the mandrels. The lower drag guides and the mandrel end supports move downward and deliver the mandrels onto the return conveyor 50 (FIGS. 18-19, 21-22), which delivers them to the mandrel alignment conveyor 52 (FIG. 20), which shifts them in the cross-direction onto the elevator infeed table 54 (FIG. 24), which, when gate 55 opens, feeds them to the return elevator 56 (FIGS. 1-3, 23) for delivery to the storage magazine or hopper 58.

When extracting mandrels from logs in groups of two instead of groups of three, the following process may be used. The logs are directed to the log lift conveyor 38, as before, which is adapted and configured to queue two successive logs. All three paddles 88 on the log lift conveyor may be mounted, if the product logs will fit between them. Advantageously, the center paddle can be removed to make more space between the first and last paddles, which may allow for larger diameter logs to be processed by the extractor. Upon the arrival of a log to the log lift conveyor 38 and alignment by the log alignment conveyor 36, the log lift conveyor receives the log and then executes a double-index, advancing the log from the pickup position to a dwell position in the infeed belts 40 without stopping the log on the uppermost pulley of the log lift conveyor. After the second log has arrived and been aligned, the log lift conveyor 38 triple-indexes to feed the two logs through the infeed conveyor assembly 40 of the mandrel extractor and onto the main log conveyor 42, where the mandrels are extracted. In this example, the left and right extraction stations on the main log conveyor contain logs and are utilized, the center extraction station does not have a log and is not utilized. The mandrel extraction process is similar to that described above for processing logs in groups of three, except two mandrels are withdrawn instead of three. The logs are then discharged from the extractor during the next triple index motion. The maximum log rate is less when logs are processed in groups of two than when logs are processed in groups of three, but the maximum log diameter that may be processed by the extractor is larger, which is a benefit.

Reinforcing Agent Application

It is known to use a reinforcing agent and/or a coating with some coreless roll products. Generally, a reinforcing agent may be applied on the first wrap or first several wraps of paper near the central hole, or to the surface of the mandrel itself, while a coating may be applied over a larger proportion of the wraps of paper. Additives and/or coatings may be used to facilitate removal of a winding mandrel from the central hole of a roll of wound web material during manufacture. Additives and/or coatings may be used to improve the appearance of the central hole. Additives and/or coatings may be used to help the central hole retain its shape during the rest of the manufacturing process, shipping, or use by a consumer. Additives and/or coatings may be used to facilitate the central hole returning to a round shape by a consumer if the roll is a compressed roll format or if the hole has become misshapen. A reinforcing agent or a coating, or both, may be applied, and may be the same composition or different compositions. If applied directly to the mandrel it may be a liquid, a solid, or a film. The additive and/or coating may be water, or water-based. Conventional spray nozzles may be provided to direct a reinforcing agent or a coating to a web or onto the mandrel surface. Electrostatic spray guns may be provided to direct a reinforcing agent or a coating to a web. In one example, a rewinder intended for webs around 2.8 m (110 inches) wide may be provided with an array of around 10 spray nozzles or guns spaced across the width of the web. More or fewer spray guns may be provided depending on the width of their spray pattern and desired amount of overlap of the spray patterns. More spray guns may be provided for wider webs, and fewer for narrower webs. The reinforcing agent or coating may be provided with a positive electrostatic charge. The reinforcing agent or coating may be provided with a positive electrostatic charge in a storage system located remotely to the electrostatic spray gun, reducing the risk of high voltage on the spray guns that could produce an arc. The Trilogy model of spray gun offered by Nordson Corporation, 28601 Clemens Road, Westlake, OH 44145, may be a suitable spray gun. The spray guns may be located opposite a fixed plate, with web passing between the spray guns and the plate. The fixed plate may be a "pinch" plate disposed within a type of rewinder wherein it cooperates with pinching pads to sever the web, and thus is in a favorable position for the application of a reinforcing agent or coating to the portion of web following the web transfer, which will constitute the first wraps of web within the log. The pinch plate may be grounded. The pinch plate may be provided with a negative electrostatic charge. It is not ruled out that the reinforcing agent and/or coating may be provided with a negative charge and the pinch plate may be provided with a positive charge. An intent of having the reinforcing agent and/or coating oppositely charged from the pinch plate is to maximize the amount of sprayed material that deposits on the web and minimize the amount that drifts and lands elsewhere by having the airborne material drawn to the web by the opposite electrostatic charges in addition to having the material spray aimed at the web. Sprayed material that lands elsewhere is wasted, and it can contaminate the machine, requiring downtime to clean, and other inefficiencies. Rather than providing the pinch plate with an electrostatic charge, the web may be provided with an electrostatic charge by suitable non-contact induction means, or by a contact method, such as by a rotating roll with a rubber, or other elastomer, cover suited to generating an electrostatic charge. The spray guns may be timed to apply additive or coating to a length of web that will be wound near the central hole of the roll. If the web is severed at a perforation for transfer, the spray guns may be timed to begin applying reinforcing agent or coating to the web after the perforation which will be severed for transfer has moved past the spray zone. The spray guns may be timed to stop applying reinforcing agent or coating after a suitable length of web has had reinforcing agent or coating applied to it given the purpose of the reinforcing agent or coating. The flow rate of reinforcing agent or coating applied may be scaled according to the web speed, which may be done to minimize variation in the amount of reinforcing agent or coating applied per unit area of web or unit length of web as the web speed is changed. Applying the reinforcing agent or coating in the machine immediately prior to the web transfer area may help with machine hygiene, as no machine elements such as rollers touch the side of the web with the reinforcing agent or coating applied thereon. It may be advantageous to spray the reinforcing agent or coating with a component of velocity which is in generally the same direction as the web travel. This may be done by tilting the spray guns relative to the web path to an inclination angle of less than 90 degrees. Given that the fluid dynamics of the system change with web speed, it may be advantageous to move and/or re-orient the spray guns according to changes in web speed during operation of the system. In the alternative, an array of piezoactuated flow channel dispensers may be provided to direct a reinforcing agent or a coating to the web. Piezoactuated flow channel dispensers available from Alchemie Technology Ltd, Future Business Centre, Kings Hedges Road, Cambridge, CB4 2QT, UK may be suitable. In another alternative, the reinforcing agent and/or coating may be applied with a rotary disk fluid casting system, such as the Rotor Spray system available from Ahlbrandt, Altebergstraße 23-25, 36341 Lauterbach (Hessen) Germany. Application with a rotary disk system could be turned on and off rapidly with a servo-actuated shutter. In still another alternative, it is not ruled out that the reinforcing agent and/or coating may be applied by a contact means to the mandrel or the web, such as with an applicator roll or a brush.

Mandrel Introduction and Insertion

Figure 30:
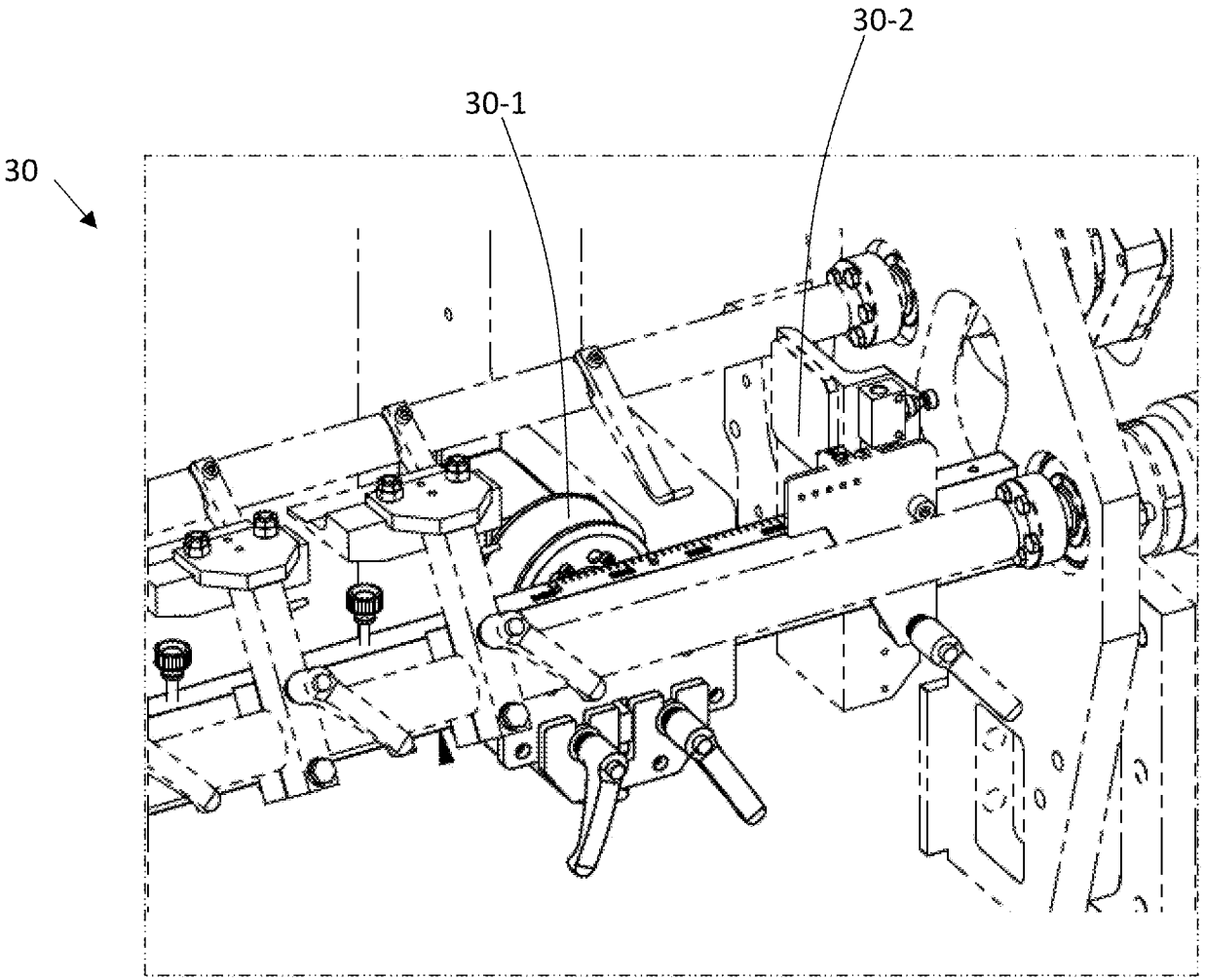
FIG. 30 is an isometric view of a mandrel assist wheel in a rewinder.
Figure 31:
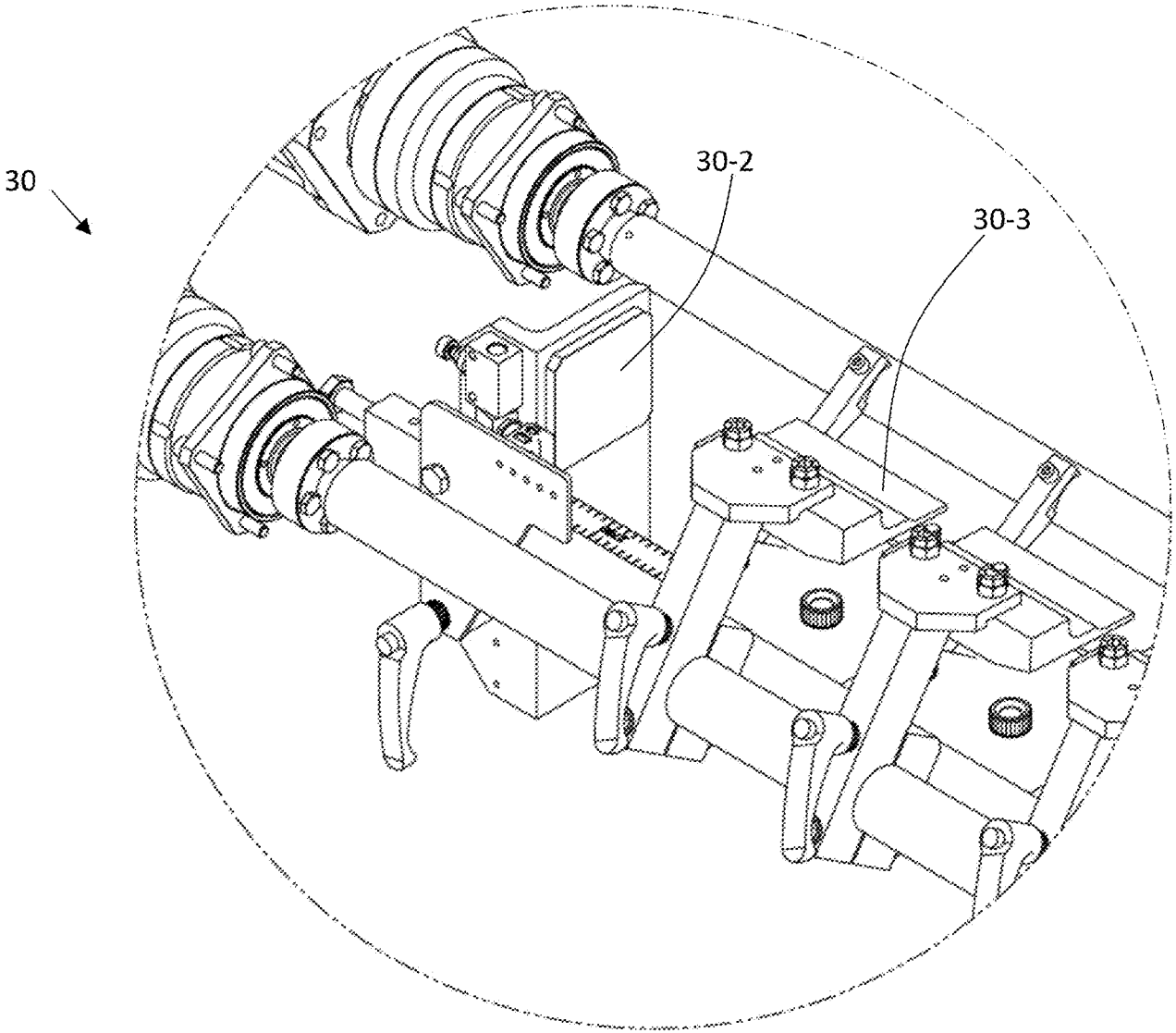
FIG. 31 is an isometric view of a mandrel braking shoe and mandrel stop in a rewinder.

The rewinder core introduction and insertion apparatus and methods disclosed in U.S. Pat. No. 6,422,501 may be used for both traditional cardboard cores and for coreless winding mandrels. However, coreless winding mandrels, because they are recirculated and reused numerous times, because they have a lower friction surface than cores, and because of their material properties, by their nature may have a narrower operating window for reliable operation than cardboard cores. Though most or all of the transfer glue may be wiped clean in the mandrel extraction process for many grades of glue and types of substrate, in other cases, glue may remain on the mandrels due to the type of glue used and/or a relatively lower absorbency of the wound web. Some of the glue that remains on the mandrels may transfer to a mandrel assist wheel 30-1 (FIG. 30) that assists the mandrel M in arriving at the correct cross-direction position in the rewinder, which may reduce the traction between the mandrel assist wheel 30-1 and the mandrel M. Good traction between the assist wheel 30-1 and the mandrel M is important for the assist wheel to decelerate the mandrel translational velocity before the mandrel contacts a stop plate 30-2, to minimize or control bounce-back of the mandrel from the stop plate, and/or to drive the mandrel toward the stop plate if the mandrel bounces away from the stop plate. Typically the assist wheel 30-1 is driven in rotation at constant speed as the mandrel enters. Its rotation speed may be varied. Its rotation may be stopped between mandrels, which may reduce wear of the wheel and/or wear of the mandrels. Typically a mandrel braking shoe 30-3 is provided above the assist wheel 30-1 to press the mandrel against the assist wheel. As mandrels are reused, they may become less than perfectly circular, especially at and near their ends, which is where the mandrel assist wheel 30-1 that seats the mandrels against a mandrel stop 30-2 (FIG. 31), and the mandrel braking shoe 30-3 operate on the mandrel. An oval-shaped mandrel may arrive at the mandrel assist wheel 30-1 in an unfavorable orientation, for instance with its minor diameter aligned to the mandrel assist wheel 30-1 and braking shoe 30-3 (FIG. 31), so the contact force is reduced, or non-existent, and the mandrel is not controlled correctly, or for instance with its major diameter aligned to the mandrel assist wheel 30-1 and braking shoe 30-3, so the contact force is excessive and the mandrel is not controlled correctly. Additionally, a mandrel assist wheel 30-1 contaminated with glue build-up or dust, may result in the mandrel M being incorrectly positioned in the cross-direction in the rewinder because of insufficient interface friction for the assist wheel to decelerate the mandrel and/or to drive the mandrel end to the mandrel stop 30-2 properly. Plastic mandrels may tend more than cardboard cores to rebound in the cross-direction when they hit the mandrel stop 30-2, due in part to them having a lower coefficient of friction, and due in part to the mandrels typically having greater mass than an equivalent size cardboard core, so they arrive at the mandrel stop with greater momentum if at the same velocity, which may result in the mandrels being incorrectly positioned in the cross-direction in the rewinder.

Figure 28:
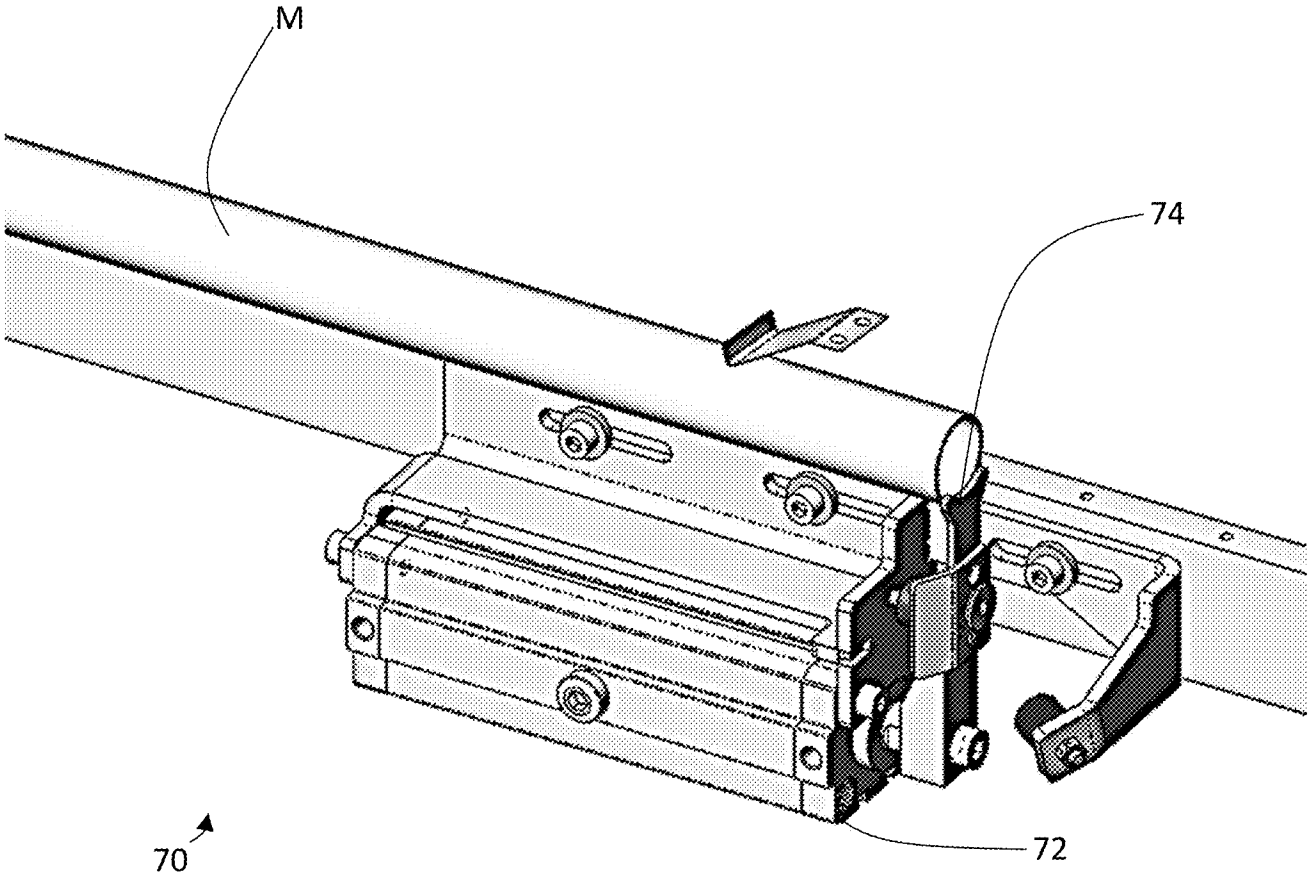
FIGS. 28-29 are isometric views of a mandrel justifier.
Figure 29:
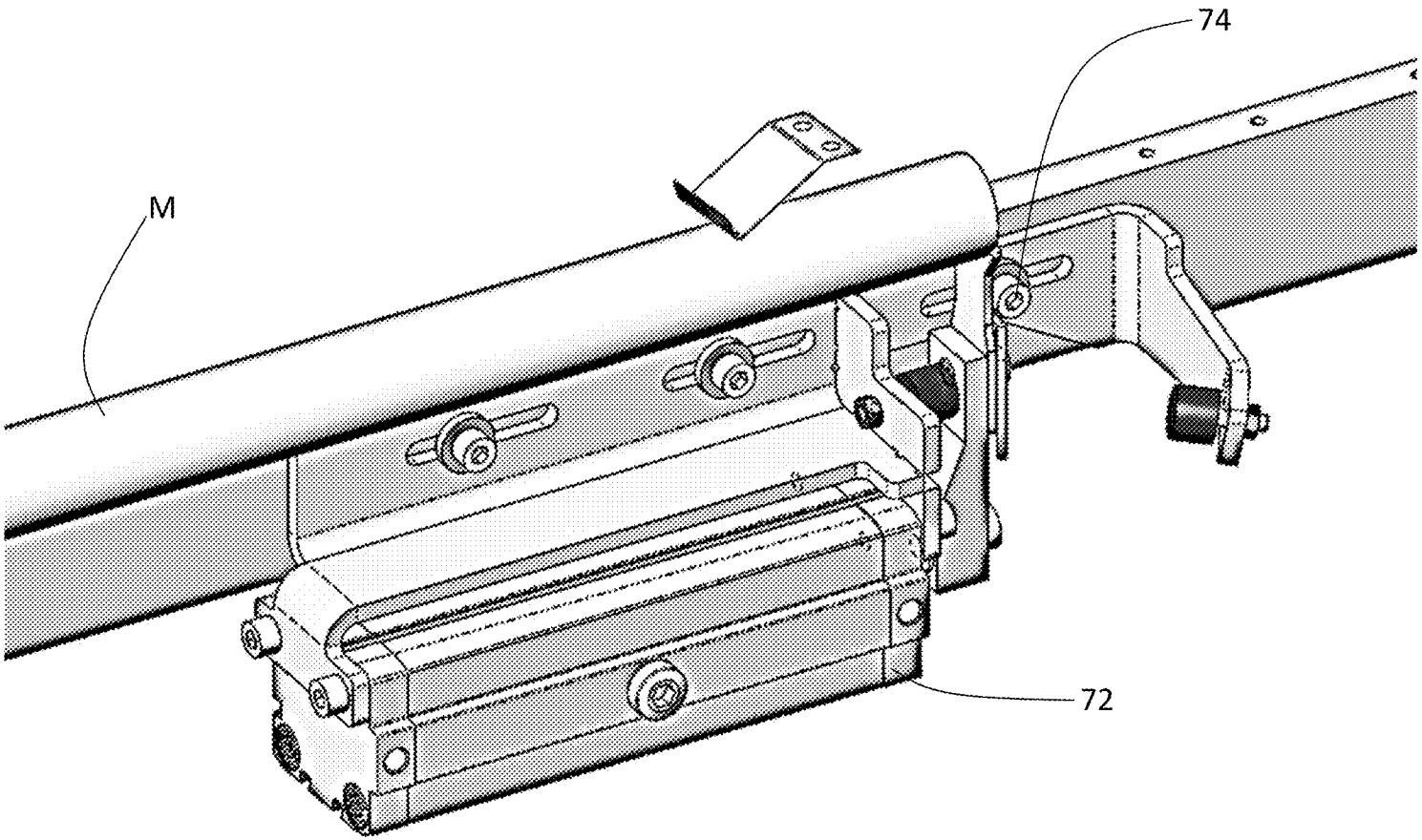

A mandrel justifier 70 as shown in FIGS. 28 and 29 may be used to ensure that mandrels are correctly positioned in the rewinder 30 for mandrel insertion and transfer. This device may be mounted near the inside of the frame of the rewinder 30 on the side of the machine from which mandrels are introduced in the cross-direction. A swivel clamp 72 with a pusher 74, for example, a Festo model CLR, may be used to provide the combination of linear and rotational movement needed for this device. When the swivel clamp 72 is extended, the pusher 74 rotates out of the way, allowing a mandrel (M) to be introduced into the rewinder in the cross-direction. Once the mandrel has travelled far enough into the rewinder in the cross-direction, the swivel clamp 72 may be retracted so that the face of the pusher 74 pushes against the end face of the mandrel to locate the mandrel to be introduced in the rewinder in the correct position. Bumpers may be provided at each end of the stroke of the swivel clamp for cushioning.

A toggle stop comprising a spring (mounted to a spacer or other suitable member, not shown) may be provided to help prevent mandrel rebound and help position the next mandrel with the mandrel justifier. The toggle stop may comprise a lightweight spring-loaded device, or even simply a formed piece of plastic or thin metal with inherent springiness. The toggle stop device is mounted adjacent the path of the incoming mandrels, at the side of the rewinder from which the mandrels enter. When the mandrel enters, its leading end displaces the toggle stop out of its path. As the mandrel passes by, it holds the toggle stop at the displaced position. After the trailing end of the mandrel passes by the device, its spring or inherent springiness causes the toggle stop to return rapidly to its non-displaced position, in the path of the next mandrel. The shape of the toggle stop profile may be roughly that of a right triangle. When in the non-displaced position the long leg is substantially parallel to the mandrel feeding path, the short leg is substantially perpendicular to the mandrel feeding path, and the hypotenuse is in the mandrel feeding path, facing the leading ends of the incoming mandrels. The incline of the hypotenuse allows the leading end of the mandrel to smoothly displace the toggle stop out of the way for mandrel entry. After the mandrel has passed by the toggle stop and the toggle stop has moved back to its non-displaced position, the stop face associated with the short leg of the triangle has been restored to its position in the path of the mandrel, facing the trailing end of the mandrel, blocking it. In this way a toggle stop at the mandrel entry side of the rewinder can prevent excessive bounce-back of mandrels from the mandrel stop 30-2 at the opposite side of the rewinder. This toggle stop may be used in conjunction with the mandrel justifier disclosed above or without the mandrel justifier disclosed above. The toggle stop may also be used with cores if desired.

The braking shoe 30-3 which presses the mandrel against the mandrel assist wheel 30-1 may be mounted with a spring, or other elastically yielding member. Or it may comprise a formed piece of plastic or thin metal with inherent springiness which contacts the mandrel directly. Thus, the braking shoe 30-3 may be set to have greater interference on the mandrel to reduce or minimize the negative effects of non-circular mandrel ends. For instance, if an oval-shaped mandrel arrives at the assist wheel with its minor diameter aligned to the wheel and braking shoe, the spring-loaded shoe may nonetheless contact the mandrel and press it against the assist wheel with enough force for the mandrel to be controlled, or if an oval-shaped mandrel arrives at the assist wheel with its major diameter aligned to the wheel and braking shoe, the spring-loaded shoe may deflect away from the mandrel readily and thereby apply a force which is not excessive so that the mandrel is controlled. The spring-loaded braking shoe may also be used with cores if desired.

Infeed Roller

The mandrel extraction system is typically provided with an infeed table 80 down which the logs roll as they exit the previous machine in the process, which is often a tail sealer 32. The infeed may be in accordance with pending US 2023/010524 (application Ser. No. 17/944,688), the disclosure of which is incorporated by reference. Detectors, preferably photo-eyes, positioned along the table 80 may detect the log's approach and be used to predict the log's arrival time. Logs may exit the tail sealer 32 at uneven intervals because there is variation in how long each log takes to undergo the tail sealing process. As an example, logs may arrive at the tail sealer 32 with the tail end of the web in varying orientations around the log (e.g., with the tail end of the web at the 3 o'clock position, then at the 8 o'clock position, etc., randomly), which may result in variations in the time required for the tail sealer 32 to complete the tail sealing process. Logs may arrive in the tail sealer 32 with the unsealed tail more or less wrinkled or sometimes folded over, and thus require more or less time for the tail to be laid flat as part of the tail sealing process. Logs may bounce when they are abruptly stopped at the end of the infeed table 80, which requires providing a waiting time in the extractor log loading process to allow the log to settle, which increases the process cycle time and reduces the cycle rate.

Figure 8:
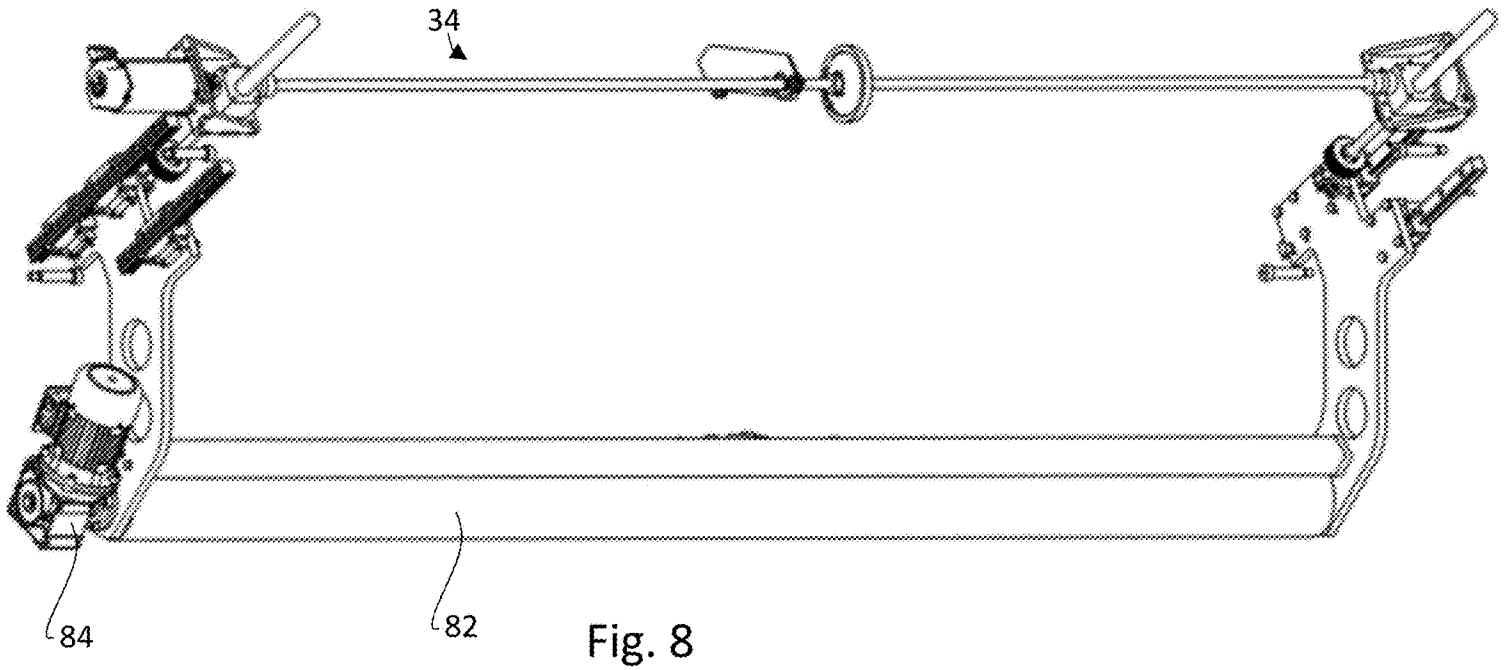
FIG. 8 is a perspective view of an infeed roller assembly.

To make the log infeed process more robust and increase the attainable cycle rate, an infeed roller assembly 34 such as that shown in FIG. 8 may be positioned above the infeed table 80, with a gap between a roller 82 of the assembly and the table 80 that is slightly smaller than the log diameter. To afford good control of the logs, the roller 82 may be covered with a high or moderately-high traction surface, such as sprayed tungsten carbide or sprayed plasma coating, or a resilient material with high or moderately high grip such as foam, rubber, nitrile, urethane, or the like, for example, 25 Shore A Valrite or 40 Shore A Valthane, available from Valley Roller, N257 Stoney Brook Rd, Appleton, WI 54915. To help accommodate variations in log diameter, the roller 82 may be covered with a resilient material, or by providing the roller as a "no crush" roller or series of roller segments, for example from Wagner Industries Inc. of Frackville, PA 17931. The roller 82 preferably rotates in the opposite direction of the logs' rolling rotation to receive the log gently and then to expel the log. The roller 82 is driven in rotation by a motor 84. The infeed roller 82 decelerates the log, reducing its translational velocity, so that the log has less energy and may bounce less when it is stopped at the end of the infeed table 80. In a preferred embodiment the log alignment conveyor 36 (see next section) is at the end of the infeed table 80. Reducing the bounce-back of the logs on this alignment conveyor 36 may make alignment of the logs by the conveyor more reliable and expeditious. The rotational velocity of the infeed roller may be constant from log to log, at a velocity slow enough to reduce or minimize bounce-back of the logs, and yet fast enough to load them expeditiously to the log lift conveyor for the required cycle rate. The compression of the infeed roller 82 on the logs may be varied according to at least the log firmness, log diameter, log mass, or substrate friction characteristics. The rotational speed of the infeed roller 82 may be varied according to at least the log firmness, log diameter, log mass, substrate friction characteristics, line speed, or required cycle rate. Optionally, the rotational speed of the infeed roller 82 may be varied from log to log, or log set to log set. Variation of the roller rotational speed may be used to counteract the variation in log arrival time and thus deliver the logs to the downstream process with a uniform or more nearly uniform periodicity. Such periodicity restoration functionality has a high value, because if a log arrives later than the average periodicity, the lost time can only be recovered by having, and utilizing, available excess cycle rate capacity in the system. If, instead of having and utilizing excess cycle rate capacity to deal with the non-periodic arrival of logs, the periodicity of the logs can be restored, or nearly restored, or at least improved, the system can operate with its average cycle rate closer to its maximum theoretical cycle rate, without a reduction in reliability, which results in greater production and efficiency. Variation of the infeed roller rotational speed, also called modulation, may be based on a signal from the tail sealer 32 regarding how long it took to complete the tail sealing function of a log. It may be based on the predicted time of arrival of the logs at the infeed roller, which may be determined with calculations using signals from the aforementioned detectors positioned along the infeed table. Using the arrival time predicted by the detectors may be preferable because it takes into account more potential sources of variation among products, for instance the rolling time of the logs on the table 80. Rotation of the infeed roller 82 may be stopped between the arrival of logs, but preferably it rotates continuously, which is preferable for accommodating higher cycle rates which have shorter intervals between logs. The infeed roller 82 may rotate at a baseline speed, as described above, and then be modulated faster or slower, as described below. When a log is predicted to arrive at the infeed roller earlier than the average periodic interval, then the speed of the infeed roller may be decreased, to slow the log a greater amount. If a log is predicted to arrive at the infeed roller later than the average periodic interval, then the speed of the infeed roller may be increased, to slow the log a lesser amount. The average periodic interval may be calculated based on a signal from the rewinder, or an average of the logs processed by the tail sealer 32, or a virtual signal such as may be generated by the PLC. A detector, preferably a photo-eye, is preferably located downstream from the infeed roller 82, preferably near the end of the infeed table 80, to detect the time of arrival of logs expelled from the infeed roller. The signal from this detector may be used as feedback to adjust and alter and optimize the modulation of the infeed roller, with the objective of delivering logs to the extractor at a more nearly uniform interval than the logs arrive at the infeed roller, and more preferably at a uniform interval substantially corresponding to the period of the rewinder cycle rate for log production. Preferably the adjustments to the modulation based on the feedback from the detector are executed automatically by the PLC as a type of self-learning system. The height of the roller 82 above the table 80 may be adjustable to allow for logs of different diameters, in either a manual or an automatic fashion. While modulation of the infeed roller to improve the periodicity of logs is explained here in the context of a mandrel extractor infeed, its utility is not limited to this application. It may be used ahead of other modules that may benefit from a more uniform time span between arrival of logs. Non-limiting examples, for instance, include tail sealers and log accumulators.

Log Alignment Conveyor

As described in U.S. Pat. No. 9,284,147, when a "simple pulling mode" is used to withdraw the mandrel an actuator such as a pneumatic cylinder, may be used to push the log end face against restraint plates in order to align the log in a direction along its axis (the cross-direction) for mandrel removal after the log is in a position in which the mandrel's axis coincides with the axis of a clasp. A drawback of this approach is that it takes time during a part of the process that is critical to maximum cycle rate. Another drawback is that with multiple puller extractors an actuator is required at each station to shift the logs. An improved method includes aligning the logs prior to moving the logs into positions in which each mandrel's axis coincides with the axis of a clasp. A way to accomplish this cross-direction pre-alignment is to provide a log alignment conveyor 36 as shown in FIG. 9. The log alignment conveyor comprises a flat belt conveyor at the end of the infeed table 80. The log alignment conveyor 36 moves the logs in the cross-direction as they arrive at the end of the infeed table. The log alignment conveyor 36 may be positioned where the log lift conveyor 38 picks up the logs, to afford a more compact design. The conveyor 36 may be segmented, so as to allow the paddles of the log lift conveyor 38 to pass through the gaps between the segments. The log alignment conveyor belt material may have moderate or moderately low traction to prevent scuffing or tearing the logs so that the belt may run continuously, even after a log on it has been aligned. Movement of the log alignment conveyor may be stopped between logs, but preferably it moves continuously, which is preferable for accommodating higher cycle rates which have shorter intervals between logs. The conveyor may be driven by an electric motor. The speed of the log alignment conveyor 36 may be varied according to at least the log firmness, log diameter, log mass, substrate friction characteristics, line speed, or required cycle rate. Preferably, the log alignment conveyor is canted at an angle so that logs tend to roll across it expeditiously. Thus, logs may be aligned in the cross-direction as they complete their translation from the infeed roller assembly 34 to the log lift conveyor 38 pickup position. Shifting the logs with the log alignment conveyor 36 as the logs roll to the mandrel extractor 44, instead of when they are stationary in the mandrel extractor, may reduce the cycle time and increase the attainable cycle rate. Further, the conveyor belt is inherently a faster alignment system than the pneumatic cylinders which operate at low pressure and force to avoid axially compressing relatively low firmness logs. And, the log alignment conveyor can operate with only one actuator, in the above example an electric motor.

Disposed near the end of the log alignment conveyor 36, at the same side of the machine from which the mandrels are withdrawn, is a stop reference plate 86 against which the face of the side-shifting log is moved by the conveyor. The stop plate 86 has a profile which allows the end of the mandrel, which protrudes beyond the face of the log, to extend beyond the face of the plate. The position of the stop plate 86 may be adjusted in the cross-direction to accommodate various log lengths and preferred stop positions and may be adjusted relative to the height of the infeed table and conveyor belt to accommodate logs of various diameters. Upstream in the rewinder 30, the mandrel loading and log winding processes may be set up such that the end of the mandrel, which will be grasped by the clasp for removal from the log later in the process, protrudes a consistent distance from the end of the log. By then moving the log in the cross-direction until its end face contacts the stop plate 86, the end of the mandrel may be placed in a suitable cross-direction location for mandrel removal from the log.

Log Lift Conveyor

Figure 6:
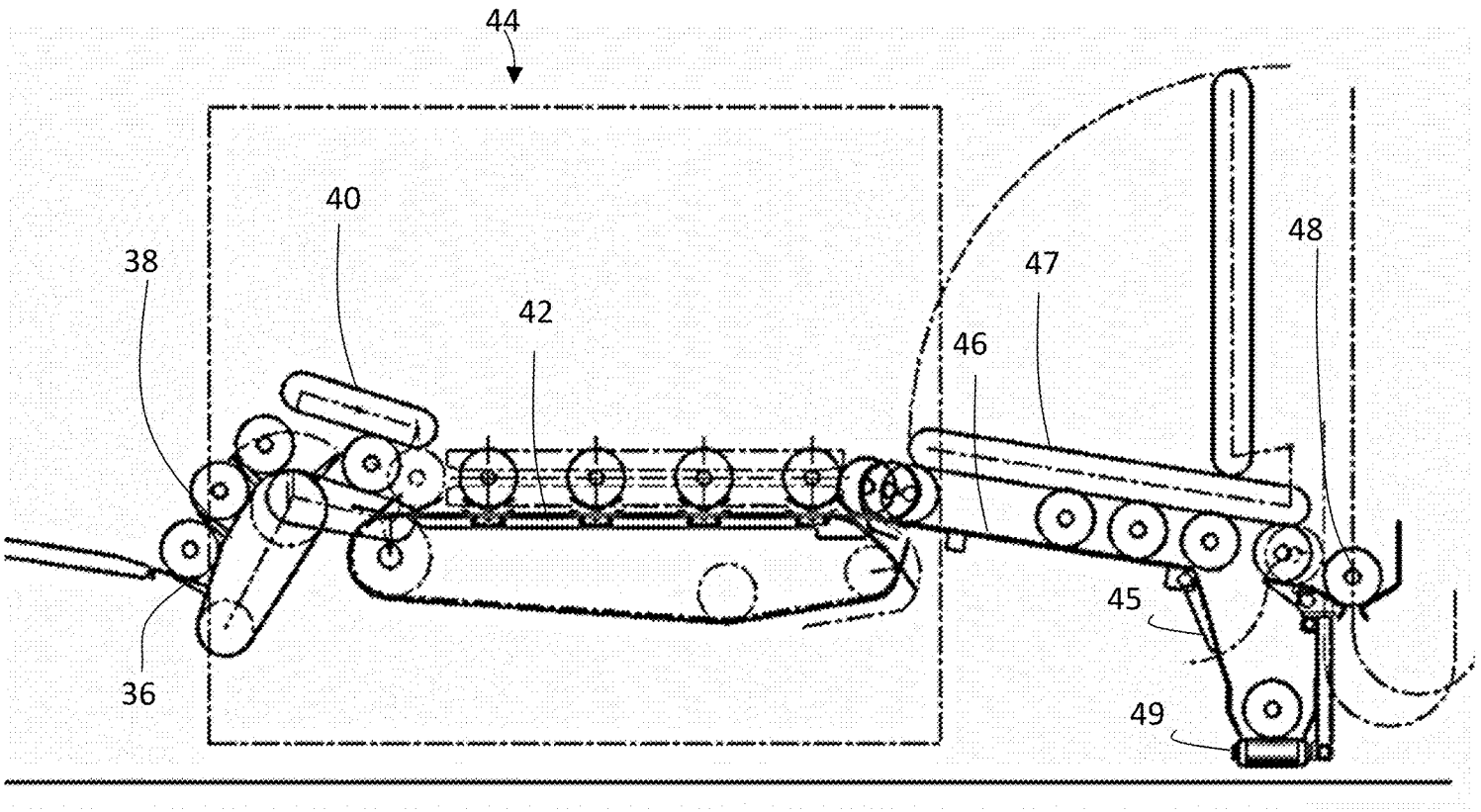
FIG. 6 is a schematic side elevation of a 4-puller mandrel extractor.

The log lift conveyor 38 is shown in FIG. 10, and satisfies multiple functions in the mandrel extraction system. In one aspect, it is desirable for a converting line for coreless rolls to be as similar as possible to a converting line that makes rolls with cores, so that the need for specialized equipment is minimized. For this reason, it is desirable that the log exit point from the tail sealer 32, and the log entry point into the log accumulator 48, be at approximately the same height in a coreless line as in a converting line that makes only rolls with cores, where the extractor is omitted, so that the same tail sealer and accumulator modules may be used in both types of converting lines. This is facilitated by having the logs elevated, or raised, as they are processed within the mandrel extractor 44, so that the infeed and outfeed tables can have reasonable inclination for the logs to roll on them. Elevating the logs in the extractor prior to mandrel extraction also provides space for the mandrels to be lowered to a mandrel return system 50,52,54,56 after the mandrels are removed from the logs. Part of this log elevation is performed by the log lift conveyor, which lifts the logs from the infeed table. Part of this log elevation may be performed by the main log conveyor 42 (explained below), if it operates at an inclination, as shown for example in FIG. 5. In another aspect, the log lift conveyor 38 provides a mechanism to queue several logs for introduction to the mandrel extractor 44. FIGS. 5 and 6 show mandrel extractors with three and four mandrel pullers, respectively. Fewer mandrel pullers or more mandrel pullers may be provided. Adding mandrel pullers increases the maximum theoretical cycle rate, but with diminishing returns. Adding mandrel pullers decreases the ease with which the inner mandrel pullers may be accessed by machine operators, and increases the cost of the mandrel extractor. After a log arrives at the end of the infeed table 80 and is aligned to the proper cross-direction location for mandrel extraction, it is ready to be advanced by the log lift conveyor. The log lift conveyor 38 may include flights 88 on a belt. The log lift conveyor 38 may index one flight length to raise the log, making room for the next log to arrive. After the next log arrives the log lift conveyor may index one flight length again to make room for the third log to arrive. In a 3-puller extractor (FIG. 5), after the third log arrives and has been aligned in the cross-direction with the log alignment conveyor 36, the log lift conveyor 38 and infeed conveyor assembly 40 may triple-index to deliver the three logs to the carriers 90 on the main log conveyor 42. In a 4-puller extractor (FIG. 6), after the fourth log arrives, the log lift conveyor 38 and infeed conveyor assembly 40 may quadruple-index to deliver the four logs to the carriers on the main log conveyor 42. Two important functions performed by the log lift conveyor are log accumulation and staging. Its log accumulation function allows the mandrel extractor to receive logs at the average interval between their production and yet take longer than this duration to execute the steps required for mandrel extraction. Its staging function sets the correct phasing of the three logs to the carriers 90 on the main log conveyor 42 into which they will be loaded, so the triple index can be executed in a short time, which facilitates operating at high overall cycle rates. Typically, each log lift conveyor belt in a 3-puller extractor has at least three paddles or flights 88 mounted on it, one for each log in the set. To accommodate larger diameter logs that may not fit between the paddles 88, the center paddle on each belt may be removed. In this configuration the system may execute a double-index when the first log in the set arrives, so it is advanced from the log pickup position to a dwell position in the infeed belts assembly 40. The system may execute a triple-index after the second log in the set arrives, to advance the two logs and load them to the main log conveyor 42. Two logs are loaded, one to the rightmost extraction station, one to the leftmost extraction station, and the center extraction station is empty.

The inclination angle of the log lift conveyor 38 may be selected to minimize negative effects on the phasing of the logs to the carriers 90 on the main log conveyor 42. In a 3-puller extractor, when the log lift conveyor 38 indexes one flight length to advance the first log, the first log may settle and align in the generally V-shaped region between the paddle 88 and the surface of the belt on the uppermost pulley of the log lift conveyor when the conveyor motion stops. The second log may likewise settle and align in the generally V-shaped region between its paddle 88 and the surface of the belt on the uppermost pulley of the log lift conveyor after the log lift conveyor 38 finishes indexing a flight length to advance the first and second logs. When the log lift conveyor 38 triple-indexes after arrival of the third log at the log lift conveyor pickup position, the third log travels from the pickup position to a carrier 90 on the main log conveyor 42 without stopping. Because the third log travels over the uppermost pulley of the log lift conveyor without the conveyor stopping, typically without the conveyor slowing down, its trajectory, or approach angle, is relevant to whether or not the log remains in contact with the conveyor belt on the pulley. If the conveyor inclination is less steep, then the centripetal acceleration vector required to make the log deviate from its straight path and start to orbit around the conveyor pulley is more closely aligned with the gravitational acceleration vector, so the conveyor can run faster without the log losing contact with the belt surface. If the conveyor inclination is steeper, then the centripetal acceleration vector required to make the log deviate from its straight path and start to orbit around the conveyor pulley is less closely aligned with the gravitational acceleration vector, so the conveyor may have to run slower to keep the log from losing contact with the belt surface. For the logs to be correctly phased to their carriers on the main log conveyor they should preferably remain in contact with the log lift conveyor belt surface and paddle surface until they have reached the entrance of the infeed belts 40. As explained above, whether or not this preferred behavior is attained, especially at high speeds, is influenced by selection of the log lift conveyor inclination angle. Furthermore, log guides may be provided in proximity to the log lift conveyor at the log pickup position that prevent logs from contacting the log lift conveyor belts until after the logs have been lifted off of the log alignment conveyor 36. This may be done so that the logs do not rub against the log lift conveyor belts or do not contact the edges of the log lift conveyor belts as the logs are being shifted in the cross-direction by the log alignment conveyor. If such log guides are provided, each log may initially ride upward along these guides when picked up by the log lift conveyor before starting to migrate downward into contact with the log lift conveyor belt, which may occur after the logs have passed beyond the tops of the guides. If the conveyor inclination is less steep, then the acceleration vector required to make the log move downward into contact with the log lift conveyor belt is more closely aligned with the gravitational acceleration vector, so the conveyor may run faster and still allow time for the log to move downward into contact with the log lift conveyor belt before the log has to start orbiting around the log lift conveyor uppermost pulley. If the conveyor inclination is steeper, then the acceleration vector required to make the log move downward into contact with the log lift conveyor belt is less closely aligned with the gravitational acceleration vector, so the conveyor may have to run slower to allow time for the log to move downward into contact with the log lift conveyor belt before the log has to start orbiting around the log lift conveyor uppermost pulley. As explained above, for correct phasing, the logs should preferably remain in contact with the log lift conveyor belt surface and paddle surface until they have reached the entrance of the infeed belts 40. This preferred behavior may be facilitated by having the log move into contact, or closer to contact, with the belt surface before the log has to start orbiting around the log lift conveyor uppermost pulley. As explained above, whether or not this preferred behavior is attained, especially at high speeds, is influenced by selection of the log lift conveyor inclination angle.

The inclination angle of the log lift conveyor 38 may be selected to minimize negative effects of log bounce-back at its log pickup position. As explained earlier, the infeed roller may be used to reduce or minimize bounce-back of logs at the log lift conveyor pickup position. However, it may be found that log bounce-back is not eliminated, especially at high cycle rates where the logs must enter between the log lift conveyor paddles 88 in a short amount of time. This may be encountered when running coreless products. It may be more acute when the extractor operates in bypass mode. In bypass mode the logs are produced with cores that are not extracted. Because time is not required for aligning and restraining the logs nor for withdrawing the mandrels, the logs can theoretically be bypassed through the unit at higher cycle rates than when extracting mandrels. For instance, the extractor may operate in bypass mode at rates of 50 logs per minute (LPM) or even 60 LPM. At high log rates there is relatively little time for the log to enter between the log lift conveyor paddles and for the log lift conveyor to index. At high cycle rates it may be preferable to index the log lift conveyor before logs at the pickup position settle, when they are still bounced back away from the intended pickup position. If a log is picked up by the log lift conveyor when it is bounced back away from the log guides that are in proximity to the log lift conveyor belts, then the fast-moving conveyor paddle may carry the log up the conveyor without the log touching the guides, in which case the log has farther to move downward to come into contact with the log lift conveyor belt surface. This may cause a problem for the phasing of the last log in a set if the conveyors are performing a triple-index, as explained above, or for the first log in a set if performing a double-index. If the conveyors are performing a single-index it may not be a problem, as explained above, because the log may settle and align in the generally V-shaped region between its paddle 88 and the surface of the belt on the uppermost pulley of the log lift conveyor when the conveyor motion stops. But, it may be a problem for log phasing at higher cycle rates also when the conveyors are performing a single-index if the log has not properly settled or is still rocking when the log lift conveyor indexes again. In that case the log may be out of contact with the belt or the paddle when the log lift conveyor resumes motion. Having the log not in contact with the log lift conveyor belt surface and paddle surface as it is advanced to the entrance of the infeed belts 40 risks having improper phasing of the log to the carriers 90 on the main log conveyor 42. However, if the log lift conveyor inclination is less steep, then the acceleration vector required to make the log move downward into contact with the log lift conveyor belt, or the proximate log guide, is more closely aligned with the gravitational acceleration vector, so the conveyor may run faster and still allow time for the log to move downward into contact with the log lift conveyor belt, or the proximate log guide, or at least closer to contact, before the log has to start orbiting around the log lift conveyor uppermost pulley. If the conveyor inclination is steeper, then the acceleration vector required to make the log move downward into contact with the log lift conveyor belt, or the proximate log guide, is less closely aligned with the gravitational acceleration vector, so the conveyor may have to run slower to allow time for the log to move downward into contact with the log lift conveyor belt, or the proximate log guide, or at least closer to contact, before the log has to start orbiting around the log lift conveyor uppermost pulley. Having the log in contact, or closer to contact, with the log lift conveyor belt surface when the log starts to orbit around the log lift conveyor uppermost pulley may help to reduce or minimize rocking of the log at its single-index dwell position on the pulley. Some rocking of the log at this dwell position may be tolerated, of course, but the point here is that the for the logs to be correctly phased to their carriers on the main log conveyor, especially at high cycle rates, the amount of rocking should preferably be minimized, or at least not excessive, and whether or not this preferred behavior is attained, especially at high speeds, is influenced by selection of the log lift conveyor inclination angle. However, there are tradeoffs. A less steep inclination of the conveyor may allow for higher conveyor speeds and thus higher cycle rates, but it would tend also to increase the length of the machine, making it less compact. It also would tend to reduce the log elevation gain in the log lift conveyor, which may make it more difficult to utilize the extractor in a rewinder line with other standard converting modules, or otherwise may require the forfeited elevation gain to be provided elsewhere in the extractor, for instance at the main log conveyor.

Infeed Conveyor System

The infeed conveyor 40 may have lower and upper infeed belts 40*a*,40*b*, as shown in FIGS. 11, 12 respectively, that receive logs from the log lift conveyor 38 and deliver the logs to the main log conveyor 42. The infeed belts 40*a*,40*b* may be provided with a slight downward inclination for a smooth hand-off of logs to the carriers 90 on the main log conveyor 42. Typically, the upper and lower belts 40*a*,40*b* are moved at the same surface speed, so the logs are advanced solely by translation, without rotation. That said, the belts may be operated at differing speeds to rotate the logs relatively forward or backward. The speed of the belts at the moment of log handoff to the main log conveyor is controlled so that the component of the log velocity parallel to the direction of travel of the main log conveyor is substantially equal to the velocity of the main log conveyor. Between the moments of log handoff to the main log conveyor 42, the speed of the belts 40*a*,40*b* may be modulated faster or slower to adjust the phasing of the logs to the phasing of the carriers 90 on the main log conveyor 42. A detector, preferably a photo-eye, may be located such that it can detect the time of arrival of logs to a predefined point in the infeed belts 40*a*,40*b*. The signal from this detector may be compared to the planned or preferred time of arrival for the log at this point in the infeed belts and used to adjust and alter and/or optimize the modulation of the infeed belts, with the objective of delivering logs to the carriers 90 on the main log conveyor 42 with greater precision of the phasing. Preferably, adjustments to the infeed belts modulation based on the sensor feedback are executed automatically by the PLC as a type of self-learning system. Though the phase relationship between logs delivered by the infeed belts and the carriers on the main log conveyor may be good, or at least sufficient, without automatic modulation of the infeed belts' speed by the PLC, it is possible this method for automatic modulation may make it better, or may serve to make it more consistent over an extended time of operation.

In one aspect of the disclosure, a log guide 41 (FIGS. 4-5, 12) may be provided. The log guide may comprise an elongate member. The log guide may be positionable relative to a surface of the main conveyor 42 of a mandrel extractor 44 at a distance sufficient to allow a log L from an infeed conveyor system 40 to pass between the surface of the main conveyor and the log guide while maintaining the log in register with the mandrel extractor. One or more log guides may extend over at least a portion of the main log conveyor 42. Multiple log guides may also be used, preferably with a guide located above each belt of the main log conveyor. The log guide or guides may preferably extend at least over the region of the main log conveyor where the logs are transferred from the infeed belts 40 to the carriers 90 on the main log conveyor 42. The log guide or guides may extend over the first (nearest) mandrel extraction station. The log guide or guides may extend over the first mandrel extraction station, over the first and second (center) mandrel extraction stations, or over all the mandrel extraction stations. The log guide or guides may be used to ensure the logs delivered by the infeed belts to the main log conveyor seat in the carriers on the main log conveyor. If the logs arrive at the main log conveyor slightly out of phase with the carriers on the main log conveyor, they may rock in the carriers, especially as the main log conveyor accelerates or decelerates. The log guide or guides arranged above the main log conveyor 42 may serve to guide or press or displace the logs into the carriers, reducing their phase mismatch, so the logs do not rock, or they rock less. The log guide or guides may have a profile shape conducive to guiding, pressing, and/or displacing the logs downward into the carriers 90 at or following the region where the logs are transferred from the infeed belts 40 to the carriers 90 on the main log conveyor 42. The log guide or guides may be arranged to not press the logs into the carriers, but nonetheless keep the logs from rocking excessively by being in close proximity to the logs so that if a log starts to rock in the carrier it will contact a guide and have its rocking motion limited. In one aspect, the log guide 41 may be removably connected to the frame structure of the upper infeed belts 40*b*. Having the log guide or guides removably attached to the upper infeed belts structure, which is adjusted in height when changing the log diameter, causes the height of the guide or guides to also be adjusted when changing the log diameter, so the guide or guides may be correct for the new log diameter, or require only a relatively smaller separate adjustment. Alternatively, the guides may have an independent mounting, for example, brackets on the machine framework comprising the main log conveyor 42 or the mandrel extractor 44. For simplicity, the guides may be stationary during operation of the extractor. Potentially, the guides may be mounted with springs or pneumatic devices, or equivalent, so they displace and their pressure on the logs may be consistent during operation of the extractor. The log guides may be operatively removably attachable to the mandrel extractor, main conveyor or infeed conveyor system to allow replacement when worn.

Main Log Conveyor

The main log conveyor 42 is shown in FIG. 13. The main log conveyor 42 may be configured as log carriers 90 attached to timing belts. The log carriers 90 may be provided with a shape, such as a V-shape, that tends to keep the logs in a constant position relative to the log carriers when subjected to high accelerations necessitated by high-speed movements. The main log conveyor 42 of the 3-puller extractor may be provided with a slight upward slant to elevate the logs to a suitable height for delivery to the outfeed table 46 that carries logs to the downstream module, typically a log accumulator 48. This upward slant may not be necessary in a 4-puller extractor, because the log lift conveyor, having a capacity for four logs, may be taller than the log lift conveyor of the 3-puller extractor.

The timing belts of the main log conveyor preferably operate on timing pulleys, except in the region of log discharge, where they may operate on a profiled turning block 43. In this place a profiled turning block may be used to better set and control the accelerations imposed on the logs as the conveyor discharges them. If a timing pulley was used in this place the logs would tend to undergo a large step change in acceleration. Using a profiled turning block 43 allows the step change in acceleration to be reduced, so the main log conveyor can be operated at higher speeds and the logs still be controlled well enough at discharge. A straight section, or longer straight section, of main log conveyor 42 after the last mandrel puller (which is nearest the outfeed table 46), before the turning block, may be beneficial so the conveyor can be accelerated to constant velocity, or closer to constant velocity, before the first carrier with a log starts to rotate around the turning block. If the conveyor is traveling at constant velocity the motion profile acceleration is zero, so it does not add to the peak acceleration seen by the log as it passes over the turning block. If the conveyor is still accelerating as the log passes over the turning block, a component of this motion profile acceleration is seen by the log, increasing its total acceleration. In that case, it may be necessary to reduce the conveyor speed, to reduce the total acceleration seen by the log, or the log may roll up the tail of the conveyor carrier an excessive amount as the carrier passes over the turning block. However, there are tradeoffs. A longer straight section may allow for higher speeds and thus higher cycle rates, and also an increase in elevation of the logs at discharge, but it would tend also to increase the length of the machine, making it less compact.

Outfeed Conveyor System

After the mandrels have been removed from the logs, the next triple-index motion may be executed, which delivers the next group of logs, staged at the infeed conveyor assembly 40 and log lift conveyor 38, to the extraction stations, and simultaneously delivers the current group of logs, which are now coreless logs, onto the outfeed table 46. The logs roll on the outfeed table 46 into a space beneath the outfeed belts 47 which control the translational velocity of the rolling logs and meter them into the next machine in the process, typically a log accumulator 48. To attain high throughput, the triple index is preferably executed in a short duration of time, which means the logs may be discharged from the main log conveyor at a relatively high translational velocity and instantaneous log rate. The logs may be discharged from the main log conveyor at instantaneous rates in excess of 100 LPM, in excess of 120 LPM, potentially even in excess of 135 LPM. After receiving a set of logs the outfeed belts decelerate the logs to an instantaneous rate the downstream equipment can accommodate, typically in the range of 20-60 LPM for a log accumulator, though slower or faster log delivery rates may be provided.

The outfeed belts may be pivoted to a raised position 47*b* (FIG. 5) when not in use, such as when operating the extractor in bypass mode, when only single indexing is utilized, or for personnel access to the extractor module when the machine is not running. The outfeed table 46 may also be pivoted up (not shown) for access to the extractor module.

A log cull system 45,49 (FIG. 5) may be provided between the mandrel extractor and the next module downstream, most often a log accumulator. The cull system may be located close to the extractor, but a disadvantage to this arrangement is that logs may emerge at too great of a velocity or instantaneous log rate for the gate to cull only one log in the set, or possibly even to cull multiple logs correctly. FIG. 5 shows a preferred location for a log cull system, nearer the next downstream module, in this case a log accumulator. The log cull gate 45 is mounted on a pivotable shaft. The gate is shown in its closed position, where it forms part of the table which delivers logs to the accumulator. When a log is to be culled, or logs are to be culled, the gate is pivoted downward, so that the log or logs are diverted from the normal processing path to a log conveyor 49 located beneath the table, which carries logs in the machine cross-direction, out of the rewinder line, where they can be retrieved by the operator or otherwise disposed of.

An advantage of locating the log cull system 45,49 nearer the downstream module, near the end of the outfeed belts 47, is that the logs may be decelerated to a lower instantaneous log rate when, or before, they arrive at the cull gate. Because the logs pass over the log cull gate with a lower instantaneous log rate, the gate may be used to cull any one of the logs in the set or any combination of logs in the set: only the first log, only the second log, only the third log, the first and second logs, the second and third logs, the first and third logs, or all three logs. Of course this functionality requires that the conveyor 49 can take the logs away at least as fast as the logs fall from the cull gate. This may be achieved by using a fast enough belt velocity and high enough traction surface on the belt.

The log cull system may comprise a gate with pivot to its upstream side, which pivots downward to cull logs. The log cull system may comprise a gate with pivot to its downstream side, which pivots upward to cull logs. The log cull system may comprise both types of gates, which advantageously may cooperate to cull logs of larger diameter than either gate alone may accommodate.

Mandrel Extraction

A portion of the mandrel extractor 44 is shown in FIGS. 14-19 and includes a mandrel puller module 62 with a traveling carriage 92 and the clasps 60 mounted to the carriage 92. The system shown in FIGS. 14-19 improves upon the mandrel extractor system of U.S. Pat. No. 9,284,147. However, the mandrel extractor may also be configured to work with systems as shown in U.S. Pat. No. 9,290,347 and PCT patent application WO2020245319A1, which show examples of mandrels that are provided with mechanical features such as sockets and coupling elements to provide mechanical means for connecting to a mandrel clasp with corresponding mechanical features. In embodiments in which the mandrels are provided with mechanical features for connecting to a mandrel clasp with corresponding mechanical features, the clasp is in a position to engage an end of the mandrel when no relative movement between the mandrel and the clasp in a direction along the axis of the mandrel is required in order for the clasp to engage the mandrel.

Figure 14:
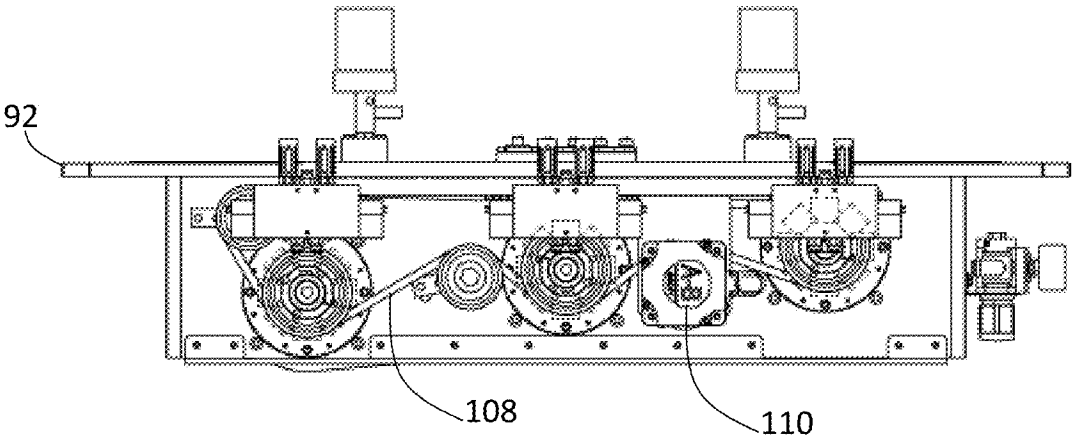
FIG. 14 is a front view of an exemplary 3-puller mandrel extractor.
Figure 15:
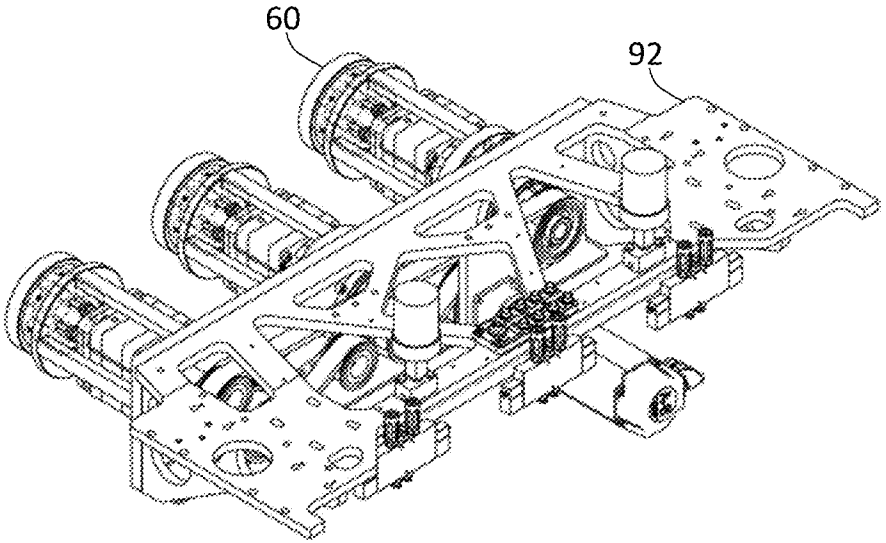
FIG. 15 is a perspective view of the mandrel extractor of FIG. 14.
Figure 16:
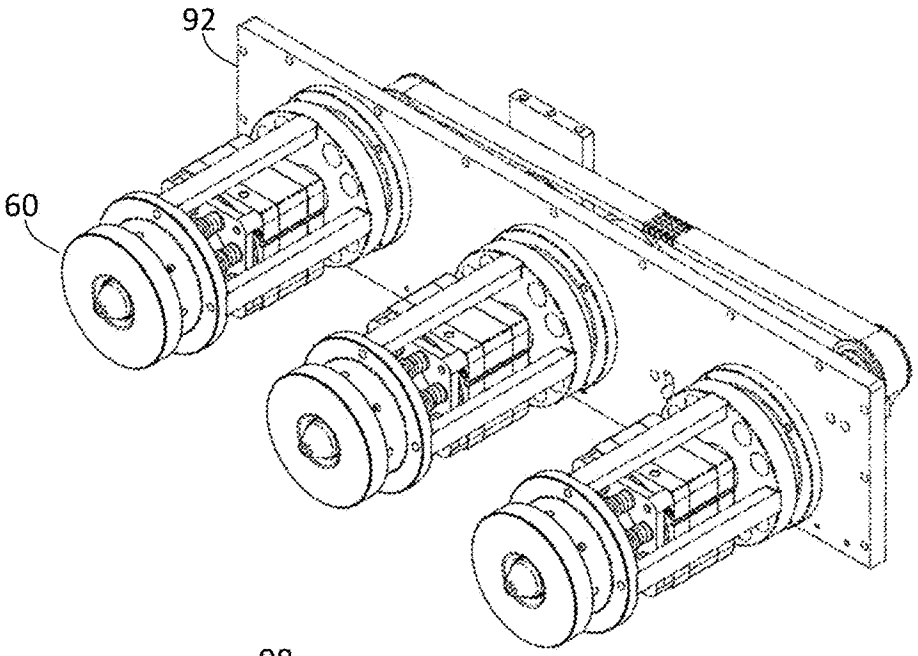
FIG. 16 is another perspective view of the mandrel extractor of FIG. 14.

The clasp illustrated in FIGS. 12-15 of U.S. Pat. No. 9,284,147 may be modified to accommodate variations in the radial travel of the clamping blocks during clamping. Winding mandrels may be tubular. The mandrels may be made of a homogenous material. The mandrels (M) may be substantially axially elastic and comprised of a material having a tensile yield strength divided by elastic modulus greater than 2.0%, for example High Density Polyethylene (HDPE). FIG. 14 of U.S. Pat. No. 9,284,147 shows a clasp in a position to engage an end of a tubular mandrel, in which the end of the mandrel is inserted over the prong of the clasp, and the clamping blocks of the clasp can be forced radially inwardly to clamp the mandrel between the clamping blocks and the prong. Making reference to FIGS. 17A-17C of the present application, the retaining plate 95 may be mounted with integral screw threads on the outer diameter of the clasp housing 94 so the retaining plate is configured as a "screw-on" cover rather than with multiple individual fasteners as shown in U.S. Pat. No. 9,284,147. This design makes it easier and faster to access the inside of the clasp. Making reference again to FIG. 17A-17C, the prong 96 (indicated with reference character 90 in U.S. Pat. No. 9,284,147) may be made as a separate, removable piece, instead of integral with the housing as shown in U.S. Pat. No. 9,284,147. This design results in a quicker change between clasp configurations among different mandrel diameters because the prong size can be changed without removing the clasp housing. In U.S. Pat. No. 9,284,147, the clasp 69 is provided with radially oriented screws 100 with radially oriented compression springs 99 to retract the clamping wedges 92 radially when the cylinder 70 extends to retract the actuator wedges 101 and disengage the mandrel. These parts may be replaced with the following alternative. Making reference again to FIGS. 17A-17C, the actuator wedges 98 and clamping wedges 100 of the clasp 60 may be provided with corresponding elongated T-shaped protrusions and elongated T-shaped slots which are arranged in an interlocking fashion. This design causes the actuator wedges 98 to positively move the clamping wedges 100 radially away from the mandrel when the actuator wedges are retracted axially by extending the cylinder actuator 102 to disengage the mandrel. In the alternative, the actuator wedges 98 and clamping wedges 100 of the clasp 60 may be provided with corresponding elongated dovetail shaped protrusions and elongated dovetail shaped slots which are arranged in an interlocking fashion. The actuator wedges may be made of steel, aluminum, brass, or an engineering plastic. The clamping wedges may be made of steel, aluminum, brass, or an engineering plastic. The actuator wedge may be made of brass and the clamping wedge may be made of steel. The surface of the clamping wedge which clamps the mandrel between the clamping wedge and the prong may be knurled or provided with other textured surface features or a coating for grip traction. The knurled surface or other textured surface features and the side surfaces of the clamping wedge may be hardened.

Figure 17A:
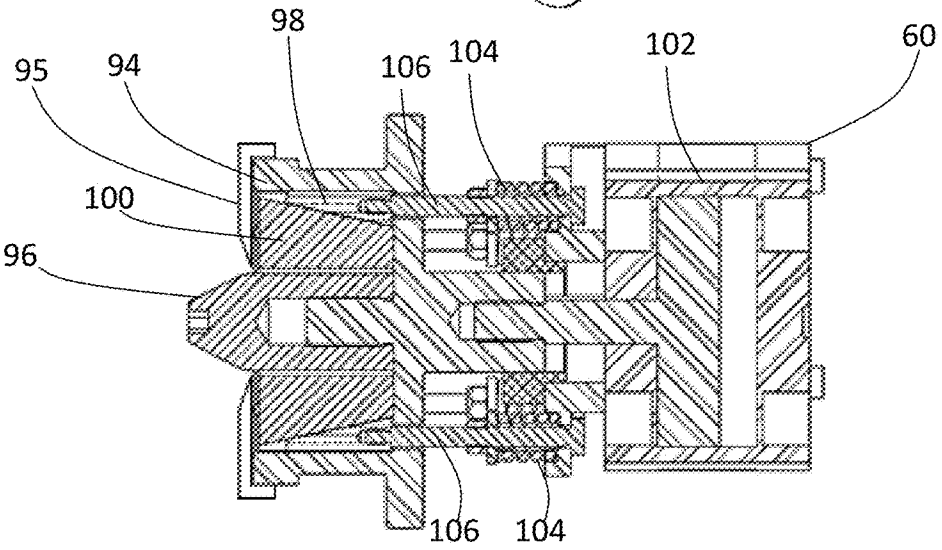
FIG. 17A is a cross sectional view of a clasp of the mandrel extractor of FIG. 14.
Figure 17B:
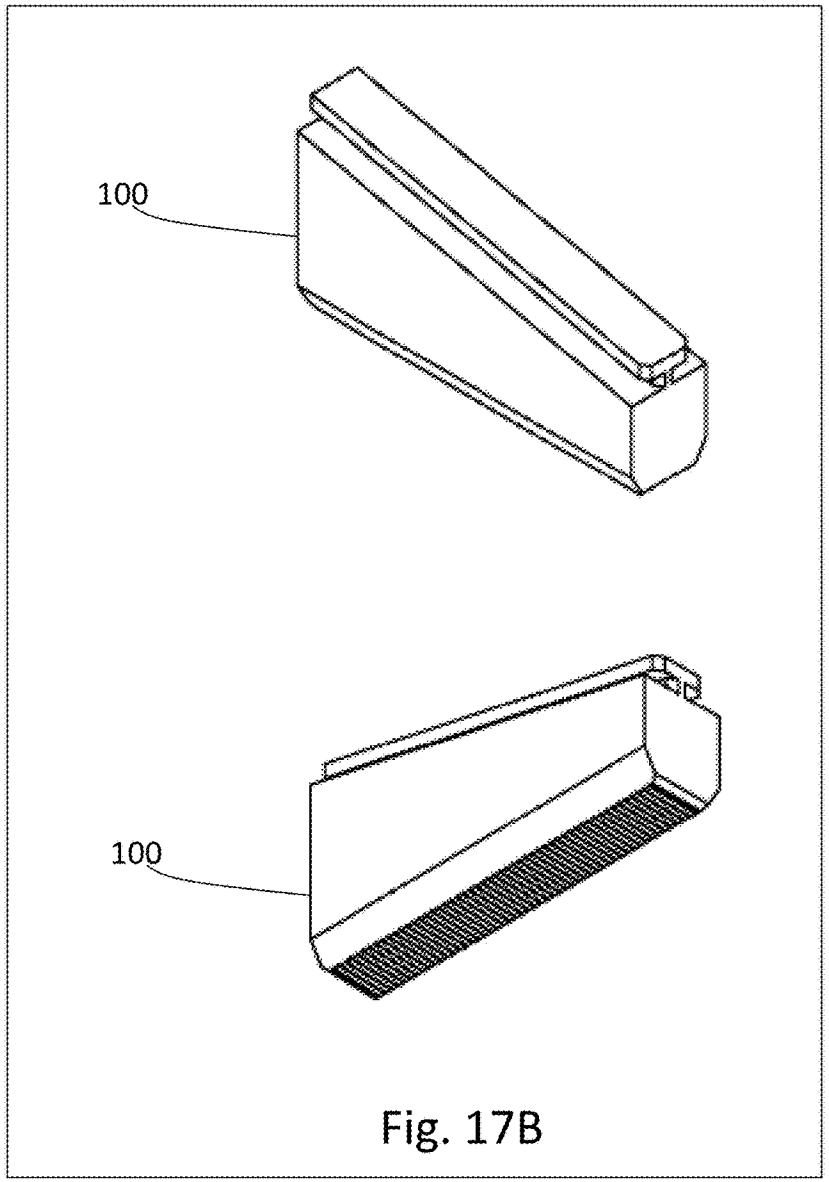
FIG. 17B show isometric views of a clamping wedge of the clasp of FIG. 17A.
Figure 17C:
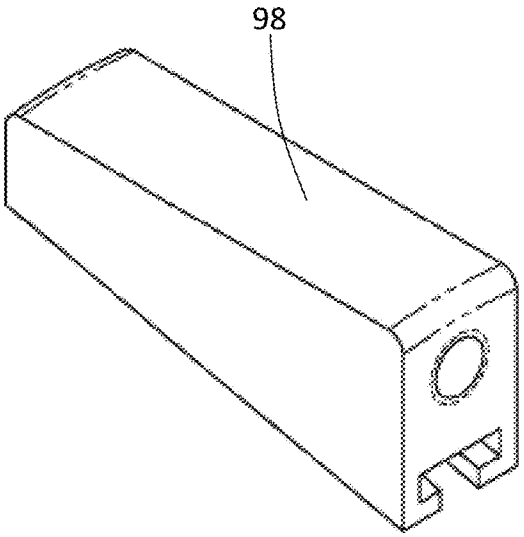
FIG. 17C is an isometric view of an actuator wedge of the clasp of FIG. 17A.

FIGS. 17A-17C illustrates a clasp 60 with a specific method of providing compliance between the shared cylinder actuator 102 and the individual actuator wedges 98. A compression die spring 104 is disposed on each actuator wedge's screw 106, and secured with a nut and washer to provide a minor preload to the spring. When the cylinder actuator 102 retracts to engage the clasp 60 to the mandrel (M), the actuator wedges 98 are urged axially leftward, causing the clamping wedges 100 to be urged radially inward. If one or several of the clamping wedges 100 is stopped by clamping the mandrel wall before other clamping wedges, their compression die springs 104 will compress in length, allowing the other actuator wedges 98 to continue moving axially, causing their associated clamping wedges 100 to continue moving radially. This design allows the clamping wedges 100 in the clasp 60 to press and clamp the tubular mandrel wall more evenly and uniformly, to better accommodate and possibly even compensate for mandrels that have varying wall thickness, lack of concentricity between the internal and external diameters, or have worn unevenly or somehow been deformed, or for uneven wear of the wedges and other components in the clasp. This design may make the clasp easier to set up when new, requiring fewer measurements and adjustments. This design may make the operation of the clasp more robust and reliable over extended durations of operation, as clasp components and/or mandrel ends may wear unevenly or be partially fouled with glue or dust.

Accordingly, in one aspect of the disclosure, a clasp may be configured for engaging an end of a tube. The clasp may include: (i) a prong having a generally cylindrical outer surface, the outer surface being adapted to be inserted into a bore of a tube, for instance, a mandrel; (ii) a housing being adapted to house a plurality of clamping wedges, the clamping wedges being spaced circumferentially around the prong within the housing, the plurality of clamping wedges being moveable between a disengaged position and an engaged position, wherein in the disengaged position, the plurality of clamping wedges are spaced radially outwardly from the outer surface of the prong at a distance sufficient such that a tube is insertable between the prong and the clamping wedges, and wherein in the engaged position, the plurality of clamping wedges are positioned radially inward of the disengaged position toward the prong, and wherein in the engaged position and when a tube is disposed between the clamping wedges and the prong, the plurality of clamping wedges presses the tube against the prong; (iii) a plurality of actuator wedges, wherein each of the actuator wedges in the plurality of actuator wedges is engageable with a corresponding clamping wedge of the plurality of clamping wedges to move the clamping wedge between the disengaged position and the engaged position, and between the engaged position and the disengaged position, wherein each actuator wedge is slidingly engageable with the corresponding clamping wedge along complementary wedge-shaped surfaces, wherein the wedge-shaped surfaces are provided with corresponding elongated protrusions and elongated slots, such that axial movement of the actuator wedge causes radial movement of the clamping wedge between the disengaged position and the engaged position and between the engaged position and the disengaged position; and (iv) a plurality of springs, wherein each of the springs in the plurality of springs is operatively connected to a corresponding actuator wedge in the plurality of actuator wedges, wherein when movement of the corresponding clamping wedge from the disengaged position toward the engaged position is stopped, the corresponding spring compresses in length.

Such a clasp may further comprise a retaining plate, wherein the retaining plate is threadably connected to the housing. In any such clasp, the corresponding elongated protrusions and elongated slots are T-shaped. In the alternative, in any such clasp, the corresponding elongated protrusions and elongated slots are dovetail shaped. In any such clasp, the prong may be threadably connected to the housing.

In a 3-puller extractor, three clasps 60 may be provided on the carriage 92 to remove mandrels from a group of three logs simultaneously. The clasps 60 may be mounted to a common moveable framework, or carriage 92 of the mandrel puller 62, that traverses along a path parallel to the direction of the axes of the logs and mandrels to remove the mandrels from the logs. The clasps 60 may be mounted to the carriage 92 with bushings or bearings, preferably tapered roller bearings suitable for withstanding the axial pulling force applied to the mandrel by the mandrel puller 62, in addition to providing a rotational degree of freedom of the clasps about their central axes. The mandrel may be rotated relative to the log as the log is held stationary by restraints 64 at its periphery, by rotating the clasp 60 about its central axis. The mandrel may be rotated relative to the log to disperse or smear the transfer adhesive as disclosed in U.S. Pat. No. 9,975,720. The mandrel may be rotated in the direction of the wind of the log. The mandrel may be rotated in the direction opposite to the wind of the log. It was observed with a tissue product that rotating the mandrel in the same direction as the wind may more effectively attach the internal tail to the side of the hole in the coreless log, making it less likely to be rendered loose when cut by the log saw and subsequently unravel. It was observed with a canister nonwovens product that rotating the mandrel in the direction opposite to the wind of the log may more effectively clean transfer adhesive off the mandrel, resulting in better machine hygiene. The mandrel may be rotated relative to the log before pulling of the mandrel is commenced, as pulling of the mandrel is commenced, and/or after pulling of the mandrel is commenced. Rotating the mandrel before pulling of the mandrel for extraction is commenced may be more effective at comprehensively smearing the transfer adhesive. But, rotating the mandrel during extraction of the mandrel has the benefit of taking less of the cycle time, which facilitates operation at higher cycle rates. Also, for some products it is helpful to pull and elongate the mandrel to reduce the torque required for the relative rotation before starting the relative rotation.

The mandrel clasps may be rotated by their own individual rotation actuators, in which case the actuators may be coaxial with the central axes of the clasps. Or they may share a common actuator 110 through a drive train 108, as shown in FIG. 14. The actuator may be a pneumatic rotary actuator, an electric motor, or similar. Preferably all the clasps are driven through a drive from a single electric servo motor 110, preferably through a serpentine timing belt drive train 108. Using a single shared actuator is economical. Using a servo motor allows for mandrel rotation of virtually any magnitude, from a partial revolution to multiple revolutions, allows for reversing the rotation, allows for executing precision accelerations to afford smooth movement, and provides for fault detection from its feedback signals. Another advantage of the preferred embodiment is that the clasps 60 can be mounted with hollow bore shafts through which the pneumatic lines for actuating the clasps are routed, which provides some containment and protection to prevent damage to the pneumatic lines during the puller motion and clasp rotation.

During the course of typical operation there is some variation in the distance the end of the mandrel at the extraction side of the machine protrudes beyond the face of the log. This may be due to mandrels being incorrectly positioned in the cross-direction in the rewinder or simply due to a variation in length among the mandrels. It may be due to an incorrect or imprecise location for the web edge in the rewinder line. At any rate, some variation is to be expected. To some degree, the variation can be dealt with by using a clasp that has significantly deeper axial length than the minimum required to engage the end of the mandrel, so it may function fine despite the variation. However, if there is too little protrusion the clasp may fail to adequately secure the mandrel end and the mandrel may slip out of the clasp during mandrel extraction which may damage the end of the mandrel. If there is too much protrusion the mandrel end may be impacted and damaged by the base of the clasp interior pocket as the clasp approaches the mandrel for engagement prior to extraction. To avoid these problems, a sensor, for example a photo-eye array or a camera, may be provided to measure the actual protrusion of the mandrel ends beyond the faces of the logs. If the protrusion of the mandrels is greater than can be accommodated by the clasps at their planned engagement positions, but is close enough to uniform among the three logs, the PLC may adjust the stop position of the clasps for mandrel engagement to be farther from the logs and continue without stoppage or a fault. If the protrusion of the mandrels is less than can be accommodated by the clasps at their planned engagement positions, but is close enough to uniform among the three logs, the PLC may adjust the stop position of the clasps for mandrel engagement to be closer to the logs and continue without stoppage or a fault. If the protrusion of the mandrels is too great or too little to be addressed by a change to the puller location for engagement of the mandrel ends, or if the variation in protrusion among the three logs it too great to be accommodated by a common puller location, the PLC may generate a fault and stop the machine without damage to the mandrel ends. Alternatively, if any one or two mandrels may be extracted and any one or two mandrels may not, the extractor may actuate the clasp or clasps for the mandrel or mandrels that may be extracted but not the clasp or clasps for the mandrel or mandrels that cannot be extracted. This may be accomplished by having a separate valve for control of each clasp's pneumatic actuator. Then the puller may remove the clasped mandrels and leave behind the non-clasped mandrels. Any logs with mandrels remaining in them would subsequently be removed from the product flow by the log cull system, which in the exemplary embodiment is located near the accumulator infeed 48, as shown in FIGS. 1 and 5.

Figure 25:
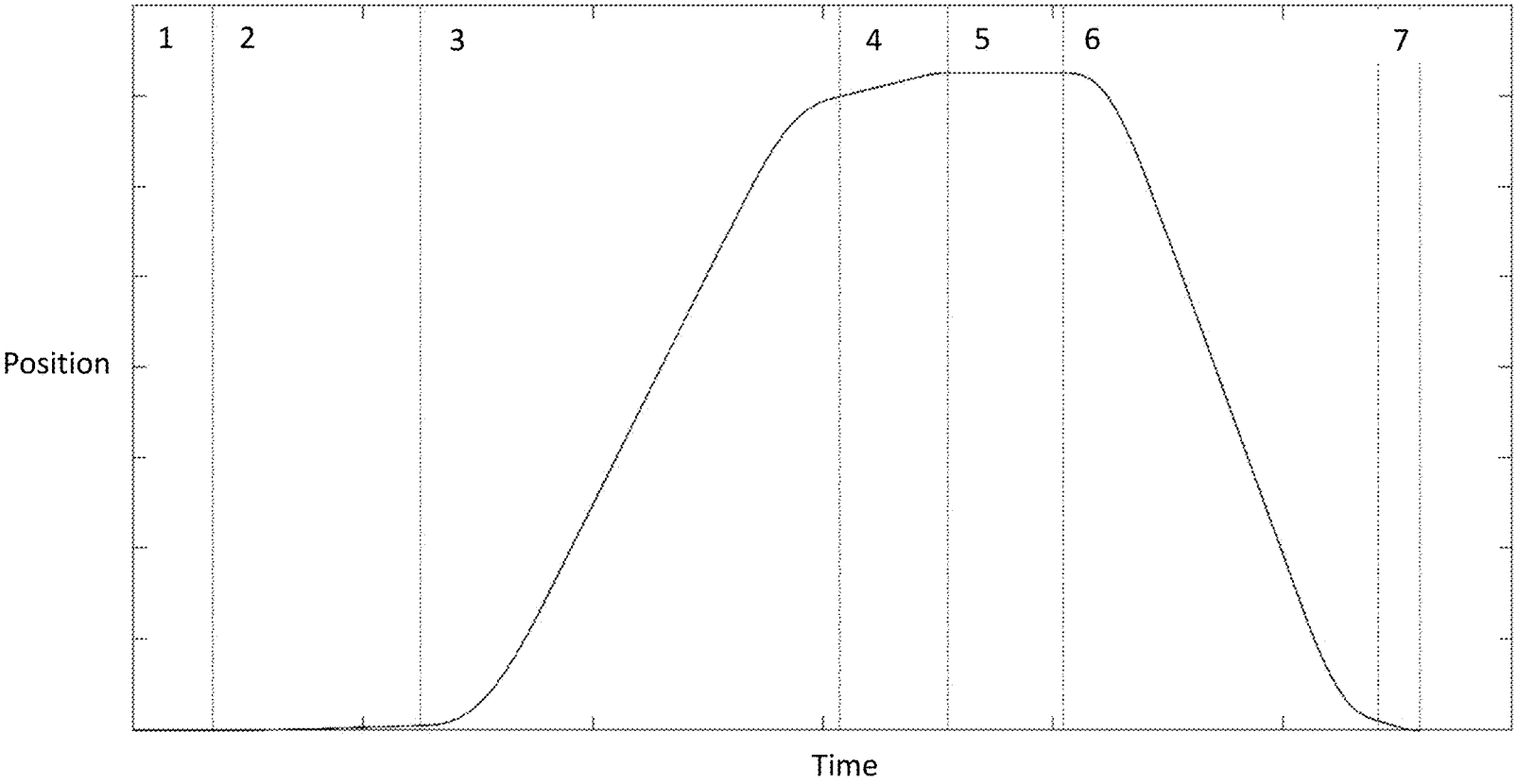
FIGS. 25-27 are graphs showing exemplary mandrel puller motion profiles.
Figure 26:
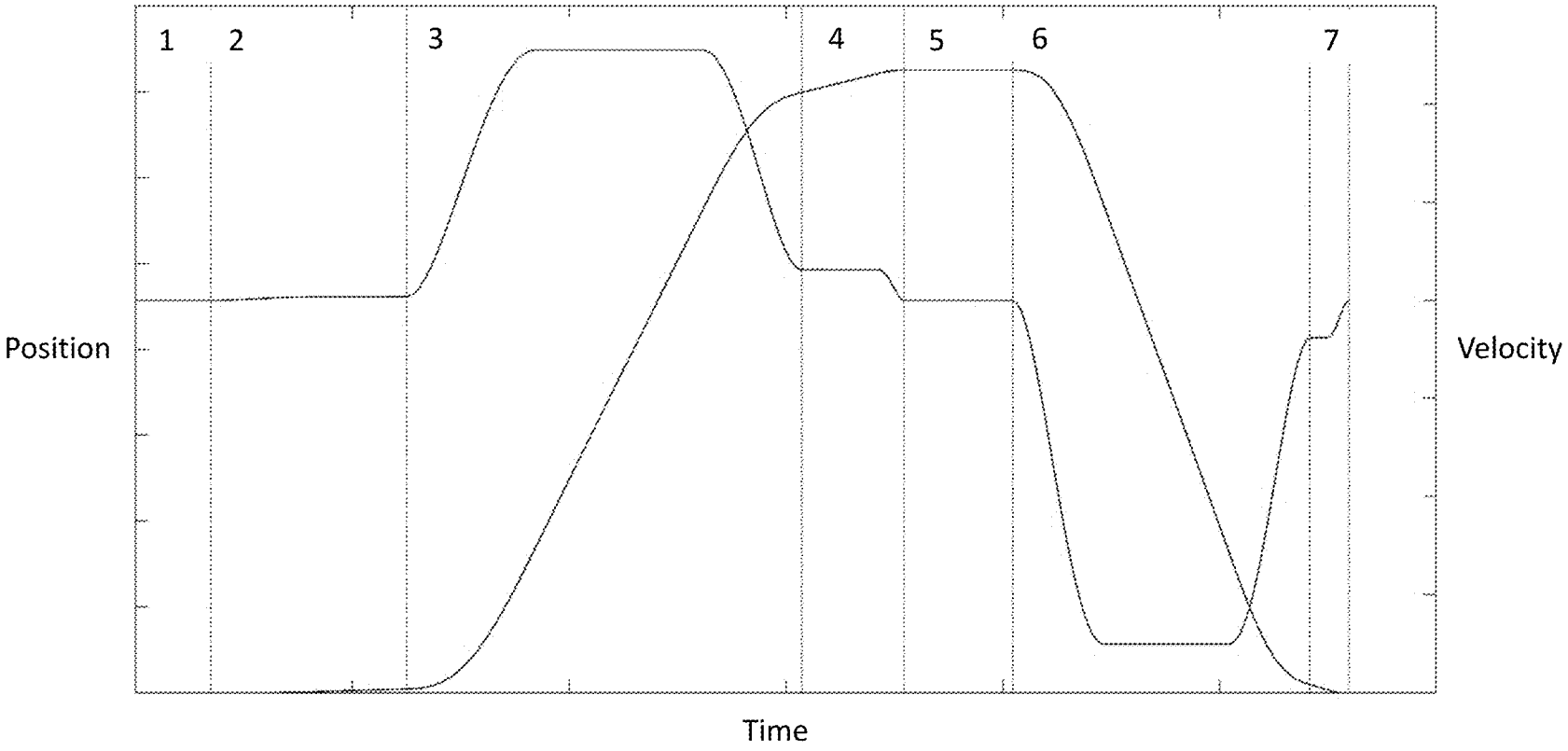
Figure 27:
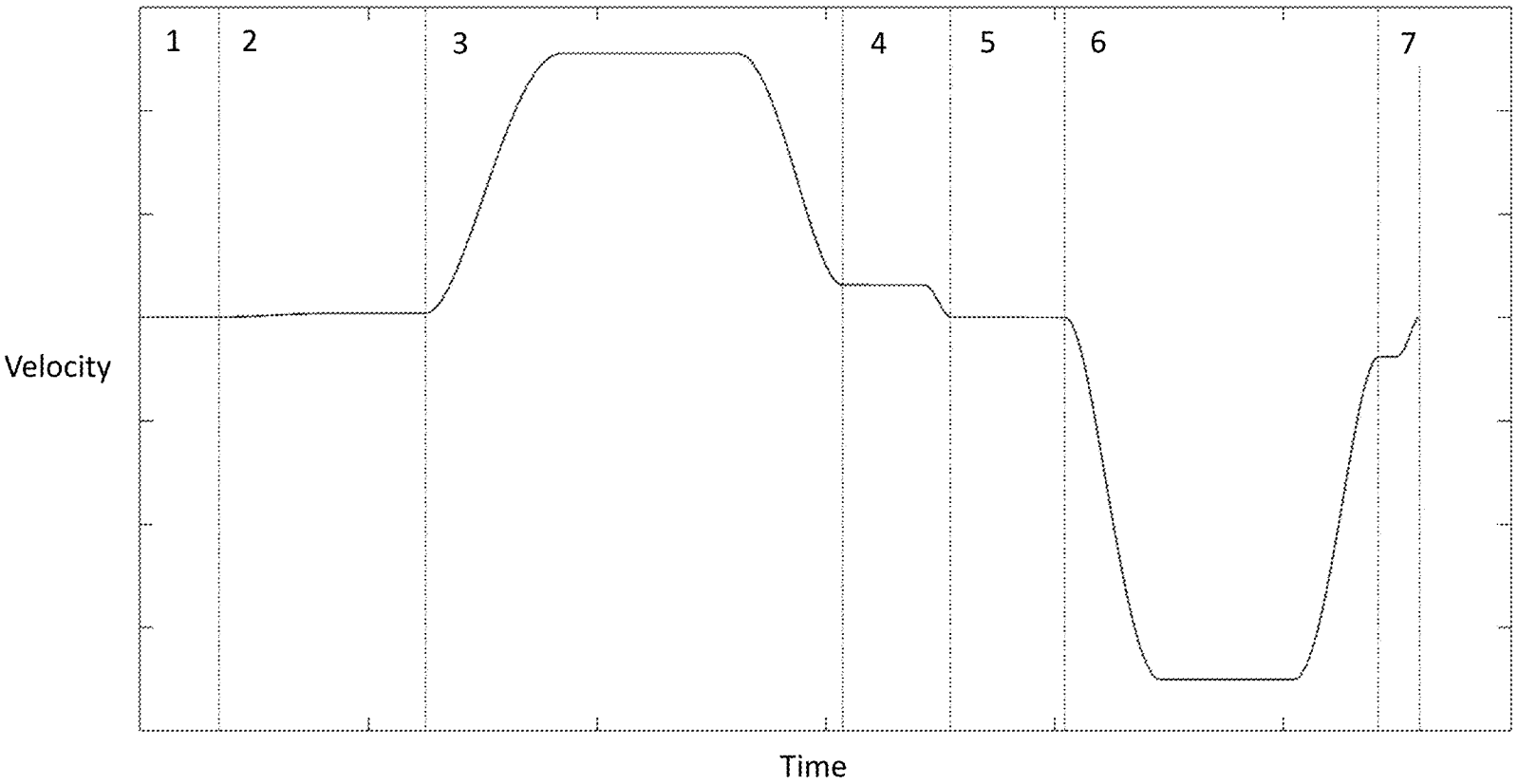

FIGS. 25-27 show a motion profile which may be used for a mandrel puller that traverses back and forth and is used to extract mandrels from logs of wound web material. During segment 1, the mandrel puller is configured with the clasp positioned at a mandrel engagement position to engage the end of a mandrel. The puller is stationary, dwelling in this position briefly to allow the clasp to actuate and engage the end of the mandrel. The duration of segment 1 is preferably at least as long as the time for the clasp cylinder to actuate the clamping wedges against the mandrel. If time is available in the cycle, it may be helpful to increase the duration of this segment to facilitate the clamping wedges to seat more securely into the viscoelastic material of the mandrel wall. Segment 2 is slow pulling by the clasp on the mandrel. The puller begins to travel slowly from the mandrel engagement position, moving the clasp away from the log slowly to facilitate stretching the mandrel and generate localized breakaway of the mandrel progressively within the log. The duration of segment 2 may be around 0.9 seconds, which is adequate for many products. The duration of segment 2 may be longer or shorter depending upon the nature of the products. The slow pull magnitude may be denominated in duration of time, as aforementioned, or in distance of travel. Using time is convenient for ensuring the desired cycle rates can be attained. Using distance is helpful for setting the pull magnitude relative to its objectives. The puller translation velocity may be constant for a portion of the slow pull duration. Alternatively, the puller translation velocity may be slowly increased throughout the slow pull duration.

An objective of the slow pull is to reduce, minimize, or optimize the peak force between the log and mandrel to extract the mandrel from the log. This is favorable for keeping the stresses in the mandrel low and for minimizing the likelihood of damage to the log. If the mandrel breaks free of the log progressively for a short portion of its length of engagement with the log, the peak force may be higher as the remaining length of its engagement breaks free suddenly. If the mandrel breaks free of the log progressively for a larger portion of its length of engagement with the log, the peak force may be lowered. If the mandrel breaks free of the log progressively for the entirety of its length of engagement with the log, the peak force may be lowered to a greater degree, even minimized. However, slow pulling takes time, so it is worthwhile to balance the benefits of executing longer duration slow pull against the benefits of a briefer, or optimized slow pull, which may yield higher cycle rates. Optimization of a sort may be done on the basis of product type. Logs which have higher firmness, and/or higher interlayer pressure, and/or higher interlayer friction, and/or higher column stiffness, which generally are more resistant to axial collapse and/or internal shifting of the wraps of web in the log, may have a shorter duration of slow pull. Logs which have lower firmness, and/or lower interlayer pressure, and/or lower interlayer friction, and/or lower column stiffness, and/or higher tack or gummier transfer glue, which generally are less resistant to axial collapse and/or internal shifting of the wraps of web in the log, may benefit from a longer duration of slow pull. Alternatively, or in addition, optimization of the slow pull may be done according to force feedback from the mandrel puller system. This feedback may be obtained by mounted force sensors or by observing the servo motor torque signal, which may be converted to pull force by known methods. The pull force feedback may be charted versus time, or distance traveled of the puller, and monitored for a change in slope of the graph which indicates the mandrel has broken free of the log and has relative axial sliding motion for the entirety of its length of engagement with the log. At this point the puller may accelerate to a relatively faster pulling speed because continued slow pulling would typically afford little if any further benefit. The puller may start to accelerate to a relatively faster pulling speed earlier, in anticipation of this point, since acceleration takes time, and therefore its velocity would be only a little greater at this point. The puller may start to accelerate to a relatively faster pulling speed earlier than this point if it is expected the product and mandrel will be okay and reducing the duration of the slow pull to attain a higher cycle rate is desired. The puller force feedback may be used by an operator to adjust, alter, and/or optimize the slow pull duration and/or distance, but more preferably it may be done automatically by the PLC.

Without stopping following this relatively slow pulling of segment 2, the pullers may be accelerated to a relatively higher velocity in segment 3 to withdraw the mandrels rapidly, to minimize the cycle period, which is favorable for operation at higher cycle rates. Mandrel rotation may occur during segment 2 or segment 3 or segments 2 and 3. Late in segment 3, the puller starts to slow down to the speed in segment 4. The clasp may unclamp and release the mandrel during the deceleration in segment 3. During segment 4 the mandrel end may be removed from the clasp. The velocity during segment 4 may be constant, to promote consistent positioning of the mandrels when released by the clasp, but continuing the deceleration from segment 3 into segment 4 is not ruled out. The mandrel may be separated from the clasp in segment 4 such that the clasp is no longer in a position to engage the mandrel end. During segment 4, drag guides may move to engage the outside of the mandrel, and may press or pinch the outside of the mandrel, to restrain it from moving axially as the clasp continues its movement, so that the mandrel end emerges from the clasp. Late in segment 4 the puller slows down further and comes to a stop at a puller stop position at the end of segment 4. From the start of the mandrel pulling (beginning of segment 2), to the time the puller stops without a mandrel (end of segment 4), the puller moves continuously, without stopping. This continuous motion affords an efficiency of time which facilitates operation at higher cycle rates.

During segment 5 the puller dwells at the puller stop position and remains stationary to allow time for the mandrel to be removed from the return path of the puller clasp carriage. For example, the mandrel may be lowered or dropped onto guides or a conveyor and returned to the rewinder to be reused. The mandrel may be lowered or dropped by utilizing gravity. Advantageously, the drag guides 66 and mandrel end supports 65 may lower the mandrel onto a mandrel return conveyor 50. Disengaging the mandrels from the clasps and quickly and reliably moving them out of the return path of the puller carriage is a critical phase of the extractor process. Therefore, this position is advantageously the position of the puller during its variable duration dwell. When extra time is available because the actual rate of logs processed is less than the cycle rate capacity of the extractor, this dwell is increased rather than the time being wasted. During the dwell time at the puller stop position before the puller initiates its return motion, the mandrels may be lowered to the return conveyor. The mandrels may bounce and then settle on the conveyor. Sensors at the conveyor may detect the mandrels are correctly in position and out of the return path of the puller carriage, so they are not damaged, and the motion planner may reset the virtual axis for the mandrel puller to follow. Having these functions and actions occur during this mandrel puller dwell of maximized duration affords greater process reliability and timeline efficiencies which facilitate operation at higher cycle rates.

The time for the end of segment 5, when the puller initiates its return motion in order to engage the mandrels in the next group of logs, depends on the duration required for its return travel and the time that the next group of logs will be in position and ready for the mandrel extraction. When the third log of a 3-log group arrives at the pickup position of the log lift conveyor, the log lift conveyor, infeed belts, main log conveyor, and outfeed belts can initiate a triple-indexing motion sequence to simultaneously unload the current group of coreless logs and load the next group of logs for mandrel extraction. As the logs are moved into position and prepared for mandrel extraction, which may include engaging the periphery of each log with a restraint and may include engaging the face of each log at the puller side end with a restraint, the puller may execute its return travel motion. The start of the return travel motion may be timed in accordance with the return travel duration so that the puller clasps move onto the mandrel ends at the moment the group of logs arrive at the extraction positions or slightly thereafter. It is preferable, if time in the cycle permits, to move the clasps onto the mandrel ends after the logs have been restrained at their periphery, so that incidental contact between the clasps and the mandrel ends does not cause the logs to shift axially in the extractor.

The puller may execute its return travel as depicted in segments 6 and 7, wherein it moves at a relatively lower constant velocity in segment 7 as the clasps move onto the mandrel ends. Alternatively, the puller may move the clasps onto the mandrel ends as it is decelerating from the relatively higher velocity of its return travel. When the puller comes to a stop at the end of segment 7 it is in a position where the clasps can engage the ends of the mandrels in the next group of logs. From the start of the puller return motion (beginning of segment 6), to the time the puller stops with the clasps on the mandrel ends (end of segment 7), the puller moves continuously, without stopping. This continuous motion affords an efficiency of time which facilitates operation at higher cycle rates.

A practice in previous extractors was to stop the mandrel puller on its return path from its mandrel extracted and released position to its mandrel engagement position. The mandrel puller was stopped with the puller clasps in relatively close proximity to where the ends of the mandrels to be withdrawn from the next group of logs would be when those logs were ready for mandrel extraction. The mandrel puller would wait (dwell) in that position until the next group of logs was ready for mandrel extraction. If the actual rate of logs received by the extractor was less than the tuned rate capacity of the extractor, then the puller would dwell there longer because this was its position of variable dwell. When the logs were ready for mandrel extraction the mandrel puller was moved from this dwell position toward the mandrel ends to its mandrel engagement position. After the clasps engaged the mandrels the puller extracted the mandrels from the logs. This intermediate dwell position allowed the puller to wait relatively close to the mandrel ends which tended to minimize the duration of time for the puller to travel to the mandrel engagement position after the logs were ready for mandrel extraction. However, upon examining the extractor process timelines when investigating the potential for operation at higher cycle rates, it was discovered that this intermediate dwell could be eliminated and that its elimination would afford various benefits. While not a requirement, eliminating the intermediate dwell may be facilitated by coordinating the extractor sequence of operations with a virtual time signal (see section Motion Optimization) which allows for coordinating the arrival of the puller clasps at the ends of the mandrels to be withdrawn when, or immediately after, the logs are ready for mandrel extraction, even with the compressed timelines that are required at high cycle rates. A benefit to this change in puller operation is that time the mandrel puller spent in dwell near the mandrel ends may be reallocated to other places in the timeline rather than wasted. For instance, the duration of the puller dwell at its mandrel extracted and released position may be increased. As explained above, this affords more time for the mandrels to be moved out of the puller return travel path, and/or more time for the mandrels to settle on the return conveyor, which is especially valuable if they bounce on the conveyor, and/or more time for the detectors to verify and communicate to the PLC that the mandrels are in the correct positions on the return conveyor, before the puller has to initiate its return motion. Another benefit is that because the puller does not stop and restart on its return path, it makes more efficient use of time. It may travel at a reduced maximum velocity and move from its mandrel extracted and released position to its mandrel engagement position in the same amount of time. Or, it may move at the same maximum velocity and return in less time, allowing higher cycle rates to be attained. Or, if it returns in less time, the freed-up time may be allocated to the mandrel extraction step, allowing for longer duration of slow pulling, reduced maximum velocity during extraction, or reduced velocity during engagement of the drag guides, without a reduction in the attainable cycle rate. This more efficient use of time allows for increasing the attainable cycle rate of the extractor and/or making the extractor process more robust by allowing more time for other steps in the process. Lastly, it is typical to set or tune the sequence of operations and motions of a converting module to be able to process logs at a somewhat higher rate than the average rate required. This is to accommodate fluctuations in the instantaneous rate of log arrival, which may occur due to variations in the log processing time in other modules. The actual log arrival rate may also be lower due to something as simple as running the rewinder line slower for a process reason without adjusting the extractor timing and motions. Regardless of the cause, it is typical that the mandrel extractor will have a variable duration dwell where it waits for the last log in a set to arrive. In previous practice, this time was wasted because it increased the duration of the mandrel puller dwell at its intermediate stop position on the return path. By contrast, in the present disclosure, the duration of the mandrel puller dwell at its mandrel extracted and released position is increased, which is more helpful, as explained above.

Mandrel Extraction System

Figure 18:
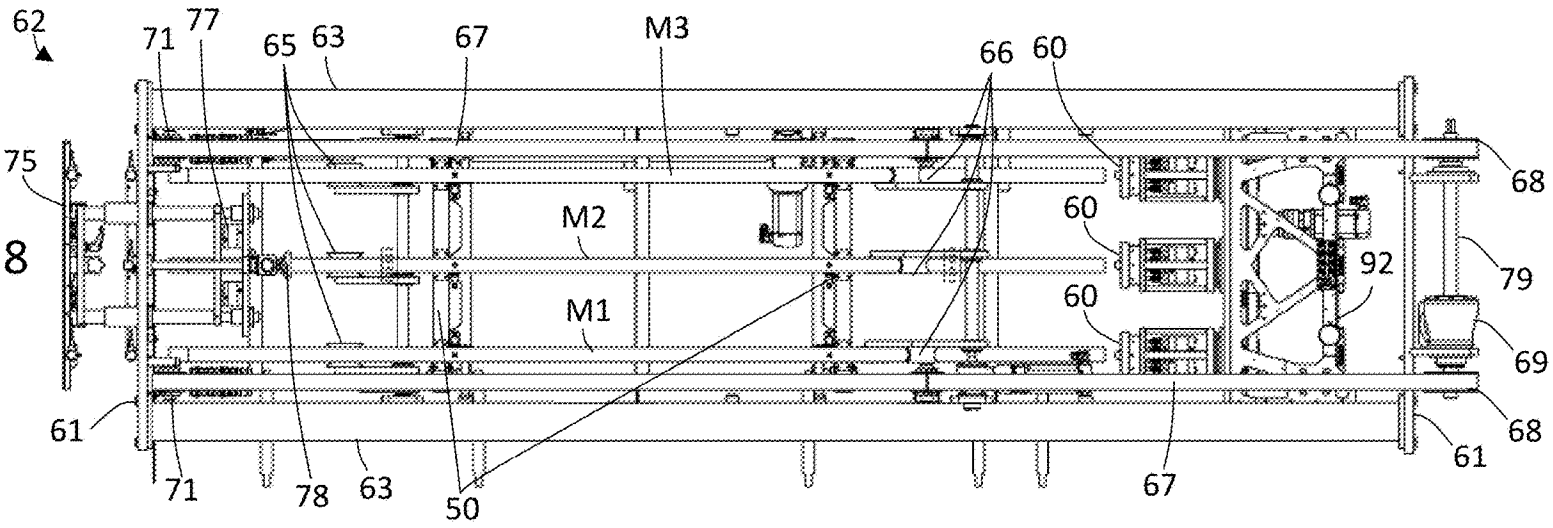
FIG. 18 is a plan view of a mandrel puller assembly with the mandrel extractor of FIG. 14.
Figure 19:
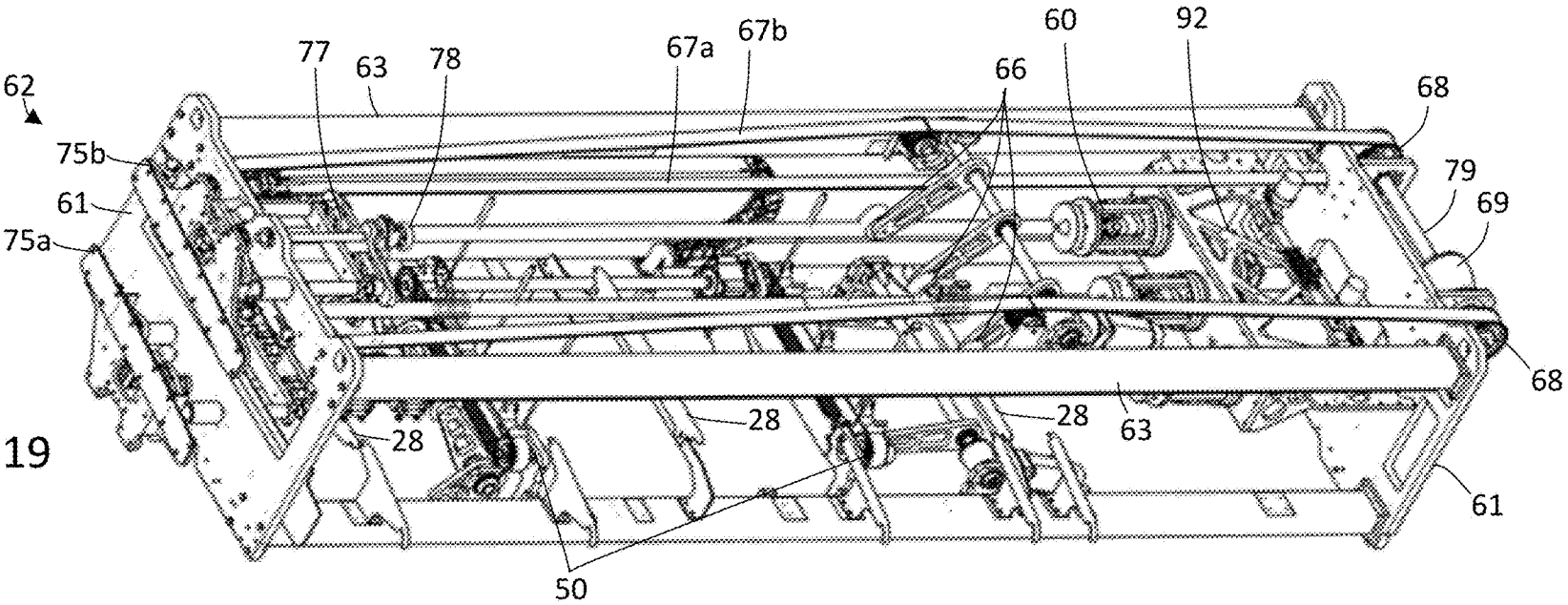
FIG. 19 is perspective view of the mandrel puller assembly of FIG. 18.
Figure 20:
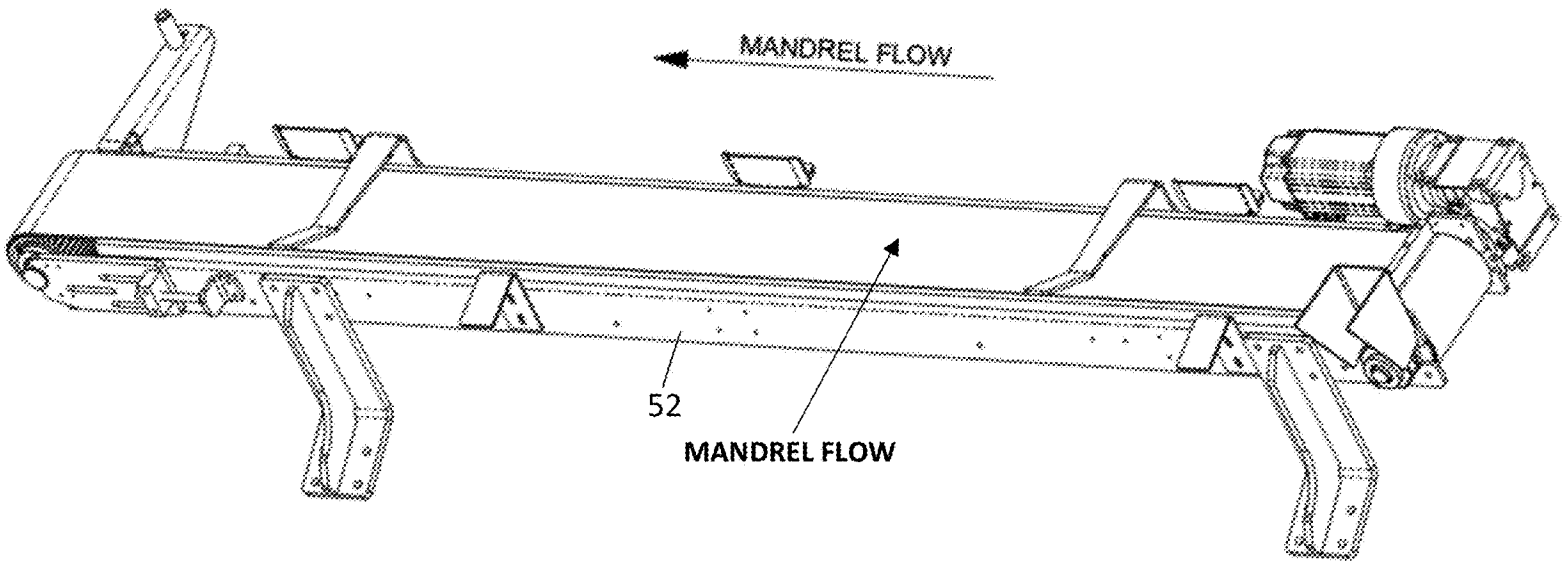
FIG. 20 is a perspective view of a mandrel return alignment conveyor.

FIGS. 14-19 show a portion of the mandrel extractor 44 that withdraws the mandrels from the logs. FIGS. 18-19 show the mandrel puller module 62. The mandrel puller module 62 is typically mounted on vertical guides and supported by a lifting system (not shown), so that its height may be adjusted to bring the heights of the puller clasps into vertical alignment with the mandrel centers in the logs. Thus the height of the puller module 62 may be adjusted with the lifting system for log diameter changes—to a higher elevation for larger diameter logs and to a lower elevation for smaller diameter logs. The lifting system may be linear screw actuators, a slider-crank device, rack and pinion system, or any other suitable device. In FIGS. 18-19 the motion direction of the puller carriage 92 is from left to right when moving away from the logs. Thus its motion direction is from left to right when extracting mandrels from the logs, moving from a mandrel engagement position nearer the logs to a position farther from the logs where it stops after the mandrels are extracted. And its motion direction is from right to left when moving from a stopped position following mandrel extraction back to the mandrel engagement position, nearer the logs. The motion of the puller carriage 92 and thus also the clasps 60 is reciprocating in nature, moving toward the logs to reach a position where the mandrels may be engaged and moving away from the logs to extract the mandrels and reach a position where the mandrels are released from the clasps. FIGS. 18-19 show the mandrel puller carriage 92 at a stopped position following mandrel extraction, spaced apart from the mandrels M1,M2,M3 which are released from the clasps 60. The mandrel M1 is shown extracted from the log at the first extraction station, the mandrel M2 is shown extracted from the log at the second (center) extraction station, and the mandrel M3 is shown extracted from the log at the third extraction station.

The puller module 62 may be comprised of plate frames 61 which are spaced apart and connected by elongated beams 63. The puller carriage 92 may be supported and guided by linear rails or tracks which are oriented parallel to the axis of the logs. These linear rails or tracks may be mounted to the underside of the upper elongated beams 63. The puller carriage may be movably secured with one degree of freedom to the linear rails by bushings or bearings affixed to the puller carriage framework. Due to the frequent and high speed translation of the puller carriage along the support rails, the bushings or bearings may be provided with lubrication, such as grease or oil. Additionally, they may be provided with an on-board automatic relubrication system so they are relubricated frequently to prolong their life. The puller carriage 92 must travel at high velocities and be located with precision, so it is preferable that the drive system used to move it along its path is lightweight and stiff. The puller carriage 92 is preferably driven along its path by one or more timing belts 67. Other flexible transmission devices, such as roller chain or cables are not ruled out. The timing belts may wrap around and be supported by idler pulleys 71 which may be located at the end of the mandrel puller module that is closer to the logs. The timing belts may wrap around drive pulleys 68 which may be located at the end of the mandrel puller module that is farther from the logs. The drive pulleys 68 may be mounted on a common drive shaft 79 and share a common drive motor and gearbox 69 that may be mounted to the puller module frame 61. This does rule out using a single timing belt, if sufficient for the needs, or more than two timing belts, if preferred or necessary. The lower spans 67*a* of the timing belts 67 are attached to the puller carriage 92. The upper spans 67*b* of the timing belts complete the loop of the belts so that the puller carriage 92 can be driven left or right by the drive train actuator 69. The drive train actuator 69 may include a gearbox and preferably an electric servo motor. In the alternative, the drive train for the puller carriage may be a rack and pinion system (not shown) wherein a gear-tooth rack is provided along a support beam 63 and a gear-tooth pinion with motor is provided on the puller carriage.

Plates 75*a*,75*b* for restraining the log end faces may be provided with mounting from the frame 61 of the mandrel puller module. The plates may be mounted from a different frame, but preferably they are mounted from the frame of the puller module so that they are raised and lowered with the puller module for log diameter changes and thus do not require a separate height adjustment for log diameter changes. Plate 75*a* is arranged below the path of the mandrels. Plate 75*b* is arranged above the path of the mandrels. The height of each may be adjusted independently to accommodate various diameter mandrels. The lower plate 75*a* may be moved downward and the upper plate 75*b* moved upward to increase the gap between them to accommodate larger diameter mandrels. The lower plate 75*a* may be moved upward and the upper plate 75*b* moved downward to decrease the gap between them to accommodate smaller diameter mandrels. The gap between them may be made very large to accommodate the passage of logs between them when running in bypass mode. The gap between them may extend from the log infeed end to the log outfeed end so that the logs with protruding mandrels to be extracted may pass in to the mandrel extraction stations, and any protruding mandrels that are not withdrawn can pass out from the mandrel extraction stations to the downstream region where they may be culled by the log cull system 45,49. The cross-direction position of the log face restraint plates 75 may be adjusted, for instance to set them at the correct position for a given log length, or move them to a different position for a different log length. They may be supported by, and slide on, linear guides such as rails or shafts. Their positions in the cross-direction may be adjusted in the cross-direction by a threaded screw using a hand wheel 78 or motorized actuator. The actual cross-direction position of the log face restraint plates is preferably provided to the PLC from a feedback device so the PLC can ensure the mandrel puller carriage does not travel too far and cause an interference between a puller clasp and the face restraint. In the present disclosure, logs may be shifted in the cross-direction by a log alignment conveyor before they are carried to their mandrel extraction positions by the main log conveyor. Thus, they need not be shifted in the cross-direction to the log face restraint plates 75 after arriving at their mandrel extraction positions. If the log face restraint plates are stationary during operation of the extractor, the upstream ends of the plates may be provided with chamfers and/or radii to reduce the chance of the log ends catching on the upstream edges of the plates as the logs are conveyed into the extraction stations. More preferably, however, the face restraints are reciprocated linearly in the cross-direction, so there is clearance between the plates and the log ends as the logs are conveyed into the extraction stations. Actuators 77, preferably pneumatic cylinders, may be provided to effect this reciprocation. In the exemplary embodiment the actuators 77 hold the face restraint plates away from the log ends as the logs are conveyed toward their mandrel extraction positions. As, or after, the logs arrive at their mandrel extraction positions on the main log conveyor, the actuators may move the restraint plates toward the log ends. However, it is preferable, if time in the cycle permits, to have the actuators 77 move the face restraint plates 75 into contact with the log ends after the logs have been restrained at their periphery, to ensure the logs are not shifted axially in the extractor. The reciprocating log face restraint plates have the further advantage of optionally applying axial compression to the logs. This may be accomplished by adjusting the position of the face restraint plates 75 or by adjusting the relative position of the log stop plate 86 at the CD alignment conveyor. A small amount of axial compression or preload on the logs may be beneficial to ensure the logs are stable and stationary during the mandrel extraction.

FIGS. 18-19 also show possible embodiments for the mandrel end supports 65 and the mandrel drag guides 66. In this embodiment the mandrel end supports are disposed at the end of arms arrayed on a pivoting shaft. The pivoting shaft is below the space where the mandrels are withdrawn from the logs. Rotation of the shaft is effected by an actuator, which may be an electric servo motor, but is more preferably a pneumatic cylinder for cost reasons. The mandrel end supports may be pivoted upward and downward, in oscillating fashion, by rotating the shaft back and forth. As the mandrels are withdrawn from the logs, the mandrel end supports may be pivoted upward so they support the ends of the mandrels that are closer to the logs when the ends of the mandrels emerge from the logs. In this embodiment the mandrel drag guides are also disposed at the end of arms arrayed on pivoting shafts. The pivoting shaft for the lower drag guides is below the space where the mandrels are withdrawn from the logs. The pivoting shaft for the upper drag guides is above the space where the mandrels are withdrawn from the logs. Rotation of each shaft is effected by an actuator, which is preferably an electric servo motor, for reasons of speed and precision. The mandrel drag guides may be pivoted upward and downward, in oscillating fashion, by rotating the shafts back and forth. After the mandrels are withdrawn from the logs, the upper drag guides may be pivoted downward and the lower drag guides may be pivoted upward to pinch and press the mandrels between them, causing the mandrels to cease translating in the cross-direction after the mandrels have been unclamped by the clasps. The mandrel puller carriage may move the clasps a little farther from the restrained mandrels so that the ends of the mandrels emerge from the clasps. Then the mandrel end supports 65 and the lower drag guides may be pivoted downward to lower the mandrels onto the mandrel return conveyor 50. As the mandrels are lowered, the upper drag guides may be pivoted upward to move them out of the way so the mandrel puller carriage can execute is return motion when it is time to extract mandrels from the next set of logs.

Motion Optimization

A machine such as a mandrel extractor may be programmed to execute its sequence of operations step-wise according to positive signals from mandrel and log detectors. That is, it may wait to perform the next action until a signal is received from a detector indicating the previous action was completed. It is fairly simple. However, it is not efficient for processes with numerous actions and elements, because the time interrogating and responding to the sensors for the numerous steps adds up to significant wasted time. Thus, the maximum rate in practice may be significantly less than the theoretical rate of the process. An alternative, which may be used with this mandrel extractor, is to coordinate the sequence of operations according to a virtual time signal. That is, the actions are performed in accordance with a pre-planned timeline which does not wait for signals from sensors or detectors. This method is more efficient for operation at high cycle rates because time is not wasted interrogating and responding to sensors for the numerous steps. Instead, the sensors are interrogated concurrent with execution of the timeline to verify things are performing according to the timeline. If a step in the process lags too far behind, or a log or a mandrel is out of position, a fault is returned and the machine may be stopped automatically by the PLC if a corrective action by the PLC while running is not feasible. Because the extractor actions are executed without incurring cumulative wasted time for detector interrogation and responses by the PLC, the maximum rate in practice is closer to the theoretical rate of the process, preferably even matching the theoretical rate of the process.

In addition, using a virtual time signal to coordinate the sequence of operations in a machine such as a mandrel extractor facilitates scaling of the rate limit. The rate limit is the maximum log rate the extractor can process. At higher rate limits the sequence of operations must occur in less time. At lower rate limits the sequence of operations may take place over greater time. If the extractor rate limit is high, for instance 30 LPM, even when the rewinder line is producing logs at a relatively low rate, for instance 18 LPM, perhaps due to winding speed or laminating speed limitations, the extractor will execute its motions more rapidly than necessary and then be idle as it waits for the next set of logs to arrive. Instead, if the rewinder line will produce logs at 18 LPM, the extractor should preferably be tuned to operate at, for instance, a value such as 20 LPM. At this rate limit the log conveyors, mandrel conveyors, and mandrel puller may operate with lower velocity and acceleration values, experience less rapid wear and tear as a result, and the extractor may tend to have fewer problems from logs and mandrels being mishandled at the lower speeds and relaxed timeline. If the rewinder line will produce logs at 27 LPM, then the extractor may preferably be tuned to operate at, for instance, 30 LPM. Under this condition the log conveyors, mandrel conveyors, and mandrel puller will operate with higher velocity and acceleration values because it is necessary, which is appropriate. Due to the quantity of conveyors and actuators and complexity of the timeline, as well as a preference to reduce the training and knowledge burden required, it is preferred to have the PLC perform the rate scaling rather than have operators or technicians attempt to do it. Thus the operator may simply enter a requested rate limit value on the HMI, or the rate limit from the rewinder may be used, and based on this value the PLC may automatically adjust the timeline sequence and conveyor motions so the extractor is tuned to operate at that rate.

Mandrel Return System

Figure 21:
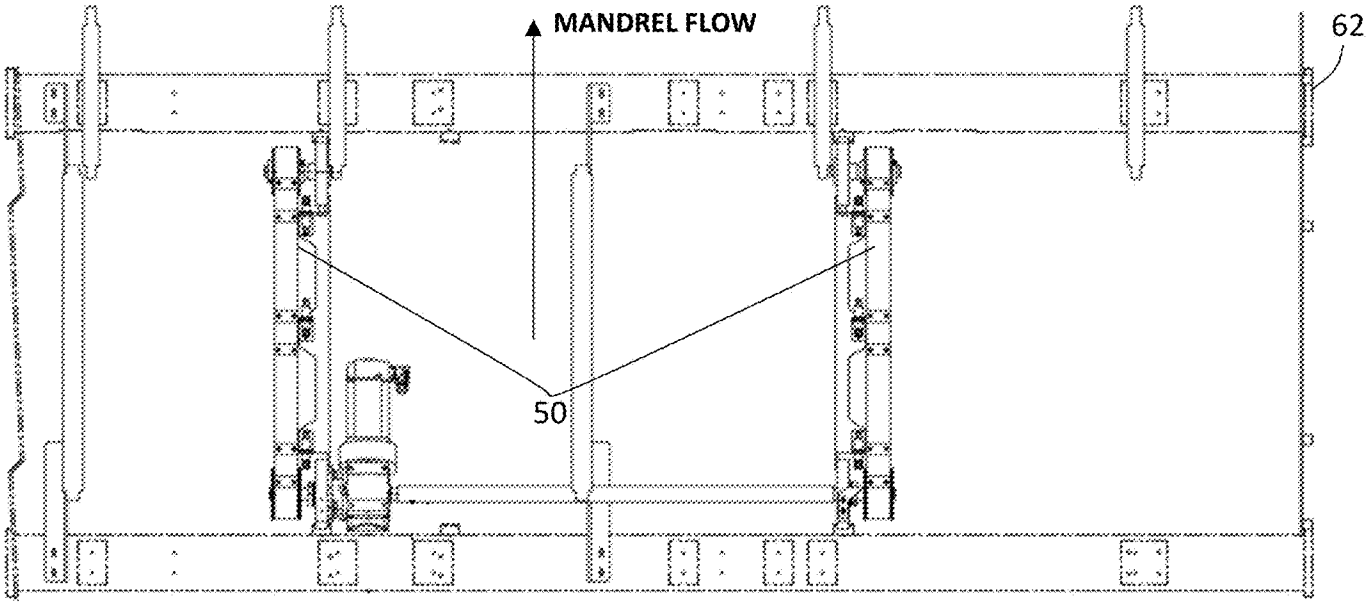
FIG. 21 is a top view of a mandrel return conveyor.
Figure 22:
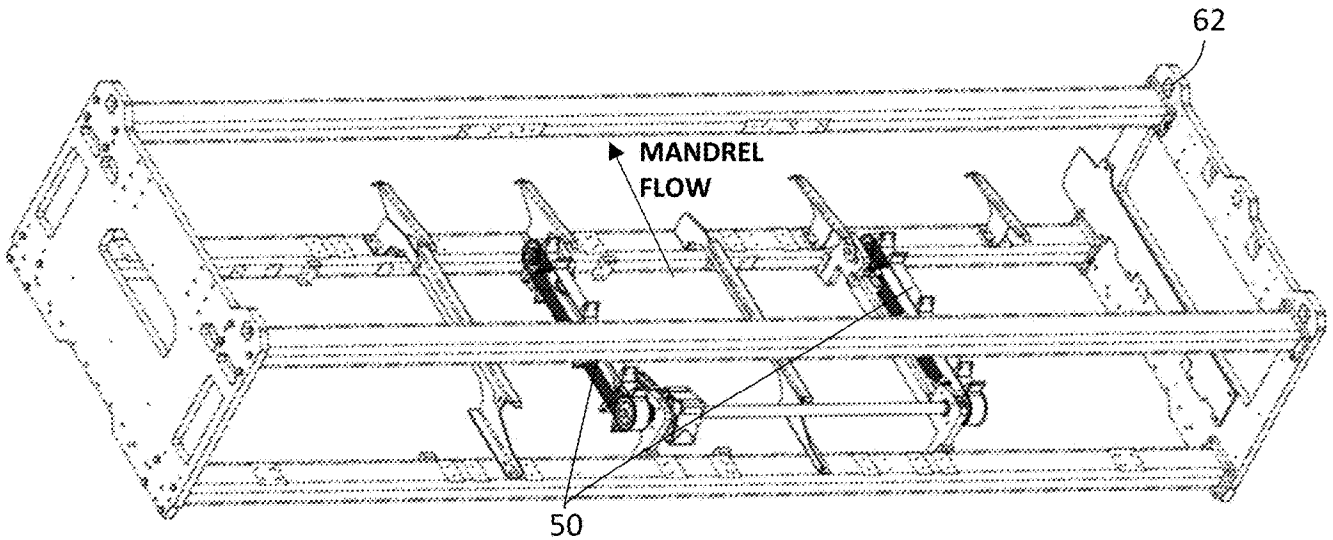
FIG. 22 is a perspective view of the mandrel return conveyor of FIG. 21.
Figure 23:
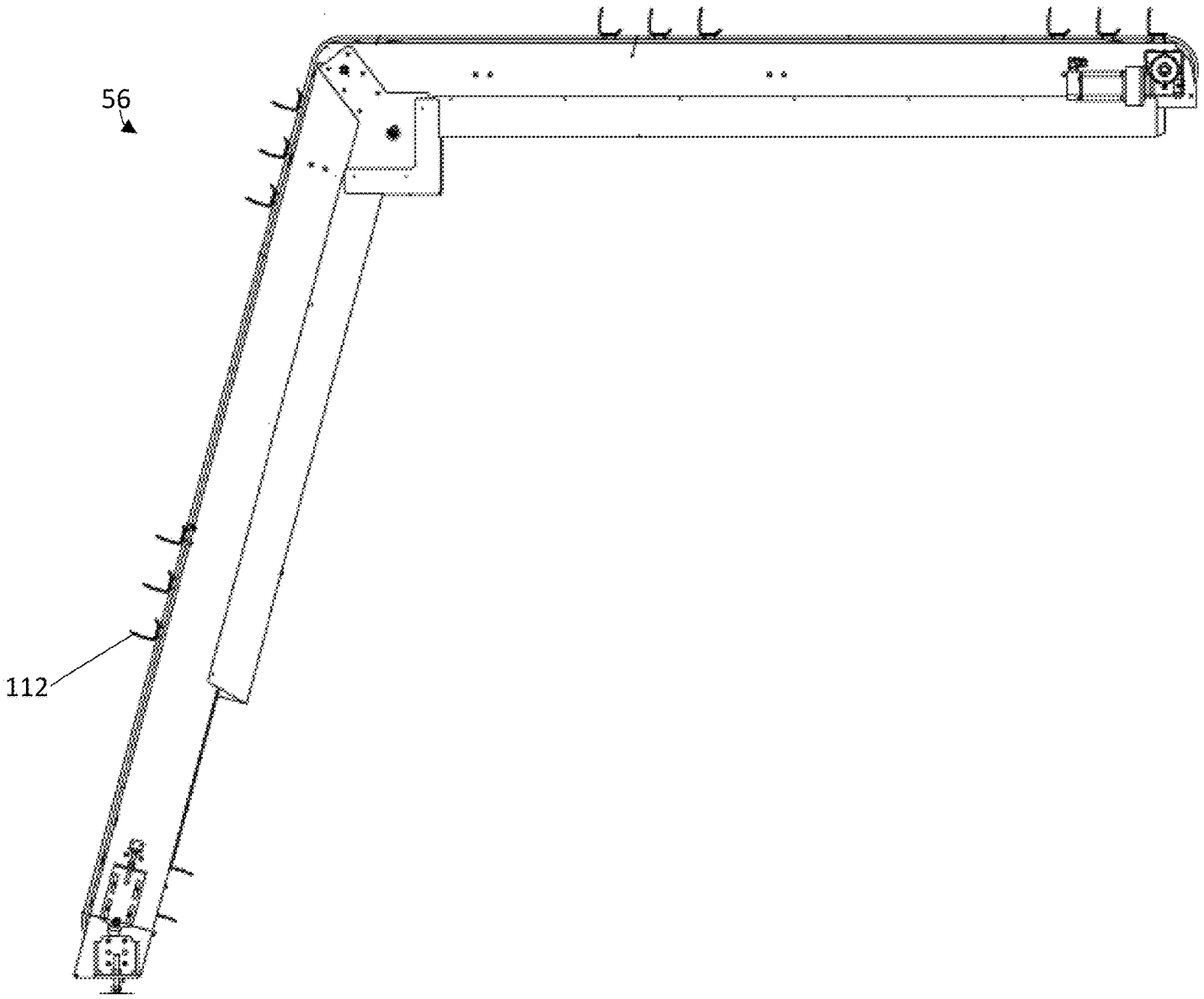
FIG. 23 is a side elevation view of a mandrel return elevator.

As noted above, after the mandrels have been removed from the logs, the mandrels may be returned to the rewinder to be reused. FIGS. 18-24 show a mandrel return system associated with the mandrel extractor 44. FIGS. 21-22 show a mandrel return conveyor 50 onto which the mandrels are dropped or lowered after they are extracted from the logs. The mandrel return conveyor 50 may comprise two or more flighted belts, with the flight spacing approximately matching the spacing between the clasps of the mandrel puller so that the mandrels can be lowered directly into the flights. Fixed guides and supports 28 may be provided as well to add support for the mandrels and guide the mandrels as they travel on the conveyor. In the example of a mandrel extractor with three pullers, after three mandrels have been lowered into the flights of the return conveyor 50, the conveyor may triple-index to deliver the mandrels onto a mandrel alignment conveyor 52 (FIG. 20) for alignment with the return elevator 56 (FIG. 23). A mandrel alignment conveyor 52 may be provided when the mandrel storage hopper/magazine 58 is located in a different cross-direction location than the mandrel return conveyor 50 of the extractor. The mandrel alignment conveyor 52 may comprise an endless flat belt with two flights. When all of the mandrels in a group (three mandrels in this example) have been delivered to the mandrel alignment conveyor 52, the mandrel alignment conveyor may transport the mandrels in the cross-direction until they are aligned with the mandrel return elevator 56. The mandrel alignment conveyor 52 may be canted at an angle so that the mandrels roll onto it from the return conveyor 50, and then off of it down the elevator infeed table 54 (FIG. 24) toward the return elevator 56, expeditiously. The mandrel alignment conveyor 52 and elevator infeed table 54 may be provided with a gate 55 (FIG. 24) that keeps the mandrels from rolling off the conveyor or down the inclined table toward the return elevator, until their cross-direction alignment is completed and the mandrel return elevator 56 is ready to receive them.

When the mandrels are aligned in position and the return elevator 56 is ready to receive them, the gate 55 may open to allow the mandrels to roll down an inclined infeed table 54 to the mandrel return elevator. The gate may provide time for a prior set of mandrels to be lifted off the table by the return elevator 56 as the next set of mandrels is shifted over by the alignment conveyor 52, thus allowing for a higher maximum cycle rate. The infeed table 54 may be provided with openings for mandrel carriers on the mandrel return elevator 56 to pass through. The mandrel return elevator 56 may be provided with major and minor flight distances between the carriers 112, with carriers in the minor flights (groups of three in this example) spaced a short distance apart, and these groups (of three in this example) spaced farther apart at the major flight distance. Configuring the mandrel return elevator 56 this way, as opposed to well-known core elevators with uniform flights spaced by the minor flight distance all along the conveyor, has the benefits of reducing the number of mandrels required for operation and of limiting the time the mandrels spend with partial support on the elevator, thereby tending to reduce development of mandrel sag.

Mandrels may stretch during mandrel extraction. If mandrel extraction forces are high relative to the elastic modulus of the mandrel, either because the logs are tightly wound, or because the mandrels are very slender, or both, mandrels may stretch a relatively large amount. Mandrels may elongate within the log as the log is wound. If the interlayer pressure between the web wraps is high due to tight winding, or the mandrels are slender, or both, the mandrels may be elongated a relatively large amount. A mandrel that remains elongated following extraction tends to contract toward its original length if given time to rest. The mandrel may elongate permanently if it is reused before it has returned close enough to its original length. In situations where mandrels have a relatively large amount of residual elongation following extraction, a mandrel circulation conveyor may be provided. The mandrel circulation conveyor may be positioned between the mandrel return elevator 56 and the mandrel storage hopper/magazine 58. A mandrel circulation conveyor provides additional time for the mandrels to rest and contract in length before being reused in the rewinder. The size of the mandrel circulation conveyor and recommended quantity of mandrels in circulation can be determined from the cycle rate at which the logs are produced and the time required for a mandrel to return to its original length or close enough to its original length. Due to the extended time mandrels take to pass through the circulation conveyor, the mandrels should be well supported so as to not develop sag. A mandrel circulation conveyor may be advantageous in, as a non-limiting example, a rewinder line producing industrial type bath tissue rolls wound to a relatively high degree of tightness on a relatively small diameter mandrel (for example, less than 25 mm diameter). The length of each mandrel may be measured to confirm it has returned close enough to its original length before being reused in the rewinder and ejected from recirculation if it is too long. Preferably this measurement is performed by the machine automatically. The measurement may be performed by a camera vision system or other optical sensor. In especially demanding cases of very tightly wound products on small diameter slender mandrels, the mandrels may not return fully to their original length in the circulation conveyor, but instead increase in length by a small amount with each cycle. This may be economical if the increase in length with each use is small enough so an adequate cycle life of the mandrel is obtained relative to its replacement cost. In this case also the additional rest time afforded by the circulation conveyor may be used to extend the usable cycle life of the mandrels. An alternative embodiment of the concept is to add more flights, along with more mandrel supports in the cross-direction, to a mandrel return elevator, and increase its length to increase its capacity of mandrels, thereby increasing the rest time of the mandrels during their return circulation.

Alternative Path Extractor

Figure 7:
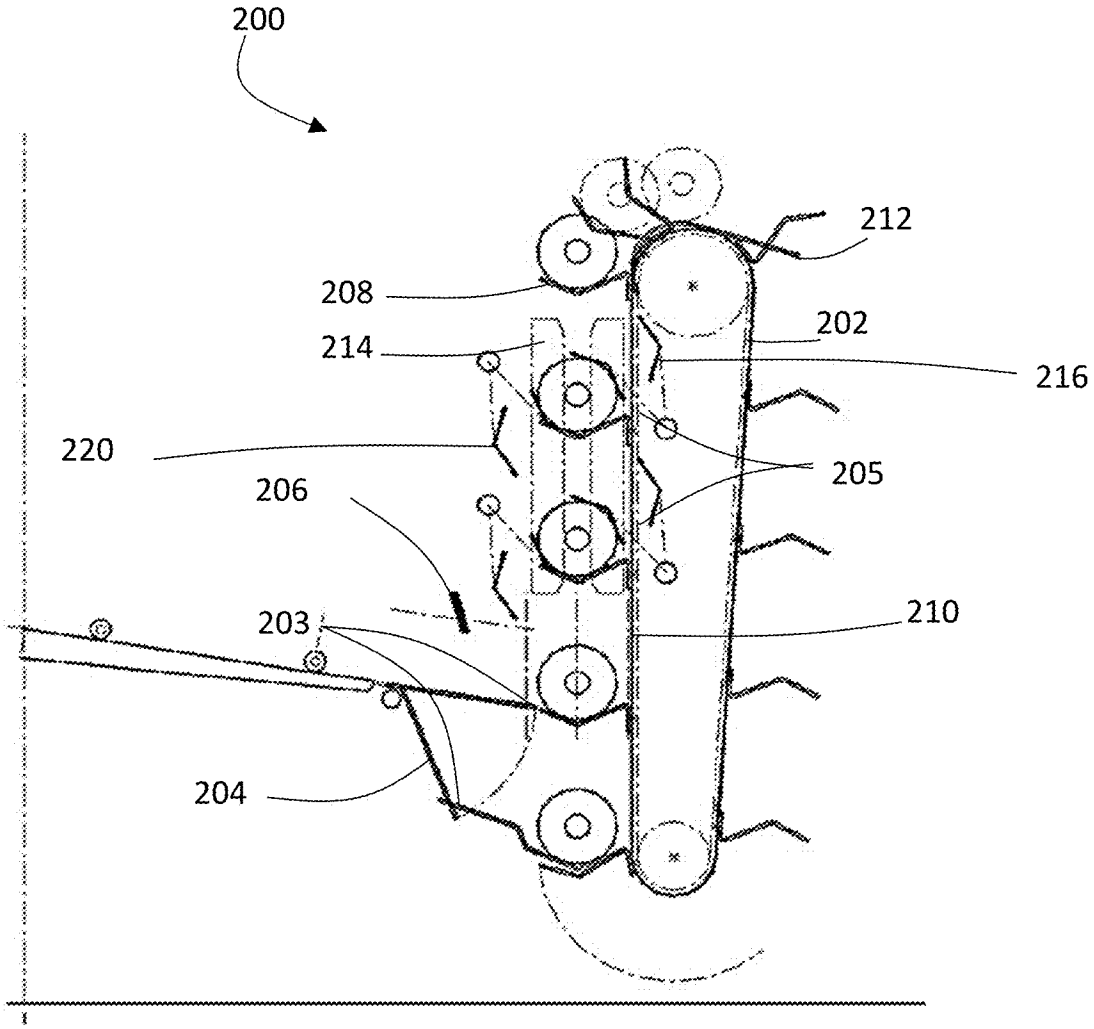
FIG. 7 is an alternate embodiment of a vertically oriented 2-puller mandrel extractor.

FIG. 7 shows an alternate embodiment for a 2-station mandrel extractor 200 (with two puller clasps) that has a vertical path for the main log conveyor 202. It would have a lower maximum cycle rate than the 3-station and 4-station extractors discussed above, but should cost far less to construct. The logs are split into two paths prior to the pickup point at the infeed, by a simple and inexpensive pivoting gate 204, which obviates the need for the log lift conveyor, lower infeed belts, upper infeed belts, and a positioning mechanism to adjust the height of the upper infeed belts structure in the embodiments described above. It may use a brush 206 to decelerate the logs, instead of the infeed roller and accompanying positioning mechanism to adjust the height of the infeed roller structure. The embodiment shown in FIG. 7 allows the elimination of 3 conveying systems and corresponding servo motors, and a roller.

The main log conveyor 202 includes a flighted belt with log carriers 208. The main log conveyor 202 may include four timing belts which may have a 14 mm pitch and 85 mm width. The log carriers 208 may be attached directly to the timing belts such that the belts may operate with only a guide 210 behind the belt 202 for stability of the belt and carriers. The distance from the lower timing pulley to the upper timing pulley may be set to control the length of the span (for instance, 1 m (39.41")), which is favorable for controlling the belt deflection. The relatively large pitch and width timing belts may be set to substantially high tension in this span also to control deflection of the belt due to a tendency of the carriers to tip under the weight of the logs. The belts may be configured to support the weight of three logs in the middle portion of this span. If found to be necessary, the carriers may be supported additionally with guides in tracks parallel to the belt path. The pitch distance of the carriers may depend upon the product format. For typical consumer bathroom tissue and kitchen towel products, the pitch distance may be 252 mm (9.92"). Extraction takes place on sets of two logs. The main log conveyor 202 remains stationary for loading two logs, and then executes a double index to bring the two logs from the infeed positions 203 to the extraction positions 205. During the double index the main log conveyor also discharges two logs (with mandrels removed) at an outfeed 212, and makes space for two logs to load at the infeed. When a log arrives at the main log conveyor 202, the first log loaded rolls to the upper position, with the infeed gate 204 closed (raised). Then the infeed gate 204 opens (pivots down), for instance, by a pneumatic cylinder, and the second log loaded rolls to the lower position. The log carrier at the lower position may be recessed slightly below log supports, so the bouncing log does not hit the carrier causing stress to the carrier mounting and possibly disturbing other logs on the conveyor. This precaution may be taken because the second log, moving to the lower position, falls farther and thus may have greater kinetic energy when it loads. So that the lower log can pass upward during the double index, the upper log load position may not have log supports, but rather the log may roll directly onto the log carriers 208. The brush 206 may be configured to decelerate the logs as they roll to the upper load position and thereby reduce their kinetic energy when they contact the carrier and belt of the main log conveyor 202. A vertical guide 210 behind the belt of the main log conveyor 202 may be provided to keep the log carrier 208 from moving excessively when a log is loaded onto the carrier and bumps into the belt 202. If found to be necessary, log supports (not shown) may be provided at the upper log load position to temporarily take the log weight, so the carrier is not disturbed excessively during log loading, and which are then pivoted out of the way, for instance by a pneumatic cylinder, at the same time the gate 204 is pivoted downward for arrival of the second log.

The tip of the infeed gate 204 may extend into the path of the logs. Therefore, after the infeed gate 204 has pivoted down for the log to load at the lower position, the infeed gate may stay in the lowered position (pivoted down) until the main log conveyor has executed approximately one-half of its double index motion. Then, the infeed gate may be pivoted back up for the next log to arrive as the lower log clears the load position for the upper log.

As explained above, the brush 206 may be configured to allow for deceleration of the log rolling to the upper log load position. The brush 206 may be located so it also operates on the log going to the lower load position. It may be configured to allow for deceleration of the logs rolling to both the upper and lower load positions if it is located farther upstream, nearer and for instance generally above the pivot of the infeed gate 204. Or, if it is located farther downstream, generally above the gate opening, it may serve as a deflector to direct the log downward toward the lower log load position. Potentially, more than one brush may be used, with a brush at each location. The brush may be mounted to the same carriage framework as the upstream (anterior) peripheral restraints 220, which is moveable on substantially vertical linear slides to be adjusted for log diameter changes.

When the main log conveyor 202 executes the double index movement, the main log conveyor moves the two logs from the log load positions 203 to the mandrel extraction positions, or stations, 205 just above. After the logs arrive at the mandrel extraction stations, the logs may be aligned in the cross-direction by actuators, such as pneumatic cylinders, that are configured to push the logs from the far side against axial face restraint plates 214 at the near side of the machine. Alignment of the logs in the cross-direction may be performed during indexing of the main log conveyor if, for instance, higher cycle rate log handling is desired. Because the log path is vertical, the axial face restraint plates 214 do not have to be reset or moved for log diameter changes, but only for mandrel diameter changes. Preferably, the axial face restraint plates do not have to be adjusted in the vertical direction. Preferably, the axial face restraint plates require only two adjustments: horizontal in the machine direction for mandrel diameter changes and horizontal in the cross-direction for web width (log length) changes. These adjustments may be done with actuators, but for cost considerations may be done as manual adjustments.

After the logs have be aligned in the cross-direction, peripheral restraints 216,220 may be moved to engage the logs. The peripheral restraints may comprise three anterior troughs 220 and three posterior troughs 216 per log. The three anterior troughs 216 and three posterior troughs 220 may be nested between the four main log conveyor timing belts. The troughs 216,220 may be configured for a pivoting motion between engagement and disengagement positions with the log. The troughs 216,220 may be configured with low moments of inertia, so the pivoting motion can be effected with small servo motors and gearboxes. Servo motors may be used to provide quick and precise pivoting motion between engagement and disengagement positions with the log. The peripheral restraint system may be configured such that the anterior restraints 220 share a common servo motor and the posterior restraints 216 share a common servo motor. A drive train, for instance a 4-bar linkage, or possibly a timing belt or similar, may be used to couple the pivot shafts of the respective restraints so they move in unison, with one actuator. Preferably, the posterior restraints 216 do not require linear slides for adjustment. The pivoting motion of the posterior restraints 216, for instance, by choosing the shaft location for the posterior restraints judiciously, may be sufficient to accommodate log diameter changes in addition to performing the engagement and disengagement motion. Preferably, the anterior restraints 220 may include substantially vertical linear slides for adjustment of the height of their pivots when changing log diameter. The anterior restraints 220 may be provided with an adjustable carriage at the infeed side to support the anterior peripheral restraints system. Motion of the carriage along the linear slides may be effected with the use of linear actuators by motor, or manually. The brush 206 may be mounted to this same carriage as the anterior restraints 220. A gross position height adjustment of the brush may be effected by movement of the carriage: lower for smaller diameter logs, higher for larger diameter logs. The brush 206 may include a fine adjustment relative to the carriage.

The belts of the main log conveyor 202 may include log carriers 208 that are configured with a general bow tie shape, instead of the carriers with a general chevron shape as shown in FIG. 7. The bow tie shape configuration may allow the logs to transition from riding on the tops of the carriers when going up the main log conveyor, at the infeed side, to riding on the bottoms of the carriers when going down the main log conveyor, at the outfeed side. In FIG. 7 the infeed side, where logs arrive, is to the left, and the outfeed side, where logs depart, is to the right. Or, the belts of the main log conveyor 202 may include log carriers 208 that are configured with a general C shape, instead of the carriers with a general chevron shape as shown in FIG. 7. The opening of the C shape carriers may face leftward when at the infeed side, to receive logs, and face rightward when at the outfeed side, to discharge logs. The C shape configuration may allow the logs to transition from riding in the trailing portion of the carriers when going up the main log conveyor, at the infeed side, to riding in the leading portion of the carriers when going down the main log conveyor, at the outfeed side.

An outfeed table 212, as shown in FIG. 7, may be provided to unload and receive logs from the main log conveyor. A roll down table may be used to deliver the logs from this point to the next processing module in the converting line, typically a log accumulator. The log accumulator may be configured to receive the logs at this higher elevation so the logs do not have to be lowered to the typical log accumulator infeed height. To deliver logs at the typical log accumulator infeed height, the logs may be lowered from this discharge height to a relatively lower height, for instance, by a conveying system (not shown).

Alternatively, if bow tie shape carriers or C-shape carriers are used on the main log conveyor, the main log conveyor may be used to convey the logs to a relatively lower height for delivery to a log accumulator or a log cull system. In this case the outfeed table 212 near the top of the main log conveyor (FIG. 7) would be omitted. The logs may transfer from the top sides of the bow tie shape carriers to the undersides of the bow tie shape carriers ahead of them as they pass over the upper timing pulley, and then ride down the right side of the main log conveyor on the bow tie shape carriers to a height nearer the floor before being unloaded. The logs may migrate from the trailing portion of the C shape carriers to the leading portion of the C shape carriers as they pass over the upper timing pulley, and then ride down the right side of the main log conveyor in the C shape carriers to a height nearer the floor before being unloaded. Additional timing pulleys may be provided within the main log conveyor belts to extend their loop length and allow the logs to be unloaded at a preferred height. Because the main log conveyor executes a double index, it would discharge two logs in rapid succession, except for the following method which may be used to cause the logs to discharge from the main log conveyor at a substantially uniform interval. In this method a log unloading portion of roll down table may be arranged at a good height for logs to roll to the next module, for instance a log cull system and/or accumulator infeed. It may be actuated up and down by a pneumatic cylinder or other suitable actuator. The system may be arranged so that when the main log conveyor is at its dwell position, the carrier with the first log to be unloaded is just above this portion of table, with the table in its down position. While the main log conveyor is stationary, this portion of table may be actuated upward to lift and unload the log from the carrier. The unloaded log may then roll down a fixed portion of inclined table to the next module. Then, when the main log conveyor executes is double index, the log in the next carrier (above the first one) would unload as its carrier on the main log conveyor passes through the unloading portion of the roll down table. The moveable portion of the table may then be actuated to its lowered position before the double index is complete, so the next arriving log is not unloaded. This log will not be unloaded until the moveable portion of the table is actuated upward, as described above. Thus this system may be configured to unload logs at a substantially uniform interval, at the cycle rate of the rewinder, because it can unload every other log (odd logs) when the main log conveyor is stationary, and the other logs (even logs) during the main log conveyor double index movement. Furthermore, any single log may be culled following the extractor, without having to slow down the converting line, because the instantaneous log delivery rate would substantially match the average log rate. This method obviates the need for the outfeed belts and a positioning mechanism to adjust the height of the outfeed belts structure in the embodiments described above.

After the logs are unloaded they may roll down an inclined table and can be culled by a gate integrated in the table at the infeed to the accumulator 48, or pass into the accumulator, as with the embodiments described above. The cull system may or may not be integrated with the accumulator infeed so it can be more generic.

Because the dwell heights of the carriers 208 on the main log conveyor 202 do not change with log diameter changes, the height of the log centers at the extraction stations 205 will vary with log diameter. Therefore, the height of the mandrel puller clasps in the mandrel extractor has to be adjusted to compensate for changes in log diameter (as it was for the embodiments described above). This may be done by mounting the puller in a framework moveable along vertical linear slides and adjusting its height with linear actuators, or other mechanisms, by a motor, or manually with a hand wheel.

The clasps of the mandrel extractor may be configured as shown in FIG. 17A-17C. The drag guides and mandrel end supports described previously may be supported in a way that does not prevent using a single carriage and motor for moving the carriage and the two clasps. The drag guides and mandrel end supports may be configured to reliably restrain the mandrels, facilitate clearing the mandrels from the path of the returning pullers, and facilitate clearing themselves from the path of the returning pullers. The mandrel return may include mandrel return guides utilizing gravity, which obviates the need for the mandrel return conveyor described previously.

A mandrel alignment system may be configured to shift the mandrels over in the cross-direction for the return trip to the storage magazine or mandrel hopper. This may be done with a rod-less pneumatic cylinder pushing the mandrels on a stationary table surface. The pusher would extend rapidly to move the mandrels and then can retract while mandrels are still on the table, before the mandrel return elevator has finished picking up the mandrels. The mandrel return elevator may be configured to pick the mandrels up directly from the table of the mandrel alignment system.

Production System Optimization

The pressures to increase the production speed and cycle rate for coreless rolls (as well as rolls with cores) intertwine with evolving demand for automated machine control and optimization of production speeds and efficiency. The characteristics of products described above, although not limited to these, present an excellent opportunity to optimize efficiency given (well-known in the industry) web property variations relative to the production speeds they support. Because winding technologies that provide significant control of the log from the outer periphery are subject to the dynamic behavior of the log interior as a lumped system, at different speeds and different portions of the wind cycle, the logs can become unstable and vibrate excessively within the winding surfaces. It is also well known that log instability and vibration tend to increase with winding speed. A result is that higher winding speeds tend to cause undesirable characteristics such as displacement of the winding mandrel or core, leading to non-concentricity in the finished product, reduced emboss definition, and decrease in roll radial firmness. It is also associated with process issues, such as increased occurrence of web breaks, failure to correctly discharge logs, perforation damage, and many other undesirable effects.

A technique to reduce the incidence of log instability is to automatically adjust the line speed based on a measured magnitude of the log instability or vibration. This method may also be used to control the severity of the instability. The magnitude of the instability or vibration may be reduced, minimized, or eliminated; or it may be optimized, according to the preference of the converter. There may be times minor instability causes no defects. There may be times operating at higher winding speed is deemed worth some level of imperfection in the product and this method of active monitoring can be used to maintain the desired result as material properties or other conditions change. It is known that the log makes noise and vibrates when it is unstable. Thus it is possible to measure the instability or vibrations with methods such as capturing audio from the area, or leveraging feedback signals in the motion control system from the servo axes which control winding of the log. Some examples of suitable signals include torque or current feedback, or simply velocity error. Because significant noise is present within all of these signals, it is desirable to filter to improve the resolution of the instability measurement. One way to filter the signals would be to apply a time to frequency domain transform based on the average log diameter during the winding process relative to an optimized window of time series data stored in a FIFO updating each new sample. The fundamental frequency would also update each sample to the new average log diameter for the window of time series data. One possible methodology would be to use a Goertzel style algorithm, or conventional Discreet Fourier Transform (DFT), to calculate the continuous evolution of the power magnitude of the desired fundamental frequency and associated harmonics of the log rotation as it builds diameter. This signal can then be analyzed for characteristics, such as, but not limited to, absolute magnitude or rate of change. Given target characteristics, the line speed can be modulated to maintain the log stability within ideal bounds which would help maximize efficiency. Such techniques of compensating for rewinder log instability as indicated by sound or by drive feedback signals are complementary and can be combined with other methods in this disclosure for an improved overall production system.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A method of removing mandrels from successive rolls of convolutely wound web material comprising the steps of:

a) moving a roll of web convolutely wound around a mandrel to a position in which a longitudinal center axis of the mandrel is aligned with a center axis of a clasp, wherein the clasp is spaced apart from the mandrel along a path parallel to the longitudinal center axis of the mandrel, b) moving the clasp along the path parallel to the longitudinal center axis of the mandrel toward the roll from a puller stop position to a mandrel engagement position, the puller stop position being spaced away from the mandrel engagement position to allow the mandrel to be removed from the roll, c) stopping the movement of the clasp toward the roll only when the clasp is in the mandrel engagement position to engage the mandrel, d) engaging the mandrel with the clasp, e) moving the clasp and the mandrel away from the roll along the path parallel to the longitudinal center axis of the mandrel to withdraw the mandrel from the roll, f) releasing the mandrel from the clasp when the mandrel is removed from the roll, g) removing the mandrel from the path of the clasp, and h) repeating steps (a) through (g) for a subsequent roll.

2. The method of claim 1 wherein the mandrel is comprised of a material having a tensile yield strength divided by elastic modulus greater than 2.0%.

3. The method of claim 1 wherein the mandrel is at least one of substantially axially elastic, tubular, radially compliant, and homogeneous.

4. The method of claim 1 wherein the step of moving the clasp along the path parallel to the longitudinal center axis of the mandrel toward the roll further comprises inserting a prong of the clasp into an end of the mandrel.

5. The method of claim 4 wherein the step of engaging the end of the mandrel with the clasp further comprises clamping the mandrel between the prong and a plurality of clamping blocks of the clasp.

6. The method of claim 1 wherein the step of moving the clasp and the mandrel away from the roll along the path parallel to the longitudinal center axis of the mandrel comprises moving the clasp with a first velocity and moving the clasp with a second velocity, wherein the first velocity is lower than the second velocity.

7. The method of claim 6 wherein the step of moving the clasp and the mandrel away from the roll along the path parallel to the longitudinal center axis of the mandrel further comprises moving the clasp with a third velocity when the mandrel is removed from the roll, wherein the third velocity is lower than the second velocity.

8. The method of claim 1 wherein the step of moving the clasp and the mandrel away from the roll along the path parallel to the longitudinal center axis of the mandrel further comprises rotating the mandrel during at least a portion of the step of moving the clasp and the mandrel away from the roll.

9. The method of claim 1 wherein the step of moving the clasp and the mandrel away from the roll along the path parallel to the longitudinal center axis of the mandrel further comprises restraining the periphery of the roll from moving axially.

10. The method of claim 1 in which each of the steps is performed on a group of at least two rolls with at least two mandrels.

11. The method of claim 10 further comprising aligning the at least two rolls with at least two mandrels in the cross-direction before the step of moving the rolls to a position wherein the longitudinal center axis of each mandrel is aligned with the center axis of the respective clasp.

12. The method of claim 10 wherein the step of moving the at least two rolls to the positions wherein the longitudinal center axis of each mandrel is aligned with the center axis of the respective clasp occurs simultaneously for each of the at least two rolls.

13. The method of claim 1 in which the steps of moving the clasp and the mandrel away from the roll to withdraw the mandrel from the roll, and releasing the mandrel from the clasp when the mandrel has been removed from the roll, includes stopping the movement of the clasp away from the roll only when the mandrel has been withdrawn from the roll and the mandrel has been released from the clasp.

* * * * *